US008471470B1

(12) United States Patent
Wedding

(10) Patent No.: US 8,471,470 B1
(45) **Date of Patent: *Jun. 25, 2013**

(54) RADIATION SHIELDING

(75) Inventor: Carol Ann Wedding, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 40 days.

This patent is subject to a terminal disclaimer.

(21) Appl. No.: 13/423,309

(22) Filed: Mar. 19, 2012

Related U.S. Application Data

(63) Continuation-in-part of application No. 12/276,304, filed on Nov. 22, 2008, now Pat. No. 8,138,673, which is a continuation-in-part of application No. 10/431,446, filed on May 8, 2003, now Pat. No. 7,456,571.

(60) Provisional application No. 60/381,822, filed on May 21, 2002.

(51) Int. Cl.
*H01J 17/16* (2012.01)

(52) U.S. Cl.
USPC ..... 313/582; 313/567

(58) Field of Classification Search
USPC ..... 313/582–587, 567
See application file for complete search history.

(56) References Cited

U.S. PATENT DOCUMENTS

| | | | | |
|---|---|---|---|---|
| 2,599,944 | A * | 6/1952 | Salisbury | 342/1 |
| 6,870,519 | B2 * | 3/2005 | Sundahl | 345/1.3 |
| 8,138,673 | B1 * | 3/2012 | Wedding | 313/582 |

* cited by examiner

*Primary Examiner* — Joseph L Williams
(74) *Attorney, Agent, or Firm* — Donald K. Wedding

(57) ABSTRACT

Apparatus and method using a gas discharge device for screening or shielding an object and/or person from electromagnetic (EM) radiation including radar, microwaves, X-rays, and/or gamma rays. The device comprises multiple gas discharge cells, each cell being within a gas-filled hollow shell. The shells are located in one or more single substrates. The gas may be selected to absorb radiation when the gas is in a non-discharge or discharge state. The shell may be composed of a radiation absorption material. In one embodiment, two or more single substrates are tiled and sealed together edge to edge.

12 Claims, 49 Drawing Sheets

Top View

Section A-A View

Section B-B View

RADIATION SHIELDING

RELATED APPLICATIONS

This application is a continuation-in-part under 35 U.S.C. 120 of U.S. patent application Ser. No. 12/276,304 filed Nov. 22, 2008, to issue as U.S. Pat. No. 8,138,673 which is a continuation-in-part under 35 U.S.C. 120 of U.S. patent application Ser. No. 10/431,446 filed May 8, 2003, now U.S. Pat. No. 7,456,571, with a claim of priority under 35 U.S.C. 119(e) of U.S. Provisional Patent Application Ser. No. 60/381,822, filed May 21, 2002, all incorporated herein by reference.

FIELD OF THE INVENTION

This invention relates to electromagnetic (EM) radiation shielding using a gas discharge device such as a plasma display panel (PDP). In one embodiment, the gas discharge device comprises gas-filled shells called plasma-shells. Each hollow plasma-shell is filled with an ionizable gas and used as a gas discharge cell for radiation shielding or screening of an object and/or person from radar, microwaves, X-rays, gamma rays, and/or other electromagnetic radiation. In one embodiment the device is used to shield or screen radiation in the range of about 10 kilohertz (KHz) to about 100 gigahertz (Ghz). The shells or plasma-shells may have any suitable geometric shape such as a plasma-sphere, plasma-disc, plasma-dome, plasma-cube, or plasma-cuboid. This invention includes gas discharge structures wherein the plasma-shells are positioned on top of each other such as a stacking arrangement. In one embodiment, plasma-shells are positioned on opposite sides of a common substrate or base. Combinations of pairs of plasma-shells of different geometric shapes may be used such as plasma-discs and plasma-domes, plasma-discs and plasma-spheres, plasma-domes and plasma-spheres, plasma-discs and plasma-cubes, or plasma-cubes and plasma-cuboids. Three or more shells of different geometric shapes may be used such as plasma-discs, plasma-domes, and plasma-spheres or plasma-discs, plasma-cubes, and plasma-cuboids. There may also be used gas-filled elongated tubes called plasma-tubes alone or in combination with the gas-filled plasma-shells.

This invention particularly relates to using gas discharge shells and/or elongated tubes for shielding or screening an object or person from electromagnetic radiation such as microwaves or radar. This invention also relates to using plasma-shells and/or elongated plasma-tubes for sensing or detecting radiation such as gamma rays or other radiation from a nuclear source. Also the plasma-shells and/or elongated plasma-tubes may be used in medical applications to sense or shield X-rays or other radiation used in examining or treating patients.

In one embodiment, the plasma-shells and gas discharge cells are discretely operated such that each shell and gas discharge cell is operated separately and independently of other shells and gas discharge cells the same as a flat panel TV.

In another embodiment, some or all of the shells and gas discharge cells are electrically operated together in a collective or bulk mode as opposed to each being separately or discretely operated.

The shielding or detecting device may include different shells, each shell being tailored to shield and/or detect a certain kind and/or level of electromagnetic radiation. The tailoring includes making shells out of different materials, filling shells with different gases, and/or varying the geometric shapes of shells. With a variety of tailored shells, the device can be used to shield and/or detect different kinds and levels of electromagnetic radiation.

In some embodiments, the radiation shielding device is used to protect an object and/or person from electromagnetic radiation. This can be in a military setting to protect from microwaves or in a non-military setting to protect from X-rays in a medical application. In other embodiments, the radiation shielding device is used to camouflage an object and/or person from electromagnetic radiation such as radar, for example as shown in U.S. Pat. No. 3,427,619 (Wesch et al.), incorporated herein by reference. The shell may be constructed of radar absorbing materials (RAM) or other radiation absorbing material including ferro-magnetic particles such as iron, carbonyl iron, cobalt, nickel, and alloys as discussed below.

Radiation Shielding

The prior art discloses a variety of devices, materials, and methods for shielding or screening an object and/or person from electromagnetic radiation including radar, microwaves, X-rays, and gamma rays. These include the use of materials to absorb radiation such as radar with Radar Absorbent Materials called RAM. The prior art structures include a Salisbury screen, Dallenbach absorber, Jaumann absorber, and other structures.

Radar Absorbent Materials

Electromagnetic waves such as radar may be absorbed by a variety of materials. For radar these materials are called Radar Absorbent Materials (RAM). A material's absorbency at a given frequency of radar wave depends upon its composition.

RAM may include ferro-magnetic particles such as iron, carbonyl iron, cobalt, nickel, and alloys thereof. The radar waves induce molecular oscillations from the magnetic field of the iron particles and the radar energy is converted into heat which can be dissipated. The ferro-magnetic particles may be coated with a protective non-conducting material such as silicon, silicon dioxide, aluminum oxide, and other selected non-conductive inorganic oxides of metals and/or metalloids, for example as disclosed in U.S. Pat. No. 6,486,822 (Peterman), incorporated herein by reference.

RAM particles of carbonyl iron or ferrite may be applied as a surface coating, for example as disclosed in U.S. Pat. No. 5,147,718 (Papoulias et al.), incorporated herein by reference. A radar absorber for use as a sprayable paint as disclosed by Papoulias et al. '718 comprises an inner layer having an elastomeric carrier material with a carbonyl iron powder dispersed therein with a particle size of about 4 to 5 microns and an outer layer having an elastomeric carrier material with a carbonyl iron powder dispersed therein with a particle size of about 0.5 to 1.5 microns. U.S. Pat. No. 4,173,018 (Dawson et al.), incorporated herein by reference, discloses magnetizable particles dispersed in an insulating binder of thermosetting material.

RAM materials are disclosed in U.S. Pat. Nos. 5,552,455 (Schuler et al.) and 5,976,666 (Narang et al.), both incorporated herein by reference. Schuler et al. '455 uses a binder material containing a mixture of two groups of spheres made of a magnetic material. Narang et al. '666 discloses an EM device comprising a perforated electrical absorbing layer containing conductive polymers laminated to a metal plate. The device includes additional layers of electrical absorbing layers, magnetic layers, and impedance matching layers. The RAM include carbon-loaded soft foams for broadband absorption in the SHF band. The polymeric compositions include conductive block copolymers of polyoxazoline, polyoxazine, and combinations thereof.

U.S. Pat. No. 4,012,738 (Wright), incorporated herein by reference, discloses a microwave radiation absorber comprising a layer of dielectric material of high dielectric constant and a layer of magnetic material. The dielectric material is barium titanate. The magnetic material is a ferro-magnetic dielectric such as magnetic metal particles of iron, nickel, permalloy, and/or ferrite suspended in a dielectric binder of neoprene, polystyrene, or polyethylene. The high dielectric material may also be rubber or like material containing flakes of aluminum.

U.S. Pat. No. 5,866,273 (Wiggins et al.), incorporated herein by reference, discloses a RAM material comprising an iron-silicon powder made by blending magnetic materials such as carbonyl iron, iron cobalt, and/or nickel and pure silicon powders with an activator such as a halide salt and then heating the mixture to about 1350° F. to about 1600° F. in an inert atmosphere. The result is ground to a powder until it passes through a 200 mesh screen. It is then heated in air to form a thin protective layer about each particle of the powder. The powder is combined with a suitable binder to form a RAM coating.

A RAM structure may include a magnetic absorbing substance such as ferrite-based materials to absorb electromagnetic radiation. Homogeneous or mixed-ferrite compositions are used, examples include ferro-magnetic conductive materials such as carbonyl iron or ferrite oxide mixed with other oxides or ferrites, garnet and materials such as magnesium, nickel, lithium, yttrium, calcium vanadium, manganese-zinc ferrite, Ni—Zn ferrite, and magnetites. Hexagonal ferrite can be used. The Fe(III) irons in the lattice can be replaced with divalent, trivalent, and/or tetravalent ions such as Co(III) and Ti(IV).

Sintered ferro-magnetic materials may be used for electromagnetic wave absorption in the microwave range of about 500 MHz to 12 GHz. These materials include a sintered ferrite having a spinel structure and the formula $MFe_4O_4$ where M is a divalent metal such as Mn, Ni, Cu, Zn, Mg, and Co as disclosed in U.S. Pat. No. 2,830,162 (Copson et al.), incorporated herein by reference.

The sintered ferro-magnetic material includes spinel, garnet, magnetoplumbite, and perovskite compounds, for example as disclosed in U.S. Pat. No. 3,938,152 (Grimes et al.), incorporated herein by reference. The divalent metal may also be cadmium. Also mixed crystals of two or more ions having an average valence of 2 such as Li and Fe may be used as magnetic absorbers.

The sintered ferro-magnetic material may be dispersed in a high molecular weight organic or polymeric compound, for example as disclosed in U.S. Pat. No. 4,003,840 (Ishino et al.), incorporated herein by reference. The organic high molecular compounds include resins and rubbers such as phenol resins, polyester resins, epoxy resins, silicone resins, and thermoplastic resins such as polyethylene, polypropylene, and polyvinyl chloride. Also natural and synthetic rubbers may be used such as polychloroprene, acrylonitrile-butadiene-styrene and fluorine containing rubbers.

The RAM may include carbonaceous or graphite materials dispersed in a flexible foam for radar absorbing. The materials include pyrolyzed polyacrylonitrile (PAN), pitch based graphite particles, or other electrically conductive carbon black particles.

RAM may include conductive elements within a polymer matrix. Conductive elements include metal or metal plated particles, fabrics, meshes, fibers and combinations thereof. The metal or metal plated particles may be regularly or irregularly shaped including spheres and flakes. Metals include Cu, Ni, Ag, Al, tin and steel. Conductive carbon and graphite may also be used. Conductive polymers may be used such as polythiophenes, polypyroles, polyaniline, poly(p-phenylene) vinylene, polyphenylene sulfide polyphenylene, and polyacetylene.

Salisbury Screen

Electromagnetic waves such as radar may be shielded by a Salisbury screen as disclosed in U.S. Pat. Nos. 2,599,944 (Salisbury) and 4,314,682 (Barnett et al.), both incorporated herein by reference. The Salisbury screen is designed to absorb incoming electromagnetic radiation such as radar. It comprises a radar absorbent material (RAM) for electromagnetic waves that includes the matching of an outer layer of low conductivity material(s) spaced in front of an inner surface which is a good reflector for any electromagnetic radiation that reaches it through the outer layer. The outer low conductivity layer is typically spaced from the inner surface by a distance equal to one-quarter wave length of the particular electromagnetic radiation to be absorbed.

The outer layer of a Salisbury screen is generally a composite of wood and canvas coated with graphite. The inner surface is made of metal. In practice the outer layer is designed such that the radiation reflected from it will equal as nearly as possible the radiation passing through it that is reflected from the reflecting inner surface. When the proper free spacing is used between the outer layer and the inner surface, the electric and magnetic field from the outer layer will be 180 degrees out of phase field with the electric and magnetic field of radiation reflected from the inner surface so as to cancel or reduce the reflected radiation.

The outer layer of the Salisbury screen includes material having an impedance of about 377 ohms per square which is the characteristic impedance of the free space spaced exactly one-quarter wavelength from the reflective inner surface.

A Salisbury screen for broadband RF absorption is disclosed in U.S. Pat. No. 6,538,596 (Gilbert), incorporated herein by reference. The screen comprises a front spacecloth with a bulk resistance of 377 ohms and a ground plane. Three Frequency Selective Surfaces (FSS) are positioned parallel to and between the spacecloth and the ground plane. The 377 ohms impedance of an incoming plane wave combined with the high impedance plane wave reflected from the FSS and ground plane layers presents a 377 ohms impedance wavefront at the spacecloth.

Dallenbach Absorber

The Dallenbach absorber consists of a homogeneous lossy layer backed by a metallic plate or a lossy material that can absorb the radiation. Dallenbach absorbers are disclosed in U.S. Pat. Nos. 3,007,160 (Halpern), 5,275,880 (Boyer et al.), 5,381,149 (Dougherty et al.), and 7,420,500 (Treen et al.), all incorporated herein by reference.

Jaumann Absorbers

Microwave absorbers reduce the radar cross-section of an object such as an airborne object. A Jaumann absorber is a microwave absorber comprising multiple laminated layers on a reflecting surface, the laminated layers being lossy layers separated by dielectric spacing layers. Jaumann absorbers are disclosed in U.S. Pat. Nos. 2,822,539 (McMillan), 2,875,435 (McMillan), and 4,038,660 (Connolly et al.), all incorporated herein by reference.

Dipole Absorber

Absorbers can comprise multiple layers of conductive dipoles sandwiched between dielectric layers as disclosed, for example, in U.S. Pat. Nos. 5,223,849 (Kasevich et al.), 5,214,432 (Kasevich et al.), 5,325,094 (Broderick et al.), and 5,576,710 (Broderick et al.), all incorporated herein by reference.

Broadband Absorbers

The fabrication of broadband, inhomogeneous layer absorbers is different because of the need to vary the dielectric properties of the layer from that of air to the dielectric properties of the lossy material. The need arises because an analysis of the Fresnel coefficient for reflected irradiance at the interface between air and a lossy material shows that the incident EM radiation will be reflected unless the sharp discontinuity in electric and/or magnetic properties at the interface is smoothed out, that is the impedance or refractive index of the lossy material is matched to that of air.

Gas Discharge Structures and Operation

Gas discharge structures are used in display applications such as a flat panel TV. In a gas discharge plasma display panel (PDP), a single addressable picture element is a gas discharge cell, sometimes referred to as a pixel. In a multi-color PDP, two or more cells or pixels may be addressed as sub-cells or subpixels to form a single cell or pixel. As used herein cell or pixel means sub-cell or subpixel. The cell or pixel element is defined by two or more electrodes positioned in such a way so as to provide a voltage potential across a gap containing an ionizable gas. When sufficient voltage is applied across the gap, the gas discharges to produce visible and/or invisible light. In an AC gas discharge plasma display, the electrodes at a cell site are coated with a dielectric so as to insulate the electrodes from the gas. In a DC gas discharge plasma display, one or more electrodes is in electrical contact with the gas. The electrodes are generally grouped in a matrix configuration to allow for selective addressing of each cell or pixel.

The prior art discloses a variety of plasma display structures, methods of construction, and materials. Examples of open cell gas discharge (plasma) devices include both monochrome (single color) AC plasma displays and multi-color (two or more colors) AC plasma displays. Examples of AC gas discharge (plasma) displays are well known in the prior art and include those disclosed in U.S. Pat. Nos. 3,559,190 (Bitzer et al.), 3,499,167 (Baker et al.), 3,860,846 (Mayer), 3,964,050 (Mayer), 4,080,597 (Mayer), 3,646,384 (Lay), 4,126,807 (Wedding), 4,233,623 (Pavliscak), 4,320,418 (Pavliscak), 4,827,186 (Knauer et al.), 5,661,500 (Shinoda et al.), 5,674,553 (Shinoda et al.), 5,107,182 (Sano et al.), 5,182,489 (Sano), 5,075,597 (Salavin et al.), 5,742,122 (Amemiya et al.), 5,640,068 (Amemiya et al.), 5,736,815 (Amemiya), 5,541,479 (Nagakubi), 5,745,086 (Weber), and 5,793,158 (Wedding), all incorporated herein by reference.

DC gas discharge (plasma) displays are disclosed in U.S. Pat. Nos. 3,886,390 (Maloney et al.), 3,886,404 (Kurahashi et al.), 4,035,689 (Ogle et al.), and 4,532,505 (Holz et al.), all incorporated herein by reference.

The PDP industry has used two different AC plasma display panel (PDP) structures, the two-electrode columnar discharge structure, and the three-electrode surface discharge structure. Columnar discharge is also called co-planar discharge.

Columnar Discharge Structure

The two-electrode columnar or co-planar discharge plasma display structure is disclosed in U.S. Pat. Nos. 3,499,167 (Baker et al.) and 3,559,190 (Bitzer et al.). The two-electrode columnar discharge structure is also referred to as opposing electrode discharge, twin substrate discharge, or co-planar discharge. In the two-electrode columnar discharge AC plasma display structure, the sustaining voltage is applied between an electrode on a rear or bottom substrate and an opposite electrode on the front or top viewing substrate. The gas discharge takes place between the two opposing electrodes in between the top viewing substrate and the bottom substrate. The columnar discharge PDP structure has been widely used in monochrome AC plasma displays that emit orange or red light from a neon gas discharge. Luminescent materials such as phosphors may be used in a monochrome structure to obtain a color other than neon orange. In a multi-color columnar discharge PDP structure as disclosed in U.S. Pat. No. 5,793,158 (Wedding), phosphor stripes or layers are deposited along the barrier walls and/or on the bottom substrate adjacent to and extending in the same direction as the bottom electrode. In a two-electrode columnar discharge PDP as disclosed by Wedding '158, each light emitting pixel is defined by a gas discharge between a bottom or rear electrode x and a top or front opposite electrode y, each cross-over of the two opposing arrays of bottom electrodes x and top electrodes y defining a pixel or cell.

Surface Discharge Structure

The three-electrode multi-color surface discharge AC plasma display panel structure is widely disclosed in the prior art including U.S. Pat. Nos. 5,661,500 (Shinoda et al.), 5,674,553 (Shinoda et al.), 5,745,086 (Weber), and 5,736,815 (Amemiya), all incorporated herein by reference. In a surface discharge PDP, each light emitting pixel or cell is defined by the gas discharge between two-electrodes on the top substrate. In a multi-color RGB display, the pixels may be called subpixels or sub-cells. Photons from the discharge of an ionizable gas at each pixel or subpixel excite a photoluminescent phosphor that emits red, blue, or green light. In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate. In a three-electrode surface discharge AC plasma display panel, the sustaining voltage and resulting gas discharge occurs between the electrode pairs on the top or front viewing substrate above.

Single Substrate Discharge Structure

There may be used a gas discharge structure having a single substrate or monolithic plasma display panel structure having one substrate with or without a top or front viewing envelope or dome. Single substrate or monolithic plasma display panel structures are known in the prior art and are disclosed by U.S. Pat. Nos. 3,646,384 (Lay), 3,652,891 (Janning), 3,666,981

(Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference.

Prior Art Radiation Detectors

Radiation detectors are well known in the prior art including gas-filled detectors. The following prior art relates to radiation detectors: U.S. Pat. Nos. 3,110,835 (Richter et al.), 4,201,692 (Christophorou et al.), 4,309,309 (Christophorou et al.), 4,553,062 (Ballon et al.), 4,855,889 (Blanchot et al.), 5,905,262 (Spanswick), U.S. Patent Application Publication 2004/0027269 (Howard), and WO 98/28635 (Koster et al.), all incorporated herein by reference. Gas discharge plasma display panels have also been used for radiation detection as disclosed in U.S. Pat. No. 7,375,342 issued to Carol Ann Wedding, incorporated herein by reference.

Prior Art Spheres, Beads, Ampoules, Capsules

The construction of a PDP out of gas-filled hollow microspheres is disclosed in the prior art. Such microspheres are referred to as spheres, beads, ampoules, capsules, bubbles, shells, and so forth. The following prior art relates to the use of microspheres in a PDP and are incorporated herein by reference.

U.S. Pat. No. 2,644,113 (Etzkorn) discloses ampoules or hollow glass beads containing luminescent gases that emit a colored light. In one embodiment, the ampoules are used to radiate ultraviolet light onto a phosphor external to the ampoule itself. U.S. Pat. No. 3,848,248 (MacIntyre) discloses the embedding of gas-filled beads in a transparent dielectric. The beads are filled with a gas using a capillary. The external shell of the beads may contain phosphor. U.S. Pat. No. 3,998,618 (Kreick et al.) discloses the manufacture of gas-filled beads by the cutting of tubing. The tubing is cut into ampoules and heated to form shells. The gas is a rare gas mixture of 95% neon and 5% argon at a pressure of 300 Torr. U.S. Pat. No. 4,035,690 (Roeber) discloses a plasma panel display with a plasma forming gas encapsulated in clear glass shells. Roeber used commercially available glass shells containing gases such as air, $SO_2$ or $CO_2$ at pressures of 0.2 to 0.3 atmosphere. Roeber discloses the removal of these residual gases by heating the glass shells at an elevated temperature to drive out the gases through the heated walls of the glass shell. Roeber obtains different colors from the glass shells by filling each shell with a gas mixture which emits a color upon discharge and/or by using a glass shell made from colored glass. U.S. Pat. No. 4,963,792 (Parker) discloses a gas discharge chamber including a transparent dome portion. U.S. Pat. No. 5,326,298 (Hotomi) discloses a light emitter for giving plasma light emission. The light emitter comprises a resin including fine bubbles in which a gas is trapped. The gas is selected from rare gases, hydrocarbons, and nitrogen. U.S. Pat. No. 6,545,422 (George et al.) discloses a light-emitting panel with a plurality of sockets with spherical or other shape micro-components in each socket sandwiched between two substrates. The micro-component is filled with a plasma-forming gas. Other U.S. patents issued to George et al. and various joint inventors include U.S. Pat. Nos. 6,570,335 (George et al.), 6,612,889 (Green et al.), 6,620,012 (Johnson et al.), 6,646,388 (George et al.), 6,762,566 (George et al.), 6,764,367 (Green et al.), 6,791,264 (Green et al.), 6,796,867 (George et al.), 6,801,001 (Drobot et al.), 6,822,626 (George et al.), 6,902,456 (George et al.), 6,935,913 (Wyeth et al.), 6,975,068 (Green et al.), 7,005,793 (George et al.), 7,025,648 (Green et al.), 7,125,305 (Green et al.), 7,137,857 (George et al.), 7,140,941 (Green et al.), and 7,288,014 (George et al.). Also incorporated herein by reference are U.S. Patent Application Publication Nos. 2004/0063373 (Johnson et al.), 2005/0095944 (George et al.), and 2006/0097620 (George et al.).

Also incorporated herein by reference are U.S. Pat. Nos. 6,864,631 (Wedding) and 7,247,989 (Wedding), which disclose a PDP comprised of microspheres filled with ionizable gas.

Related Prior Art PDP Tubes

The following prior art references relate to the use of elongated tubes in a PDP and are incorporated herein by reference. U.S. Pat. No. 3,602,754 (Pfaender et al.) discloses a multiple discharge gas display panel in which filamentary or capillary size glass tubes are assembled to form a gas discharge panel. U.S. Pat. Nos. 3,654,680 (Bode et al.), 3,927,342 (Bode et al.) and 4,038,577 (Bode et al.) disclose a gas discharge display in which filamentary or capillary size gas tubes are assembled to form a gas discharge panel. U.S. Pat. No. 3,969,718 (Strom) discloses a plasma display system utilizing tubes arranged in a side-by-side parallel fashion. U.S. Pat. No. 3,990,068 (Mayer et al.) discloses a capillary tube plasma display with a plurality of capillary tubes arranged parallel in a close pattern. U.S. Pat. No. 4,027,188 (Bergman) discloses a tubular plasma display consisting of parallel glass capillary tubes sealed in a plenum and attached to a rigid substrate. U.S. Pat. No. 5,984,747 (Bhagavatula et al.) discloses rib structures for containing plasma in electronic displays that are formed by drawing glass preforms into fiber-like rib components. The rib components are then assembled to form rib/channel structures suitable for flat panel displays. U.S. Pat. No. 6,255,777 (Kim et al.) and U.S. Patent Application Publication 2002/0017863 (Kim et al.), disclose a capillary electrode discharge PDP device and a method of fabrication. PDP structures with elongated display tubes are disclosed in U.S. Pat. Nos. 7,208,203 (Yamada et al.), 7,083,681 (Yamada et al.), 7,049,748 (Tokai et al.), 6,969,292 (Tokai et al.), 6,932,664 (Yamada et al.), 6,930,442 (Awamoto et al.), 6,914,382 (Ishimoto et al.), 6,893,677 (Yamada et al.), 6,857,923 (Yamada et al.), 6,841,929 (Ishimoto et al.), 6,836,064 (Yamada et al.), 6,836,063 (Ishimoto et al.), 6,794,812 (Yamada et al.), 6,677,704 (Ishimoto et al.), 6,650,055 (Ishimoto et al.), and 6,633,117 (Shinoda et al.) and U.S. Patent Application Publication 2003/0182967 (Tokai et al.), all incorporated herein by reference. Elongated gas-filled plasma-tubes are also disclosed in U.S. Pat. Nos. 7,122,961 (Wedding), 7,157,854 (Wedding), and 7,176,628 (Wedding), all incorporated herein by reference. As used herein elongated tube is intended to include capillary, filament, filamentary, illuminator, hollow rods, or other such terms. It includes an elongated enclosed gas-filled structure having a length dimension, which is greater than its cross-sectional width or height dimensions. Also as used herein, an elongated plasma-tube has multiple gas discharge pixels of about 100 or more, typically about 500 to 1000 or more, whereas a plasma-shell typically has only one gas discharge pixel. In some special embodiments, the plasma-shell may have more than one pixel, i.e., 2, 3, or 4 pixels up to about 10 pixels. The U.S. Patents issued to George et al. and listed above as microsphere prior art also disclose elongated tubes and are incorporated herein by reference.

Related Prior Art Methods of Producing Microspheres

Any suitable method or process may be used to produce plasma-shells including plasma-spheres, plasma-discs, plasma-domes, plasma-cubes, and plasma-cuboids. Methods and processes to produce microspheres are disclosed in the prior art. Microspheres have been formed from glass, ceramic, metal, plastic, and other inorganic and organic materials. Some methods used to produce hollow glass microspheres incorporate a blowing gas into the lattice of a glass while in frit form. The frit is heated and glass bubbles are formed by the in-permeation of the blowing gas. Microspheres formed by this method have diameters ranging from about 5 μm to approximately 5,000 μm. Methods of manufacturing glass frit for forming hollow microspheres are disclosed by U.S. Pat. Nos. 4,017,290 (Budrick et al.) and 4,021,253 (Budrick et al.). Budrick et al. '290 discloses a process whereby occluded material gasifies to form the hollow microsphere. Hollow microspheres are disclosed in U.S. Pat. Nos. 5,500,287 (Henderson) and 5,501,871 (Henderson). According to Henderson '287, the hollow microspheres are formed by dissolving a permeant gas (or gases) into glass frit particles. The gas permeated frit particles are heated at a high temperature sufficient to blow the frit particles into hollow microspheres containing the permeant gases. The gases may be subsequently out-permeated and evacuated from the hollow shell as described in step D in column 3 of Henderson '287. U.S. Pat. No. 4,257,798 (Hendricks et al.), incorporated herein by reference, discloses a method for manufacturing small hollow glass spheres filled with a gas introduced during the formation of the spheres. The gases include argon, krypton, xenon, bromine, DT, hydrogen, deuterium, helium, hydrogen, neon, and carbon dioxide. Other Hendricks patents for the manufacture of glass spheres include U.S. Pat. Nos. 4,133,854 and 4,186,637, both incorporated herein by reference. Microspheres are also produced as disclosed in U.S. Pat. No. 4,415,512 (Torobin), incorporated herein by reference. The Torobin method comprises forming a film of molten glass across a blowing nozzle and applying a blowing gas at a positive pressure on the inner surface of the film to blow the film and form an elongated cylinder shaped liquid film of molten glass. An inert entraining fluid is directed over and around the blowing nozzle at an angle to the axis of the blowing nozzle so that the entraining fluid dynamically induces a pulsating or fluctuating pressure at the opposite side of the blowing nozzle in the wake of the blowing nozzle. The continued movement of the entraining fluid produces asymmetric fluid drag forces on a molten glass cylinder, which close and detach the elongated cylinder from the coaxial blowing nozzle. Surface tension forces acting on the detached cylinder form the latter into a spherical shape, which is rapidly cooled and solidified by cooling means to form a glass microsphere. In one embodiment of the above method for producing the microspheres, the ambient pressure external to the blowing nozzle is maintained at a super atmospheric pressure. The ambient pressure external to the blowing nozzle is such that it substantially balances, but is slightly less than the blowing gas pressure. Such a method is disclosed by U.S. Pat. No. 4,303,432 (Torobin) and WO 8000438A1 (Torobin), both incorporated herein by reference. The microspheres may also be produced using a centrifuge apparatus and method as disclosed by U.S. Pat. No. 4,303,433 (Torobin) and WO8000695A1 (Torobin), both incorporated herein by reference. Other methods for forming microspheres of glass, ceramic, metal, plastic, and other materials are disclosed in other Torobin patents including U.S. Patent Nos. 5,397,759; 5,225,123; 5,212,143; 4,793,980; 4,777,154; 4,743,545; 4,671,909; 4,637,990; 4,582,534; 4,568,389; 4,548,196; 4,525,314; 4,415,512; 4,363,646; 4,303,736; 4,303,732; 4,303,731; 4,303,603;4,303,433; 4,303,432; 4,303,431; 4,303,730; 4,303,729; and 4,303,061, all incorporated herein by reference. U.S. Pat. Nos. 3,607,169 (Coxe) and 4,303,732 (Torobin) disclose an extrusion method in which a gas is blown into molten glass and individual shells are formed. As the shells leave the chamber, they cool and some of the gas is trapped inside. U.S. Pat. No. 4,349,456 (Sowman), incorporated herein by reference, discloses a process for making ceramic metal oxide microspheres by blowing a slurry of ceramic and highly volatile organic fluid through a coaxial nozzle. As the liquid dehydrates, gelled microcapsules are formed. These microcapsules are recovered by filtration, dried, and fired to convert them into microspheres. Prior to firing, the microcapsules are sufficiently porous such that, if placed in a vacuum during the firing process, the gases can be removed and the resulting microspheres will generally be impermeable to ambient gases. The shells formed with this method may be easily filled with a variety of gases and pressurized from near vacuums to above atmosphere. This is a suitable method for producing microspheres. U.S. Patent Application Publication 2002/0004111 (Matsubara et al.), incorporated herein by reference, discloses a method of preparing hollow glass microspheres by adding a combustible liquid (kerosene) to a material containing a foaming agent. Methods for forming microspheres are also disclosed in U.S. Pat. Nos. 3,848,248 (MacIntyre), 3,998,618 (Kreick et al.), and 4,035,690 (Roeber), discussed above and incorporated herein by reference. Methods of manufacturing hollow microspheres are also disclosed in U.S. Pat. Nos. 3,794,503 (Netting), 3,796,777 (Netting), 3,888,957 (Netting), and 4,340,642 (Netting et al.), all incorporated herein by reference. Other prior art methods for forming microspheres are disclosed in U.S. Pat. Nos. 3,528,809 (Farnand et al.), 3,975,194 (Farnand et al.), 4,025,689 (Kobayashi et al.), 4,211,738 (Genis), 4,307,051 (Sargeant et al.), 4,569,821 (Duperray et al.), 4,775,598 (Jaeckel), and 4,917,857 (Jaeckel et al.), all incorporated herein by reference. These references disclose a number of methods which comprise an organic core such as naphthalene or a polymeric core such as foamed polystyrene which is coated with an inorganic material such as aluminum oxide, magnesium, refractory, carbon powder, and the like. The core is removed such as by pyrolysis, sublimation, or decomposition and the inorganic coating sintered at an elevated temperature to form a sphere or microsphere. Farnand et al. '809 discloses the production of hollow metal spheres by coating a core material such as naphthalene or anthracene with metal flakes such as aluminum or magnesium. The organic core is sublimed at room temperature over 24 to 48 hours. The aluminum or magnesium is then heated to an elevated temperature in oxygen to form aluminum or magnesium oxide. The core may also be coated with a metal oxide such as aluminum oxide and reduced to metal. The resulting hollow spheres are used for thermal insulation, plastic filler, and bulking of liquids such as hydrocarbons. Farnand '194 discloses a similar process comprising polymers dissolved in naphthalene including polyethylene and polystyrene. The core is sublimed or evaporated to form hollow spheres or microballoons. Kobayashi et al. '689 discloses the coating of a core of polystyrene with carbon powder. The core is heated and decomposed and the carbon powder heated in argon at 3000° C. to obtain hollow porous graphitized spheres. Genis '738 discloses the making of lightweight aggregate using a nucleus of expanded polystyrene pellet with outer layers of sand and cement. Sargeant et al. '051 discloses the making of light weight-refractories by wet spraying core particles of polystyrene with an aqueous refractory coating such as clay with alumina, magnesia, and/or other oxides. The core particles are subject to a tumbling action during the wet spraying and fired at 1730° C. to form porous refractory. Duperray et al.

'821 discloses the making of a porous metal body by suspending metal powder in an organic foam, which is heated to pyrolyze the organic and sinter the metal. Jaeckel '598 and Jaeckel et al. '857 disclose the coating of a polymer core particle such as foamed polystyrene with metals or inorganic materials followed by pyrolysis on the polymer and sintering of the inorganic materials to form the sphere. Both disclose the making of metal spheres such as copper or nickel spheres which may be coated with an oxide such as aluminum oxide. Jaeckel et al. '857 further discloses a fluid bed process to coat the core.

SUMMARY OF INVENTION

This invention relates to apparatus and method comprising a gas discharge device for shielding or screening an object and/or a person from electromagnetic radiation such as radar, microwaves, X-rays, or gamma rays. In one embodiment there is used gas-filled shells called plasma-shells to absorb the electromagnetic radiation. The gas discharge device may be an AC and/or DC plasma display panel (PDP) constructed out of gas-filled plasma-shells. The gas discharge device comprises one or more gas-filled shells or plasma-shells on or within a rigid, flexible, or semi-flexible substrate. Each plasma-shell may be electrically connected to one or more electrical conductors such as electrodes for providing gas discharge voltages. However, in some embodiments, the incoming radiation may cause the gas discharge with or without gas discharge voltages being provided. Insulating bathers may be used to prevent contact between the electrodes. The shell or plasma-shell is of any suitable geometric shape including a plasma-sphere, plasma-disc, plasma-dome, plasma-cube, or plasma-cuboid. Elongated gas-filled tubes can be used in combination with plasma-shells.

A plasma-sphere is a hollow sphere. The shell may be composed of a dielectric material including a material that absorbs radiation such as RAM. It is filled with an ionizable gas at a desired mixture and pressure. The gas is selected to absorb radiation before gas discharge and/or during gas discharge when a voltage is applied. The electromagnetic radiation may also be used to cause the gas discharge. The shell material is selected to optimize dielectric properties and/or RAM and radiation transmissivity. Additional beneficial materials may be added to the inside or outer surface of the sphere including magnesium oxide for secondary electron emission. The magnesium oxide and other materials including both organic and/or inorganic substances may also be added directly to the shell material.

A plasma-disc is similar to the plasma-sphere in material composition and gas selection. It differs from the plasma-sphere in that it has a disc shape and is flattened on two opposing sides such as both the top and bottom or the front and the back. A plasma-sphere or sphere may be flattened on opposing sides to form a plasma-disc or disc by applying heat and pressure simultaneously to the top and bottom of the sphere using two substantially flat and ridged members, either of which may be heated. Other sides or ends of the disc may be flat or round.

A plasma-dome is similar to a plasma-sphere in material composition and ionizable gas selection. It differs in that one side is domed. A plasma-sphere is flattened on one or more other sides to form a plasma-dome, typically by applying heat and pressure simultaneously to the top and bottom of the plasma-sphere or sphere using one substantially flat and ridged member and one substantially elastic or dome curved member. In one embodiment, the substantially rigid member is heated.

A plasma-cube is a hollow shell with six flat sides. It is a regular shape with six congruent square faces, the angle between any two adjacent faces being a right angle. It can be formed on a mold under pressure with or without heat.

A plasma-cuboid is an elongated cube with six flat sides. It is also known as a rectangular parallelepiped. It can be made in the same way as a cube.

In addition to spheres, discs, domes, cubes, and cuboids, other geometric shapes are contemplated. Depending upon the geometric shape and size of each plasma-shell, the plasma-shells can be tightly packed together so as to minimize void or non-shielding space between plasma-shells. In one embodiment, multiple plasma-shells are stacked or layered, one plasma-shell located over or above another plasma-shell. In another embodiment, plasma-shells are positioned on opposite sides of a common substrate or base. These plasma-shells located on opposite sides of the same substrate may be stacked or layered. Plasma-tubes may also be stacked or positioned on opposite sides of the same substrate alone or in combination with plasma-shells. The stacking is enhanced by using plasma-shells with one or more flat surfaces such as plasma-discs or plasma-domes or plasma-tubes with one or more flat surfaces.

The plasma-shells and/or plasma-tubes can be made of different materials and/or filled with different gases so as to shield different kinds of radiation and/or different levels of radiation.

In one embodiment, plasma-shells and/or plasma-tubes located in the same plane are made of different materials and/or are filled with different gases for the shielding of different kinds and/or different levels of radiation. A mix of shells or plasma-shells of different geometric shapes may be used.

In another embodiment, the plasma-shells and/or plasma-tubes located in two or more different planes are made of different materials and/or are filled with different gases for radiation shielding. A mix of shells or plasma-shells of different geometric shapes may be used.

In another embodiment, plasma-shells and/or plasma-tubes are located on opposite sides of a common substrate and are made of different materials and/or filled with different gases. A mix of shells or plasma-shells of different geometric shapes may be used.

In another embodiment, the plasma-shells and/or plasma-tubes are used to sense or detect radiation such as radar, microwaves, X-rays, or gamma rays. The radiation sensing or detecting may comprise the viewing of visual photons emitted by one or more plasma-shells or plasma-tubes during gas ionization or gas discharge. The sensing may also be by means of a separate reader/recorder located within or externally of the device.

The radiation shielding device may use a plasma display panel (PDP) with a multiplicity of pixels, each pixel being defined by a hollow plasma-shell filled with an ionizable gas for shielding and/or sensing radiation. Each plasma-shell may also contain a radiation shielding and/or sensing material. Multiple plasma-shells may be positioned in two or more separate planes. In one embodiment, plasma-shells are stacked or layered in planes on a common base such as a flat substrate. In another embodiment, plasma-shells are located in separate planes on the opposite sides of a common base such as a flat substrate. Luminescent material may be positioned near or on each plasma-shell to provide or enhance light output for visual sensing. A flexible base substrate may be used for wrapping a layer or blanket of plasma-shells around a selected object and/or person to be protected from radiation.

DETAILED DESCRIPTION OF DRAWINGS

In accordance with this invention, there is provided apparatus and method utilizing gas-filled hollow shells such as plasma-shells arranged in an array or in other suitable configuration for shielding or screening an object or person from electromagnetic radiation such as radar, microwaves, X-rays, and gamma rays. As illustrated herein, at least two conductors or electrodes are electrically connected to a gas-filled shell located within or on a rigid, flexible, or semi-flexible substrate or other body. An electrically conductive or insulating dielectric bonding substance may be applied to the substrate or to each plasma-shell. In one embodiment, each electrical connection to each shell is physically separated from each other electrical connection to the shell by an insulating barrier so as to prevent shorting of electrodes and/or to prevent the conductive substance forming one electrical connection from flowing and electrically shorting out another electrical connection. The plasma-shell may be of any suitable geometric shape including a plasma-sphere, plasma-dome, plasma-disc, plasma-cube, or plasma-cuboid. In one embodiment of this invention, there is used a PDP comprised of one or more plasma-discs alone or in combination with one or more other plasma-shells of different geometric shapes. The practice of this invention is illustrated and described hereafter with respect to a gas discharge device with plasma-discs and a plasma display panel (PDP). However, other plasma-shell shapes are contemplated and may be used. Luminescent material may be positioned near or on each plasma-shell to provide or enhance light output.

Figure 1B:
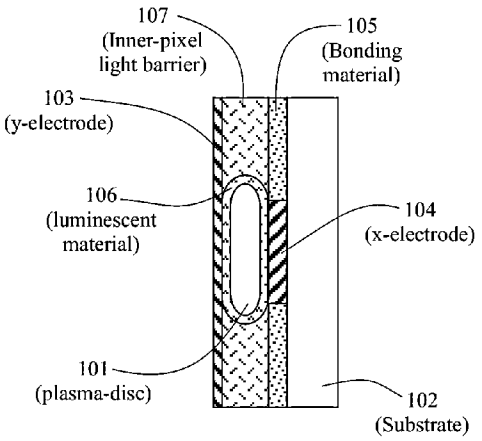
FIG. 1B is a section 1B-1B of FIG. 1.
Figure 1C:
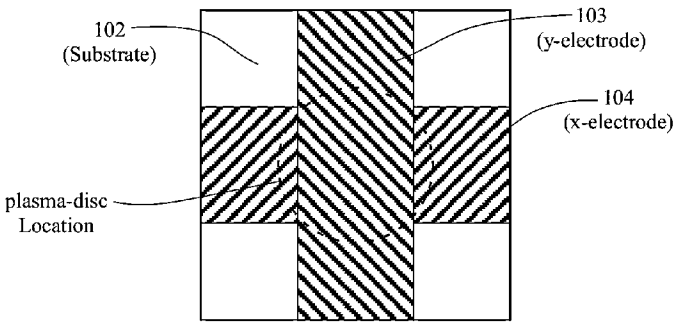
FIG. 1C is a top view of the FIG. 1 substrate showing the x-electrode and y-electrode configuration with the plasma-disc location shown with broken lines.
Figure 1:
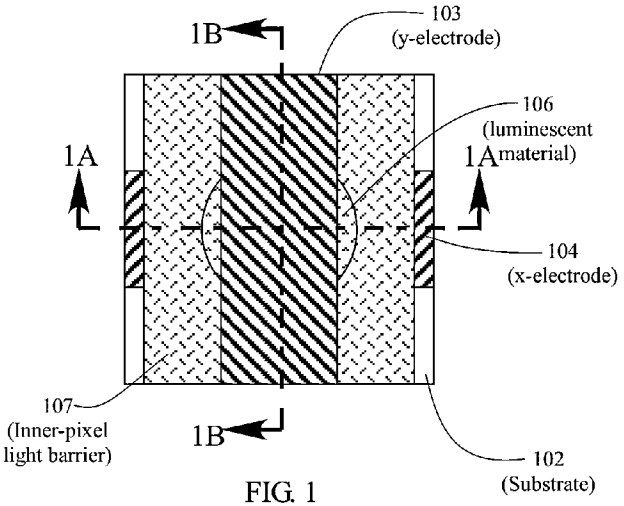
FIG. 1 is a top view of a plasma-disc mounted on a substrate with x-electrode and y-electrode.
Figure 1A:
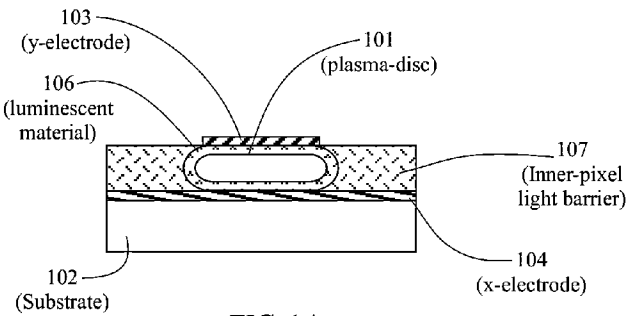
FIG. 1A is a section 1A-1A of FIG. 1.

FIG. 1 shows substrate 102 with transparent y-electrode 103, luminescent material 106, x-electrode 104, and inner-pixel light barrier 107. The y-electrode 103 and x-electrode 104 are cross-hatched for identification purposes. The y-electrode 103 is transparent because it is shown as covering much of the plasma-disc 101 not shown in FIG. 1. FIG. 1A is a section 1A-1A view of FIG. 1 and FIG. 1B is a section 1B-1B view of FIG. 1, each section view showing the plasma-disc 101 mounted on the surface of substrate 102 with top y-electrode 103 and bottom x-electrode 104, and inner-pixel light barrier 107. The plasma-disc 101 is attached to the substrate 102 with bonding material 105. Luminescent material 106 is located on the top surface of plasma-disc 101. In one embodiment, the plasma-disc 101 is partially or completely coated with the luminescent material 106. As illustrated in FIGS. 1A and 1B plasma-disc 101 is sandwiched between a y-electrode 103 and x-electrode 104. Inner-pixel light barrier 107 is of substantially the same thickness or height as plasma-disc 101. The light barrier may extend and bridge between adjacent pixels. This allows the transparent y-electrode 103 to be applied to a substantially flat surface. The light barrier 107 is made of an opaque or non-transparent material to prevent optical cross-talk between adjacent plasma-discs. The plasma-disc 101 is attached to the substrate 102 with bonding material 105. As practiced in this invention, bonding material is applied to the entire substrate 102 before the plasma-disc 101 is attached. Bonding material 105 may coat some or all of the x-electrode. Bonding material provides a dielectric interface between the electrode and the plasma-disc 101. The bonding material 105 can be of any suitable adhesive substance. In one embodiment hereof, there is used a so-called Z-Axis electrically conductive tape such as manufactured by 3M. FIG. 1C shows the electrodes 103 and 104 on the substrate 102 with the location of the plasma-disc 101 (not shown) indicated with broken lines.

Figure 2B:
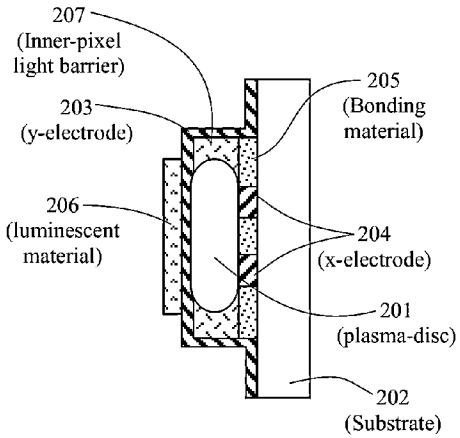
FIG. 2B is a section 2B-2B of FIG. 2.
Figure 2C:
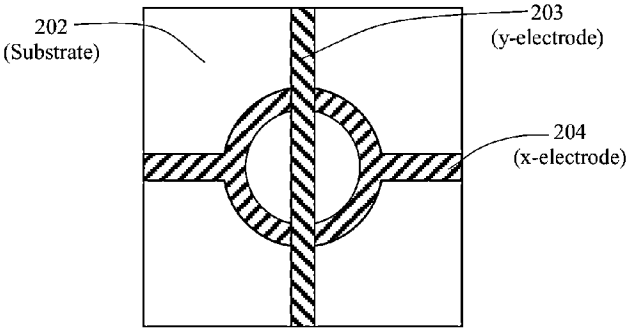
FIG. 2C is a top view of the FIG. 2 substrate showing the x-electrode and y-electrode configuration without the plasma-disc.
Figure 2:
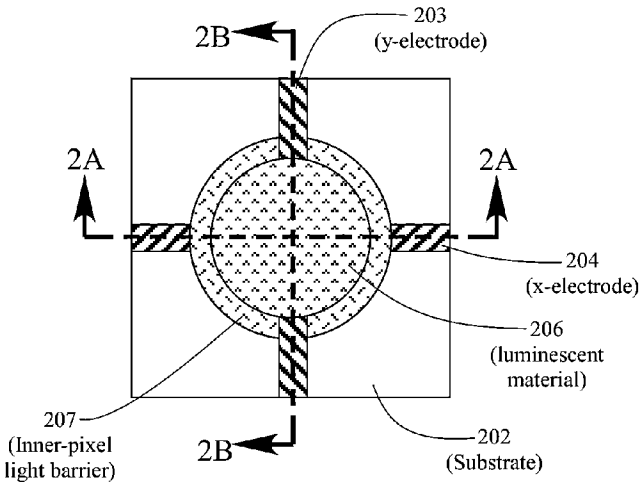
FIG. 2 is a top view of a plasma-disc mounted on a substrate with x-electrode and y-electrode.
Figure 2A:
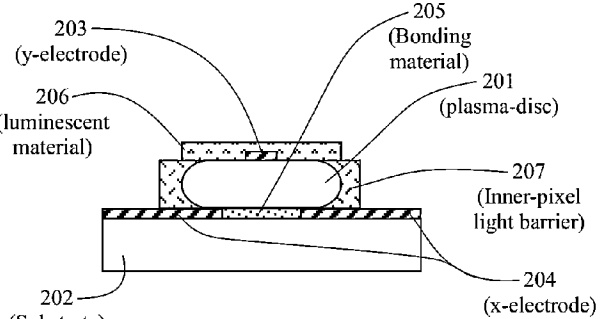
FIG. 2A is a section 2A-2A of FIG. 2.

FIG. 2 shows substrate 202 with y-electrode 203, luminescent material 206, x-electrode 204, and inner-pixel light barrier 207. The y-electrode 203 and x-electrode 204 are cross-hatched for identification purposes. The y-electrode 203 may be transparent or not depending upon its width and obscurity of the plasma-disc 201 not shown in FIG. 2. In this embodiment, the inner-pixel light barrier 207 does not extend and form a bridge between adjacent pixels. FIG. 2A is a section 2A-2A view of FIG. 2 and FIG. 2B is a section 2B-2B view of FIG. 2, each section view showing the plasma-disc 201 mounted on the surface of substrate 202 with top y-electrode 203 and bottom x-electrode 204, and inner-pixel light barrier 207. The plasma-disc 201 is attached to the substrate 202 with bonding material 205. The luminescent material 206 is located on the top surface of the plasma-disc 201. FIG. 2C shows the y-electrode 203 and x-electrode 204 on the substrate 202, the x-electrode 204 being in a donut configuration where the plasma-disc 201 (not shown) is to be positioned. In this FIG. 2 embodiment the discharge between the x-electrode and y-electrode will first occur at the intersection of electrodes 203 and 204 and spread around the donut shape of 204. This spreading of the discharge from a small gap to a wide gap increases efficiency. Other electrode configurations are contemplated.

Figure 3B:
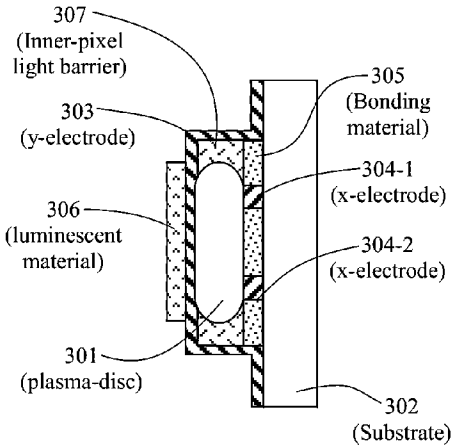
FIG. 3B is a section 3B-3B of FIG. 3.
Figure 3C:
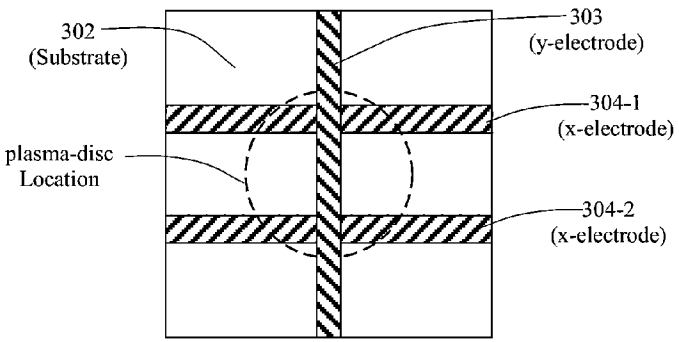
FIG. 3C is a top view of the FIG. 3 substrate showing the x-electrodes and y-electrode configuration with the plasma-disc location shown with broken lines.
Figure 3:
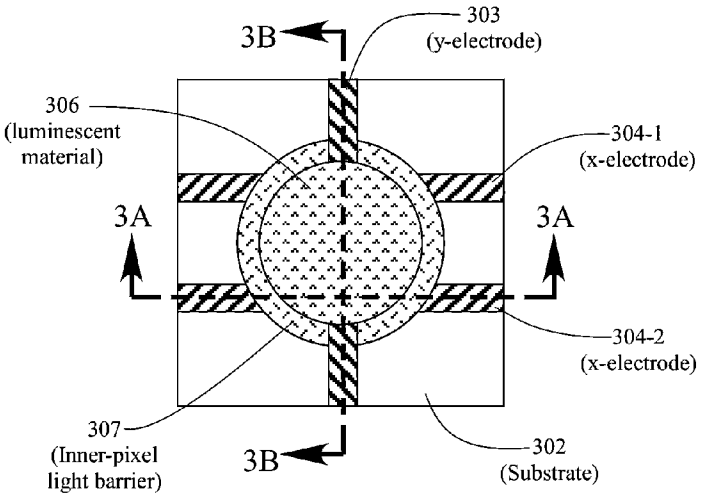
FIG. 3 is a top view of a plasma-disc mounted on a substrate with two x-electrodes and one y-electrode.
Figure 3A:
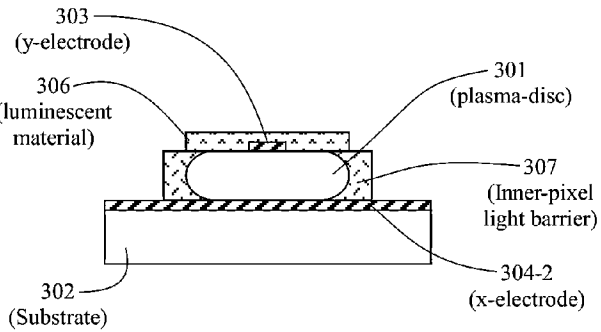
FIG. 3A is a section of 3A-3A of FIG. 3.

FIGS. 3, 3A, 3B, and 3C are several views of a three-electrode configuration and embodiment employing positive column discharge. FIG. 3 shows substrate 302 with top y-electrode 303, dual bottom x-electrodes 304-1, 304-2, luminescent material 306, and inner-pixel light barrier 307. The y-electrode 303 and x-electrodes 304-1, 304-2 are cross-hatched for identification purposes. FIG. 3A is a section 3A-3A view of FIG. 3 and FIG. 3B is a section 3B-3B view of FIG. 3, each section view showing the plasma-disc 301 mounted on the surface of the substrate 302 with top y-electrode 303 and dual bottom x-electrodes 304-1 and 304-2, inner-pixel light barrier material 307, and luminescent material 306. The plasma-disc 301 is attached to the substrate 302 with bonding material 305. The luminescent material 306 is on top of the plasma-disc 301. FIG. 3C shows the electrodes 303, 304-1, and 304-2 on the substrate 302 with the location of the plasma-disc 301 (not shown) indicated with broken lines. This embodiment is similar to the FIG. 2 embodiment except that the donut shaped x-electrode is replaced with two independent x-electrodes 304-1 and 304-2. After a discharge is initiated at the intersection of electrode 303 and 304-1 or 304-2, it is maintained by a longer positive column discharge between 304-1 and 304-2.

Figure 4B:
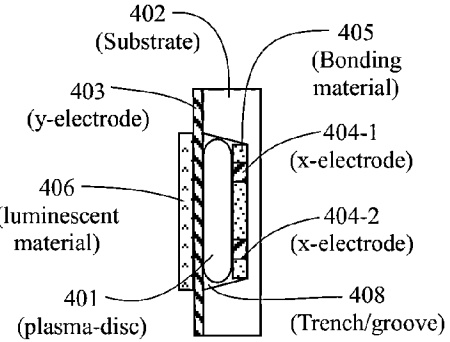
FIG. 4B is a section of 4B-4B of FIG. 4.
Figure 4C:
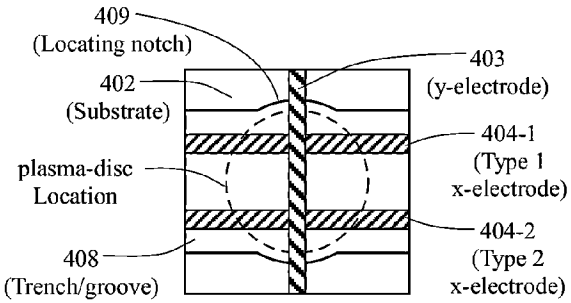
FIG. 4C is a top view of the substrate and electrodes in FIG. 4 with the plasma-disc location shown in broken lines.
Figure 4:
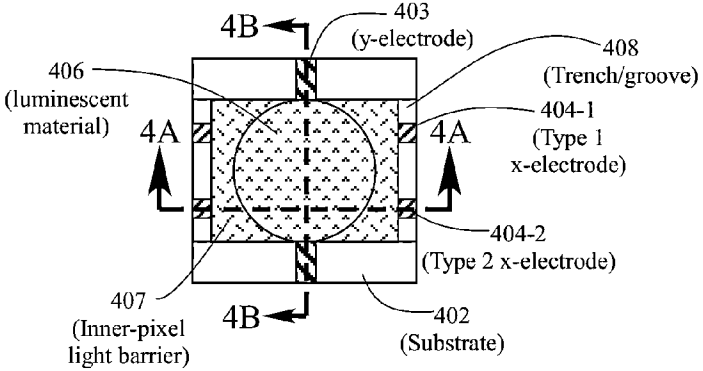
FIG. 4 is a top view of a plasma-disc mounted on a substrate with two x-electrodes and one y-electrode.
Figure 4A:
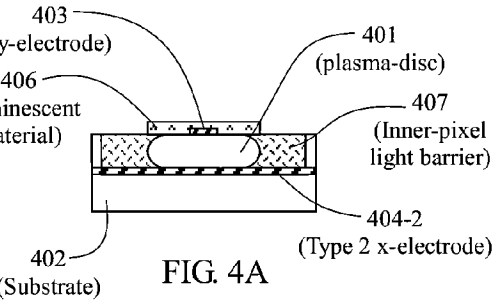
FIG. 4A is a section 4A-4A of FIG. 4.

FIGS. 4, 4A, 4B, and 4C are several views of a three-electrode configuration and embodiment in which the plasma-disc 401 is embedded in a trench or groove 408. FIG. 4 shows substrate 402 with top y-electrode 403, dual bottom x-electrodes 404-1, 404-2, luminescent material 406, inner-pixel light barrier 407 and trench or groove 408. The y-electrode 403 and x-electrodes 404-1, 404-2 are cross-hatched for identification purposes. FIG. 4A is a section 4A-4A view of FIG. 4 and FIG. 4B is a section 4B-4B view of FIG. 4, each section view showing the plasma-disc 401 mounted in the trench or groove 408 on the surface of the substrate 402 with top y-electrode 403 and dual bottom x-electrodes 404-1 and 404-2, inner-pixel light barrier material 407, and luminescent material 406. The plasma-disc 401 is within the trench or groove 408 and attached to the substrate 402 with bonding material 405. FIG. 4C shows the electrodes 403, 404-1, and 404-2 on the substrate 402 with the location of the plasma-disc 401 (not shown) indicated with broken lines. This FIG. 4 embodiment is a three-electrode structure with similar characteristics to the FIG. 2 embodiment. However x-electrodes 404-1 and 404-2 extend down the middle of trench 408 formed in substrate 402. The plasma-disc 401 is attached with bonding material to the inside of the trench. Optional light barrier material 407 may be applied around the plasma-disc. Y-electrode 403 is applied across the top of the substrate and optional luminescent material 406 may be applied over the top of the plasma-disc. FIG. 4C shows optional locating notch 409 to help position the disc.

Figure 5B:
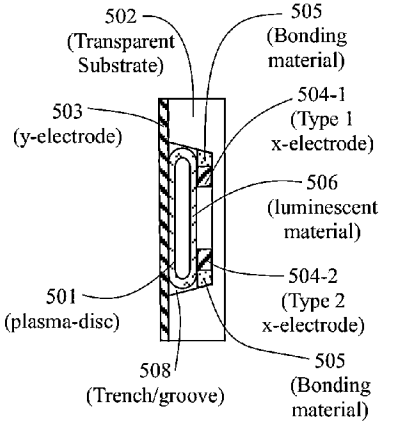
FIG. 5B is a section of 5B-5B of FIG. 5.
Figure 5C:
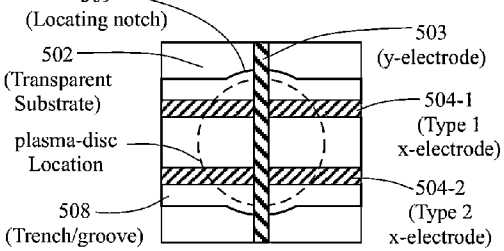
FIG. 5C is a top view of the substrate and electrodes in FIG. 5 with the plasma-disc location shown in broken lines.
Figure 5:
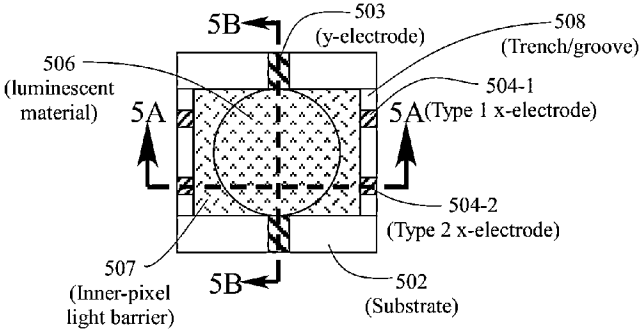
FIG. 5 is a top view of a plasma-disc mounted on a substrate with two x-electrodes and one y-electrode.
Figure 5A:
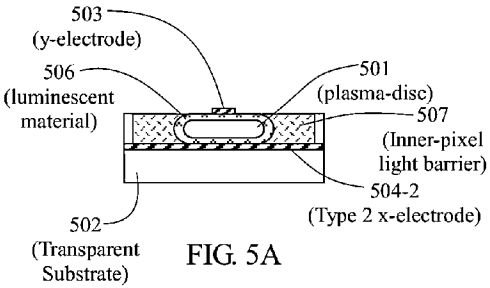
FIG. 5A is a section 5A-5A of FIG. 5.

FIGS. 5, 5A, 5B, and 5C are several views of a three-electrode configuration and embodiment in which the plasma-disc 501 is embedded in a trench or groove 508. FIG. 5 shows transparent substrate 502 with top y-electrode 503, dual bottom x-electrodes 504-1, 504-2, luminescent material 506, inner-pixel light barrier 507, and trench or groove 508. The y-electrode 503 and x-electrodes 504-1, 504-2 are cross-hatched for identification purposes. FIG. 5A is a section 5A-5A view of FIG. 5 and FIG. 5B is a section 5B-5B view of FIG. 5, each section view showing the plasma-disc 501 mounted in the trench or groove 508 on the surface of the substrate 502 with top y-electrode 503 and dual bottom x-electrodes 504-1 and 504-2, inner-pixel light barrier 507, and luminescent material 506. The plasma-disc 501 is bonded within the trench or groove 508 and attached to the substrate 502 with bonding material 505. As shown in FIG. 5B, the luminescent material 506 covers the surface of the plasma-disc 501. FIG. 5C shows the electrodes 503, 504-1, and 504-2 on the substrate 502 with the location of the plasma-disc 501 (not shown) indicated with broken lines. A locating notch 509 is shown.

Figure 6B:
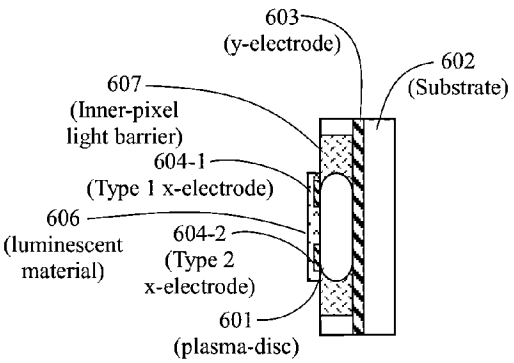
FIG. 6B is a section of 6B-6B of FIG. 6.
Figure 6C:
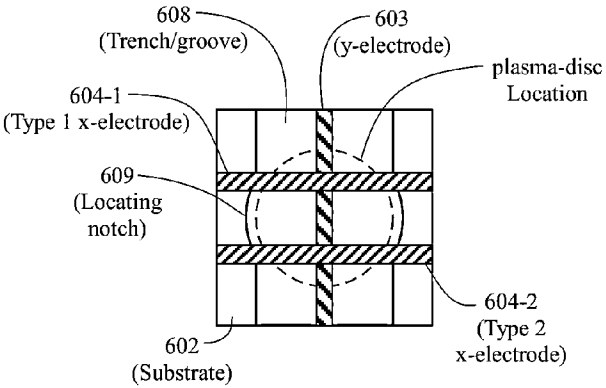
FIG. 6C is a top view of the substrate and electrodes in FIG. 6 with the plasma-disc location shown in broken lines.
Figure 6:
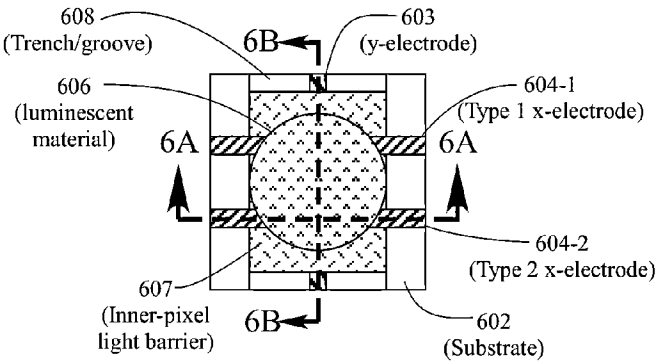
FIG. 6 is a top view of a plasma-disc mounted on a substrate with two x-electrodes and one y-electrode.
Figure 6A:
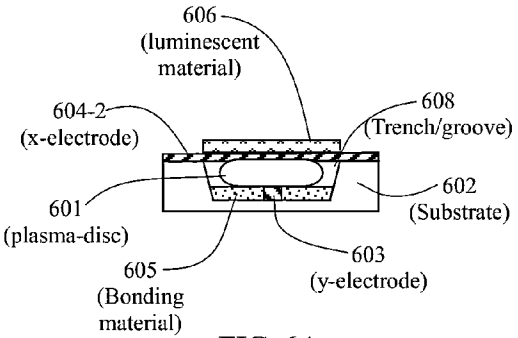
FIG. 6A is a section 6A-6A of FIG. 6.

FIGS. 6, 6A, 6B, and 6C are several views of a three-electrode configuration and embodiment in which the plasma-disc 601 is embedded in a trench or groove 608. FIG. 6 shows substrate 602 with dual top x-electrodes 604-1, 604-2, bottom y-electrode 603, luminescent material 606, inner-pixel light barrier 607, and trench or groove 608. The x-electrodes 604-1, 604-2 and bottom y-electrodes 603 are cross-hatched for identification purposes. FIG. 6A is a section 6A-6A view of FIG. 6 and FIG. 6B is a section 6B-6B view of FIG. 6, each section view showing the plasma-disc 601 mounted within trench or groove 608 on the surface of the substrate 602 with bottom y-electrode 603 and dual top x-electrodes 604-1 and 604-2, inner-pixel light barrier 607, and luminescent material 606. The plasma-disc 601 is within the trench or groove 608 and attached to the substrate 602 with bonding material 605. FIG. 6C shows the electrodes 603, 604-1, and 604-2 on the substrate 602 with the location of the plasma-disc 601 (not shown) indicated with broken lines. A plasma-disc locating notch 609 is shown. The FIG. 6 embodiment differs from the FIG. 4 embodiment in that a single y-electrode 603 extends through the parallel center of the trench 608 and x-electrodes 604-1 and 604-2 are perpendicular to trench and run along the top surface.

Figure 7:
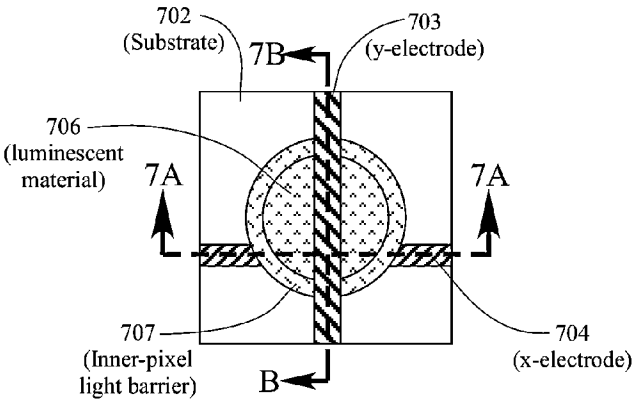
FIG. 7 is a top view of a plasma-disc mounted on a substrate with one x-electrode and one y-electrode.
Figure 7B:
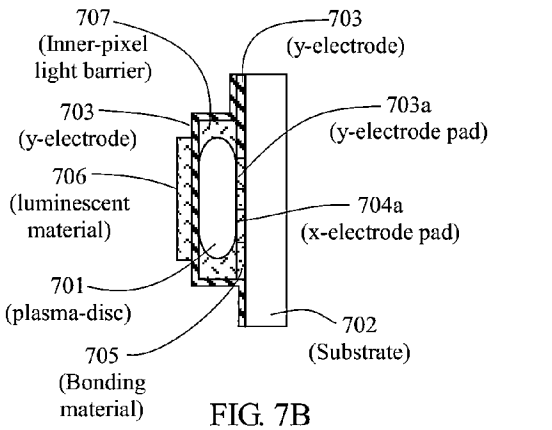
FIG. 7B is a section of 7B-7B of FIG. 7.
Figure 7C:
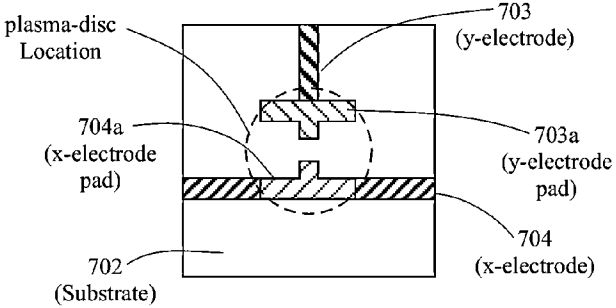
FIG. 7C is a top view of the substrate and electrodes in FIG. 7 with the plasma-disc location shown in broken lines.
Figure 7A:
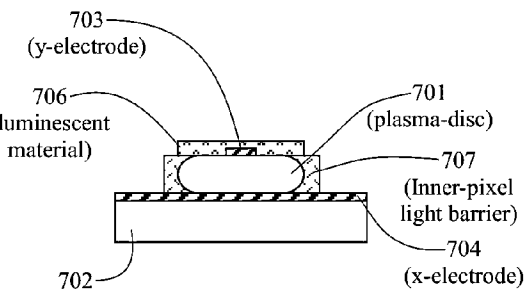
FIG. 7A is a section 7A-7A of FIG. 7.

FIGS. 7, 7A, 7B, and 7C are several views of a two-electrode embodiment with a two-electrode configuration and pattern that employs positive column discharge. FIG. 7 shows substrate 702 with top y-electrode 703, bottom x-electrodes 704, luminescent material 706, and inner-pixel light barrier 707. The y-electrode 703 and x-electrode 704 are cross-hatched for identification purposes. FIG. 7A is a section 7A-7A view of FIG. 7 and FIG. 7B is a section 7B-7B view of FIG. 7, each section view showing the plasma-disc 701 mounted on the surface of substrate 702 with top y-electrode 703 and bottom x-electrode 704, inner-pixel light barrier 707, and luminescent material 706. The plasma-disc 701 is attached to the substrate 702 with bonding material 705. There is also shown in FIG. 7B y-electrode pad 703*a*, x-electrode pad 704*a*, y-electrode 703, x-electrode 704, plasma-disc 701, luminescent material 706, and substrate 702. FIG. 7C shows the electrodes 703 and 704 on the substrate 702 with the location of the plasma-disc 701 (not shown) indicated with broken lines. There is also shown y-electrode pad 703*a* and x-electrode pad 704*a* for contact with plasma-disc 701. As in FIG. 2, FIG. 7 shows a two-electrode configuration and embodiment, which employs positive column discharge. The top y-electrode 703 is applied over the plasma-disc 701 and light barrier 707. Additionally, the electrode 703 runs under plasma-disc 701 and forms a 'T' shaped electrode 703*a*. In this configuration, the discharge is initiated at the closest point between the two-electrodes 703*a* and 704*a* under the plasma-disc and spread to the wider gap electrode regions, including electrode 703, which runs over the top of the plasma-disc. It will be obvious to one skilled in the art that there are electrode shapes and configurations other than the 'T' shape that perform essentially the same function.

Figure 8B:
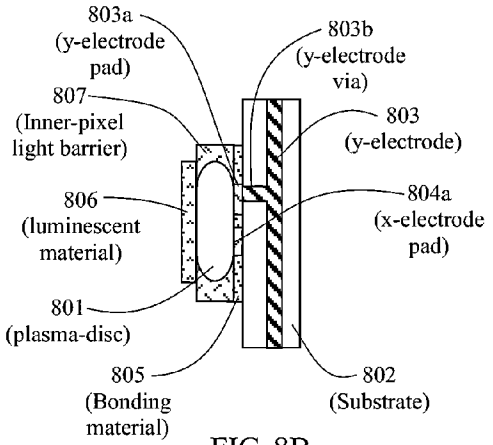
FIG. 8B is a section of 8B-8B of FIG. 8.
Figure 8C:
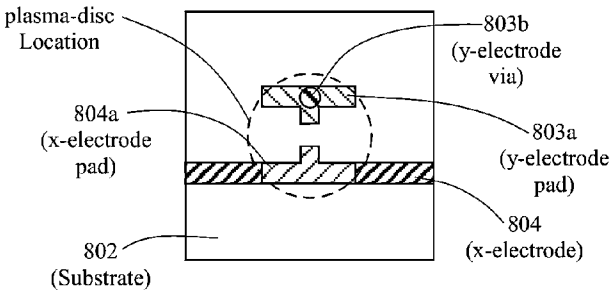
FIG. 8C is a top view of the substrate and electrodes in FIG. 8 with the plasma-disc location shown in broken lines.
Figure 8:
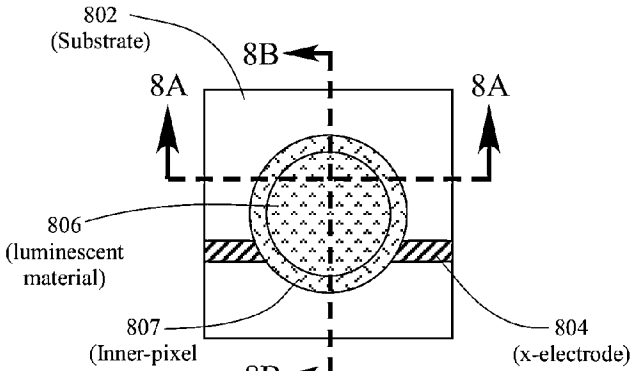
FIG. 8 is a top view of a plasma-disc mounted on a substrate with one x-electrode and one y-electrode.
Figure 8A:
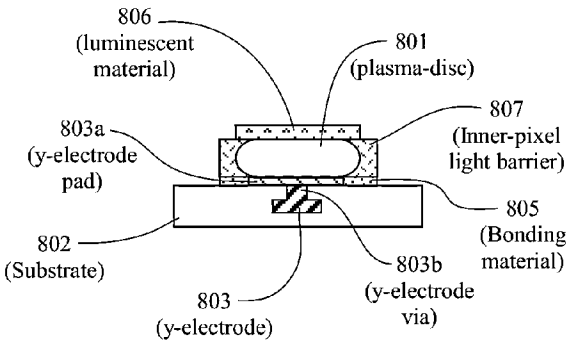
FIG. 8A is a section 8A-8A of FIG. 8.

FIGS. 8, 8A, 8B, and 8C are several views of a two-electrode configuration and embodiment in which neither the x-electrode nor the y-electrode runs over the plasma-disc 801. FIG. 8 shows substrate 802 with x-electrode 804, luminescent material 806, and inner-pixel light barrier 807. The x-electrode 804 is cross-hatched for identification purposes. FIG. 8A is a section 8A-8A view of FIG. 8 and FIG. 8B is a section 8B-8B view of FIG. 8, each section view showing the plasma-disc 801 mounted on the surface of substrate 802 with bottom y-electrode 803, top x-electrode pad 804*a*, inner-pixel light barrier 807, and a top layer of luminescent material 806. The plasma-disc 801 is attached to the substrate 802 with bonding material 805. Also shown is y-electrode pad 803*a* and y-electrode via 803*b* forming a connection to y-electrode 803. The pads 803*a* and 804*a* are in contact with the plasma-disc 801. FIG. 8C shows x-electrode 804 with pad 804*a* and y-electrode pad 803*a* with y-electrode via 803*b* on the substrate 802 with the location of the plasma-disc 801 indicated with broken lines. In this configuration x-electrode 804 extends along the surface of substrate 802 and y-electrode 803 extends along an inner layer of substrate 802. The y-electrode 803 is perpendicular to x-electrode 804. Contact with plasma-disc 801 is made with 'T' shaped surface pads 804*a* and 803*a*. The 'T' shaped pad is beneficial to promote positive column discharge. Pad 803*a* is connected to electrode 803 by via 803*b*. Although y-electrode 803 is shown internal to substrate 802, it may also extend along the exterior surface of 802, opposite to the side that the plasma-disc is located.

Figure 9B:
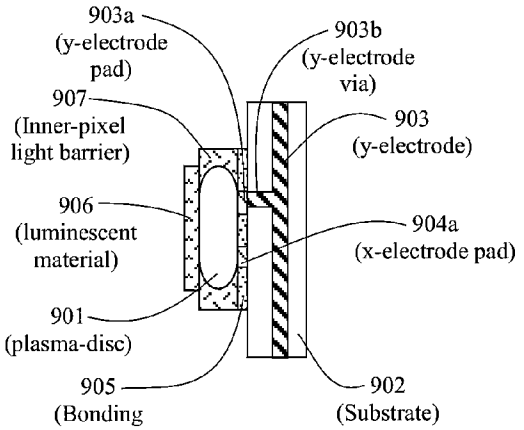
FIG. 9B is a section of 9B-9B of FIG. 9.
Figure 9C:
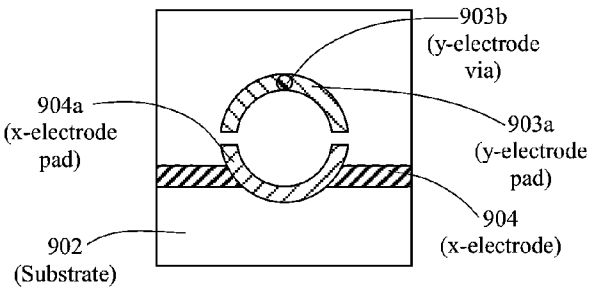
FIG. 9C is a top view of the substrate and electrodes in FIG. 9 without the plasma-disc.
Figure 9:
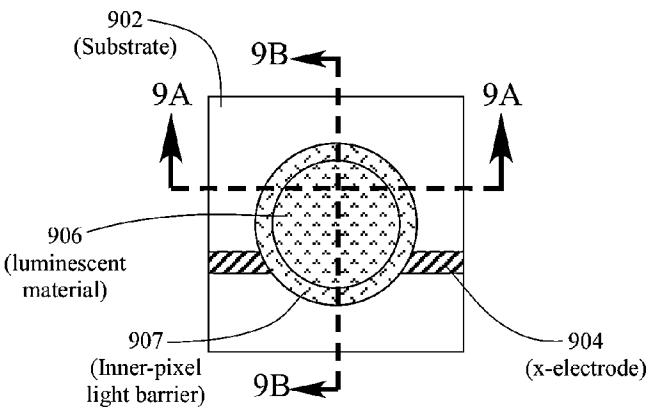
FIG. 9 is a top view of a plasma-disc mounted on a substrate with one x-electrode and one y-electrode.
Figure 9A:
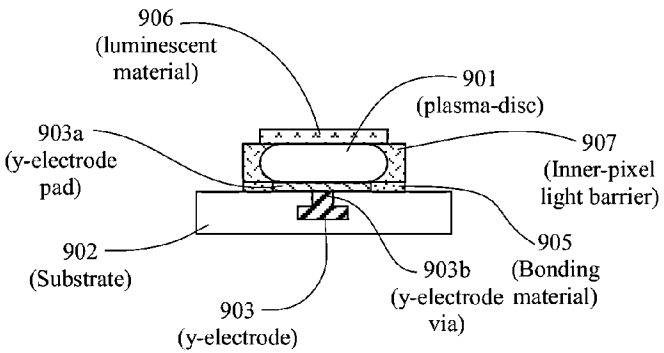
FIG. 9A is a section 9A-9A of FIG. 9.

FIGS. 9, 9A, 9B and 9C are several views of an alternative two-electrode configuration and embodiment in which neither x- nor y-electrode extends over the plasma-disc 901. FIG. 9 shows substrate 902 with x-electrode 904, luminescent material 906, and inner-pixel light barrier 907. The x-electrode 904 is cross-hatched for identification purposes. FIG. 9A is a section 9A-9A view of FIG. 9 and FIG. 9B is a section 9B-9B view of FIG. 9, each section view showing the plasma-disc 901 mounted on the surface of substrate 902 with bottom y-electrode 903 and bottom x-electrode pad 904*a*, inner-pixel light barrier 907, and luminescent material 906. The plasma-disc 901 is attached to the substrate 902 with bonding material 905. Also shown is y-electrode pad 903*a* and y-electrode via 903*b* connected to y-electrode 903. Also shown is x-electrode pad 904*a*. The pads 903*a* and 904*a* are in contact with the plasma-disc 901. FIG. 9C shows x-electrode 904 with pad 904*a* and y-electrode pad 903*a* with y-electrode via 903*b* on the substrate 902 with pads 903*a*, 904*a* forming an incomplete circular configuration for contact with the plasma-disc 901 (not shown in FIG. 9C) to be positioned on the substrate 902.

Figure 10B:
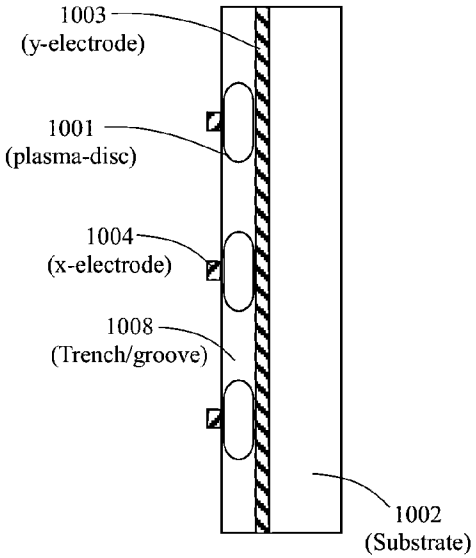
FIG. 10B is a section of 10B-10B of FIG. 10.
Figure 10:
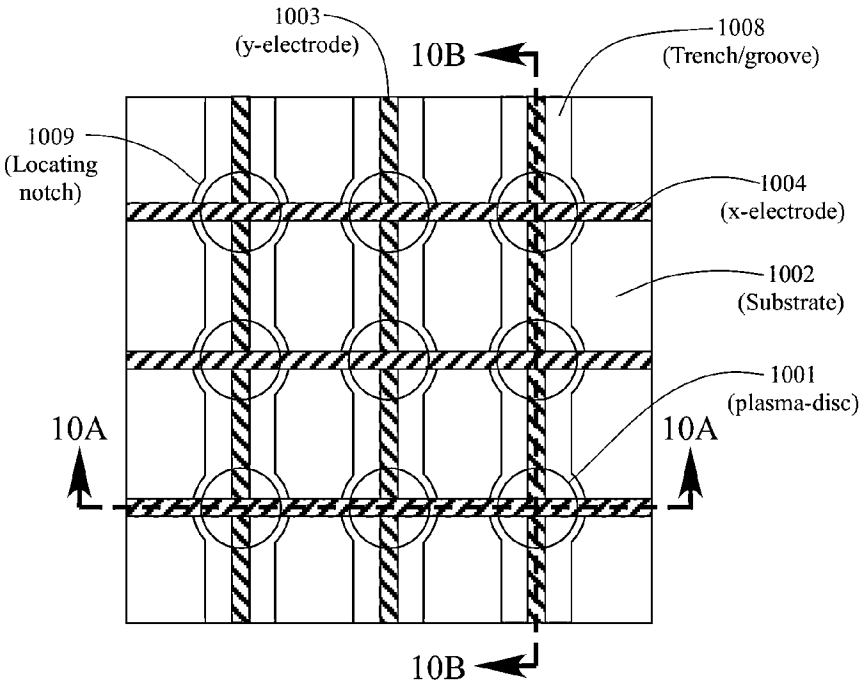
FIG. 10 is a top view of a substrate with multiple x-electrodes, multiple y-electrodes, and trenches or grooves for receiving plasma-discs.
Figure 10A:
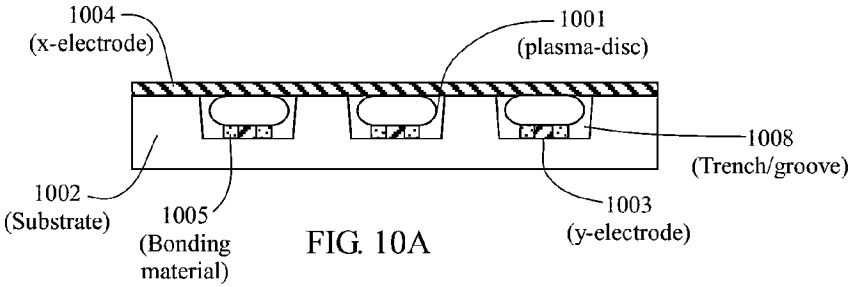
FIG. 10A is a section 10A-10A of FIG. 10.

FIG. 10 shows substrate 1002 with y-electrodes 1003 positioned in trenches or grooves 1008, x-electrodes 1004, and plasma-disc locating notches 1009. The plasma-discs 1001 are located within the trenches or grooves 1008 at the positions of the locating notches 1009 as shown. The y-electrodes 1003 and x-electrodes 1004 are cross-hatched for identification purposes. FIG. 10A is a section 10A-10A view of FIG. 10 and FIG. 10B is a section 10B-10B view of FIG. 10, each section view showing each plasma-disc 1001 mounted within a trench or groove 1008 and attached to the substrate 1002 with bonding material 1005. Each plasma-disc 1001 is in contact with a top x-electrode 1004 and a bottom y-electrode 1003. Luminescent material is not shown, but may be provided near or on each plasma-disc 1001. Inner-pixel light barriers are not shown, but may be provided.

Figure 11B:
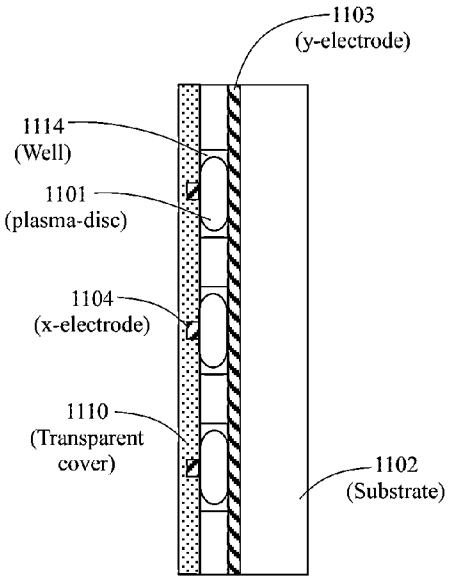
FIG. 11B is a section of 11B11-B of FIG. 11.
Figure 11:
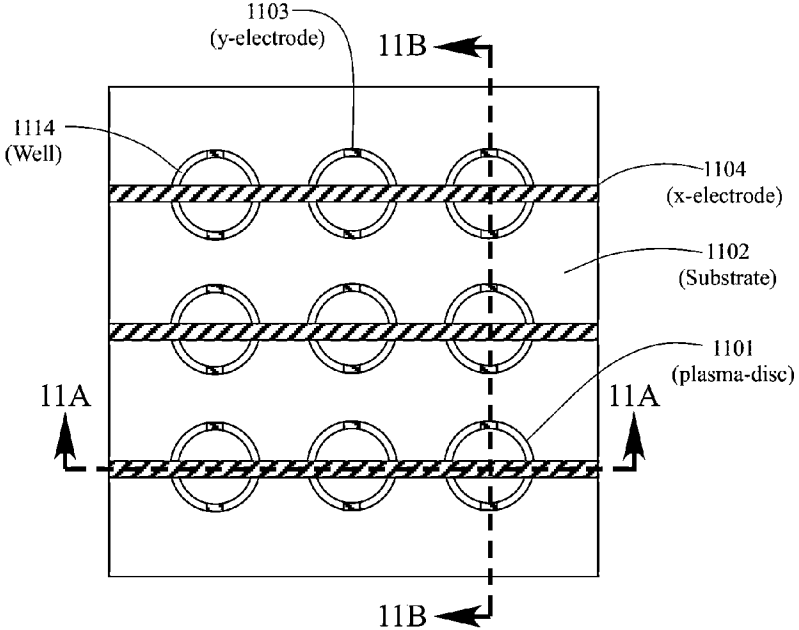
FIG. 11 is a top view of a substrate with multiple x-electrodes, multiple y-electrodes, and multiple wells or cavities for receiving plasma-discs.
Figure 11A:
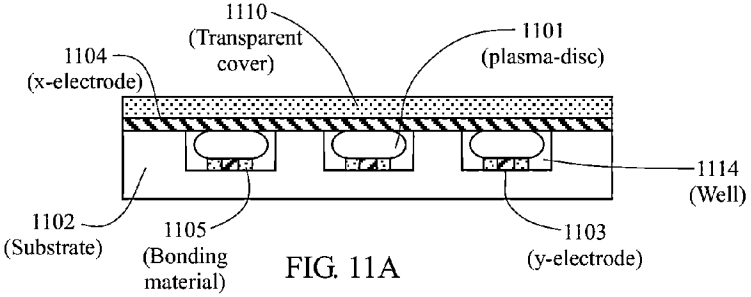
FIG. 11A is a section 11A-11A of FIG. 11.

FIG. 11 shows substrate 1102 with y-electrodes 1103, x-electrodes 1104, and plasma-disc wells 1114. The plasma-discs 1101 are located within wells 1114 as shown. The y-electrodes 1103 and x-electrodes 1104 are cross-hatched for identification purposes. FIG. 11A is a section 11A-11A view of FIG. 11 and FIG. 11B is a section 11B-11B view of FIG. 11, each section view showing each plasma-disc 1101 mounted within a well 1114 to substrate 1102 with bonding material 1105. Each plasma-disc 1101 is in contact with a top x-electrode 1104 and a bottom y-electrode 1103. Luminescent material is not shown, but may be provided near or on each plasma-disc. Inner-pixel light barriers are not shown, but may be provided. The x-electrodes 1104 are positioned under a transparent cover 1110 and may be integrated into the cover.

Figure 12:
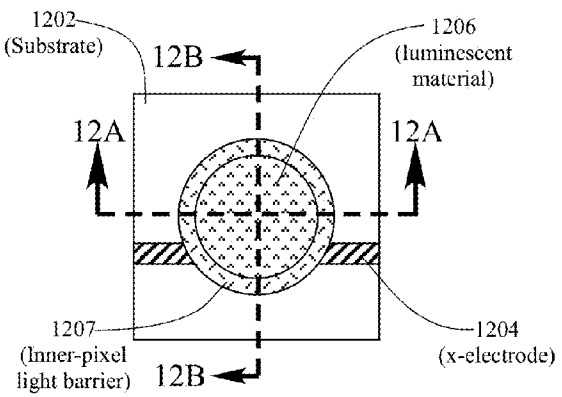
FIG. 12 is a top view of a plasma-disc mounted on a substrate with one x-electrode and one y-electrode.
Figure 12B:
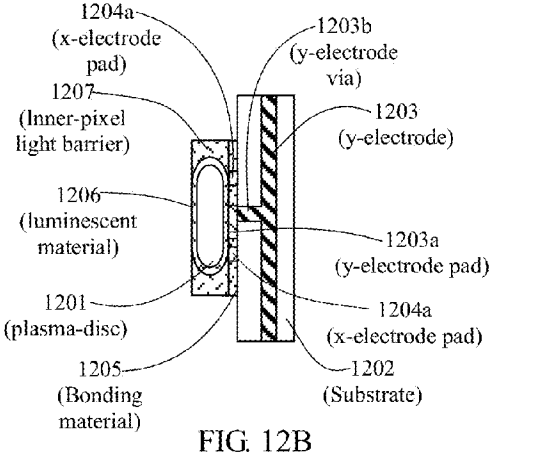
FIG. 12B is a section of 12B-12B of FIG. 12.
Figure 12C:
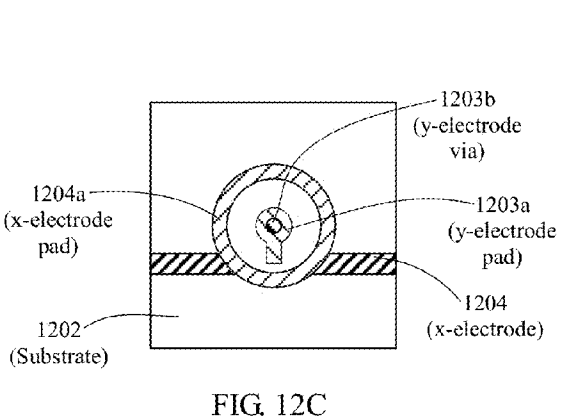
FIG. 12C is a top view of the substrate and electrodes in FIG. 12 without the plasma-disc
Figure 12A:
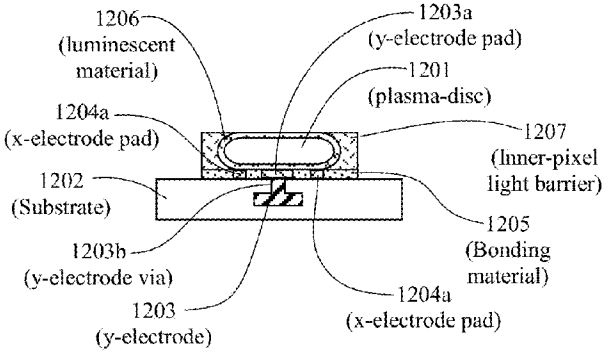
FIG. 12A is a section 12A-12A of FIG. 12.

FIGS. 12, 12A, 12B, and 12C are several views of an alternate two-electrode configuration or embodiment in which neither the x-electrode nor the y-electrode extends over the plasma-disc 1201. FIG. 12 shows substrate 1202 with x-electrode 1204, luminescent material 1206, and inner-pixel light barrier 1207. The x-electrode 1204 is cross-hatched for identification purposes. FIG. 12A is a section 12A-12A view of FIG. 12 and FIG. 12B is a section 12B-12B view of FIG. 12, each section view showing the plasma-disc 1201 mounted on the surface of substrate 1202 with bottom y-electrode 1203 and bottom x-electrode pad 1204*a*, inner-pixel light barrier 1207, and luminescent material 1206. The plasma-disc 1201 is bonded to the substrate 1202 with bonding material 1205. Also shown is y-electrode pad 1203*a* and via 1203*b* connected to y-electrode 1203. The pads 1203*a* and 1204*a* are in contact with the plasma-disc 1201. FIG. 12C shows x-electrode 1204 with pad 1204*a* and y-electrode pad 1203*a* with y-electrode via 1203*b* on the surface 1202. The pad 1204*a* forms a donut configuration for contact with the plasma-disc 1201 (not shown) to be positioned on the substrate 1202. The pad 1203*a* is shown as a keyhole configuration within the donut configuration and centered within electrode pad 1204*a*.

Figure 13B:
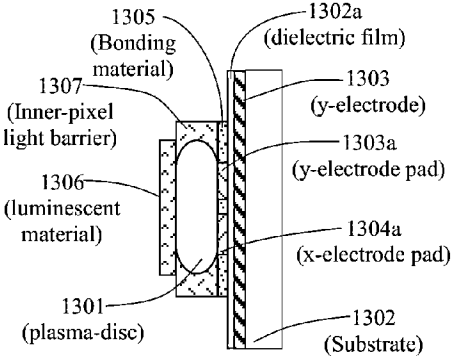
FIG. 13B is a section of 13B-13B of FIG. 13.
Figure 13C:
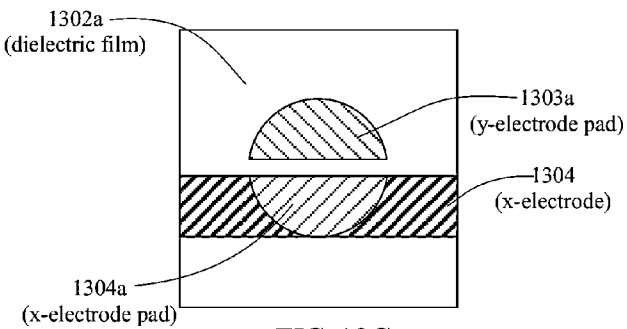
FIG. 13C is a top view of the substrate and electrodes in FIG. 13 without the plasma-disc.
Figure 13:
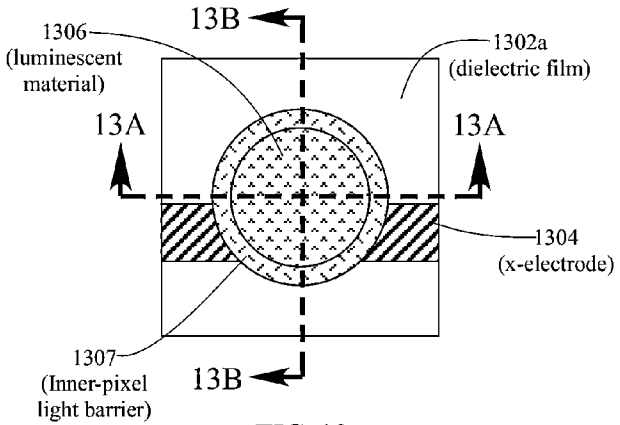
FIG. 13 is a top view of a plasma-disc mounted on a substrate with one x-electrode and one y-electrode.
Figure 13A:
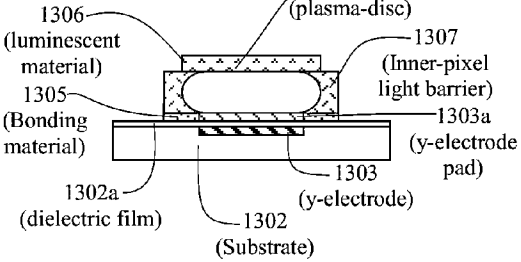
FIG. 13A is a section 13A-13A of FIG. 13.

FIGS. 13, 13A, 13B, and 13C are several views of an alternate two-electrode configuration and embodiment in which neither the x- nor the y-electrode extends over the plasma-disc 1301. These figures illustrate charge or capacitive coupling. FIG. 13 shows dielectric film or layer 1302*a* on top surface of substrate 1302 (not shown) with x-electrode 1304, luminescent material 1306, and inner-pixel light barrier 1307. The x-electrode 1304 is cross-hatched for identification purposes. FIG. 13A is a section 13A-13A view of FIG. 13 and FIG. 13B is a section 13B-13B view of FIG. 13, each section view showing the plasma-disc 1301 mounted on the dielectric film or layer 1302*a* with y-electrode 1303 and x-electrode pad

1304*a*, inner-pixel light barrier 1307, and luminescent material 1306. The plasma-disc 1301 is bonded to the dielectric film 1302*a* with bonding material 1305. Also is substrate 1302 and y-electrode pad 1303*a*, which is capacitively coupled through dielectric film 1302*a* to the y-electrode 1303. FIG. 13C shows the x-electrode 1304 x-electrode pad 1304*a*, and y-electrode pad 1303*a* on the dielectric film 1302*a* with the location of the plasma-disc 1301 (not shown) indicated by the semi-circular pads 1303*a* and 1304*a*. In this configuration and embodiment, x-electrode 1304 is on the top of the substrate 1302 and y-electrode 1303 is embedded in substrate 1302. Also in this embodiment, substrate 1302 is formed from a material with a dielectric constant sufficient to allow charge coupling from 1303 to 1303*a*. Also to promote good capacitive coupling, pad 1303*a* is large and the gap between 1303*a* and 1303 is small. Pads 1303*a* and 1304*a* may be selected from a reflective metal such as copper or silver or coated with a reflective material. This will help direct light out of the plasma-disc and increase efficiency. Reflective electrodes may be used in any configuration in which the electrodes are attached to the plasma-disc from the back of the substrate. The larger the area of the electrode, the greater the advantage achieved by reflection.

Figure 14B:
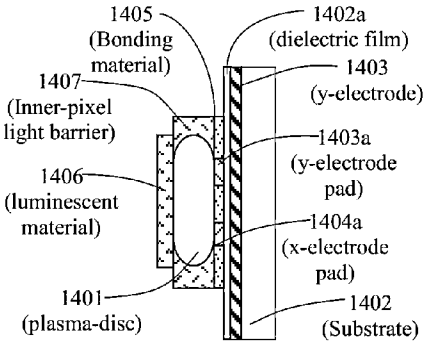
FIG. 14B is a section of 14B-14B of FIG. 14.
Figure 14C:
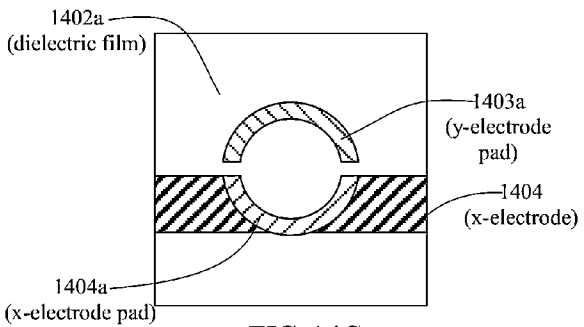
FIG. 14C is a top view of the substrate and electrodes in FIG. 14 without the plasma-disc.
Figure 14:
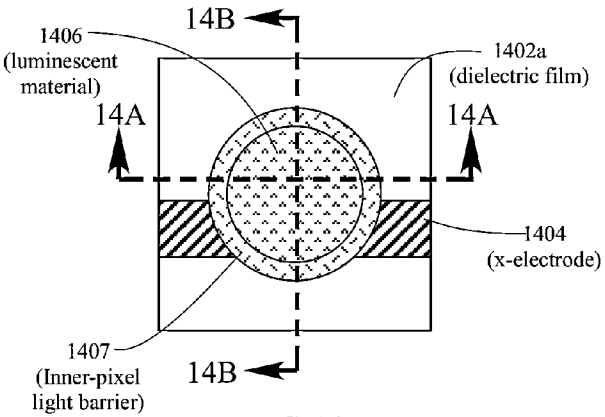
FIG. 14 is a top view of a plasma-disc mounted on a substrate with one x-electrode and one y-electrode.
Figure 14A:
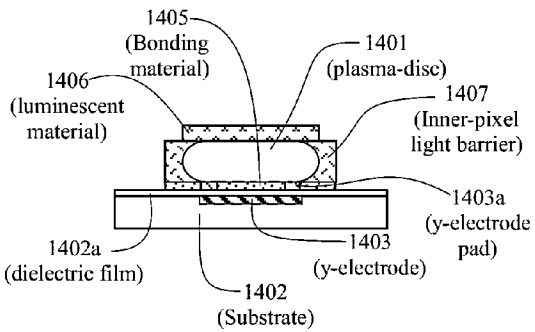
FIG. 14A is a section 14A-14A of FIG. 14.

FIGS. 14, 14A, 14B, and 14C are several views of an alternate two-electrode configuration and embodiment. FIG. 14 shows dielectric film or layer 1402*a* on the top surface of substrate 1402 (not shown) with x-electrode 1404, luminescent material 1406, and inner-pixel light barrier 1407. The x-electrode 1404 is cross-hatched for identification purposes. FIG. 14A is a section 14A-14A view of FIG. 14 and FIG. 14B is a section 14B-14B view of FIG. 14, each section view showing the plasma-disc 1401 mounted on the surface of dielectric film 1402*a* with bottom y-electrode 1403, bottom x-electrode pad 1404*a*, inner-pixel light barrier 1407, and luminescent material 1406. The plasma-disc 1401 is bonded to the dielectric film 1402*a* with bonding material 1405. Also shown are substrate 1402 and y-electrode pad 1403*a*, which is capacitively coupled through the dielectric film 1402*a* to the y-electrode 1403. FIG. 14C shows x-electrode 1404 and electrode pads 1403*a* and 1404*a* on the dielectric film 1402*a*. The pads 1403*a* and 1404*a* form an incomplete circular configuration for contact with the plasma-disc 1401 (not shown in FIG. 14C). FIG. 14 differs from FIG. 13 in the shape of the electrode pads. This can be seen in FIG. 14C. y-electrode 1403*a* is shaped like a 'C' and x-electrode 1404 is also formed as a 'C' shape. This configuration promotes a positive column discharge.

Figure 15B:
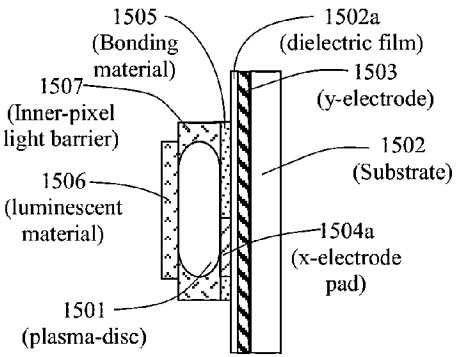
FIG. 15B is a section of 15B-15B of FIG. 15.
Figure 15C:
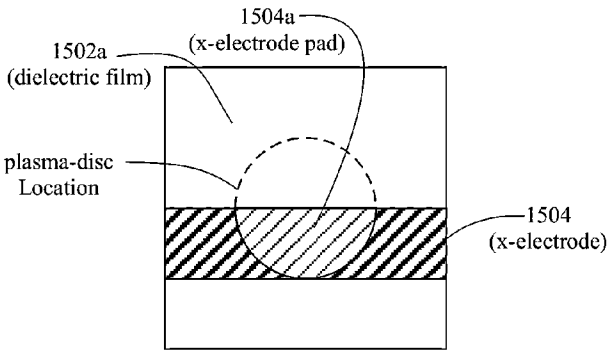
FIG. 15C is a top view of the substrate and electrodes in FIG. 15 with the plasma-disc location shown in broken lines.
Figure 15:
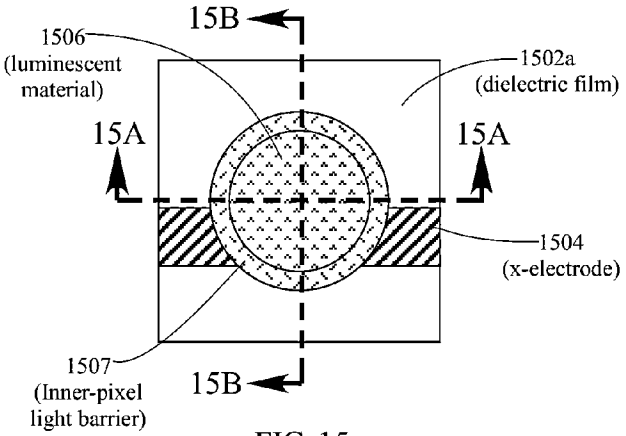
FIG. 15 is a top view of a plasma-disc mounted on a substrate with one x-electrode and one y-electrode.
Figure 15A:
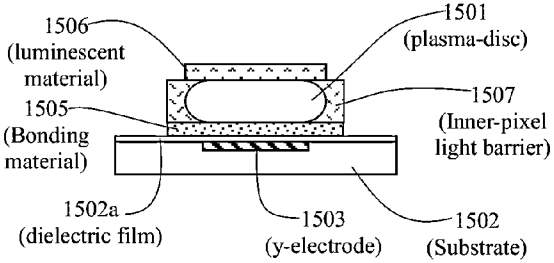
FIG. 15A is a section 15A-15A of FIG. 15.

FIGS. 15, 15A, 15B, and 15C are several views of an alternate two-electrode configuration and embodiment. These figures illustrate charge or capacitive coupling. FIG. 15 shows dielectric film or layer 1502*a* on the surface of substrate 1502 (not shown) with bottom x-electrode 1504, luminescent material 1506, and inner-pixel light barrier 1507. The x-electrode 1504 is cross-hatched for identification purposes. FIG. 15A is a section 15A-15A view of FIG. 15 and FIG. 15B is a section 15B-15B view of FIG. 15, each section view showing the plasma-disc 1501 mounted on the surface of dielectric film 1502*a* with bottom y-electrode 1503 and bottom x-electrode pad 1504*a*, inner-pixel light barrier 1507, and luminescent material 1506. The plasma-disc 1501 is bonded to the dielectric film 1502*a* with bonding material 1505. The plasma-disc 1501 is capacitively coupled through dielectric film 1502*a* and bonding material 1505 to y-electrode 1503. Also shown is substrate 1502. FIG. 15C shows the x-electrode 1504 with x-electrode pad 1504*a* on the dielectric film 1502*a* with the location of the plasma-disc 1501 (not shown) indicated with broken lines.

Figure 16B:
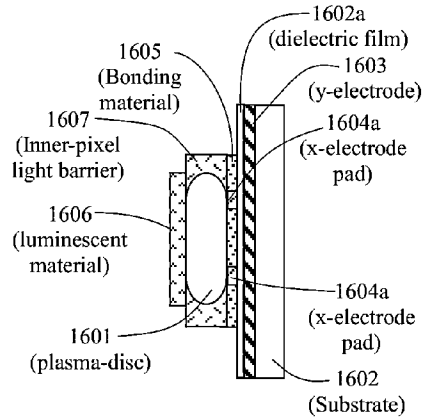
FIG. 16B is a section of 16B-161B of FIG. 16.
Figure 16C:
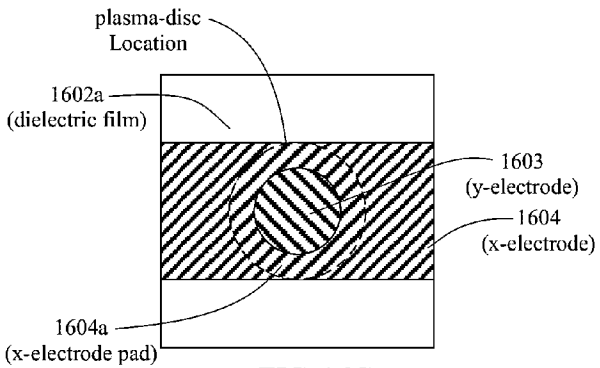
FIG. 16C is a top view of the substrate and electrodes in FIG. 16 with the plasma-disc location shown in broken lines.
Figure 16:
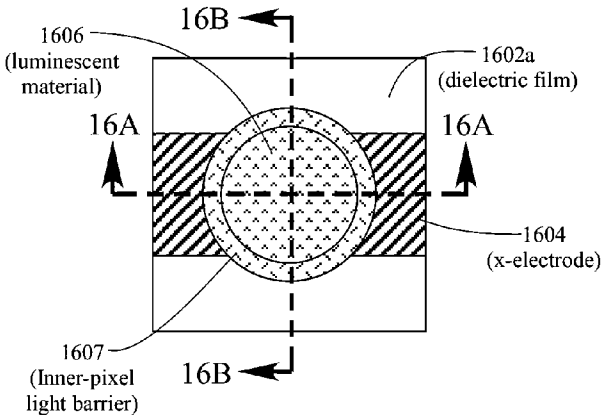
FIG. 16 is a top view of a plasma-disc mounted on a substrate with one x-electrode and one y-electrode.
Figure 16A:
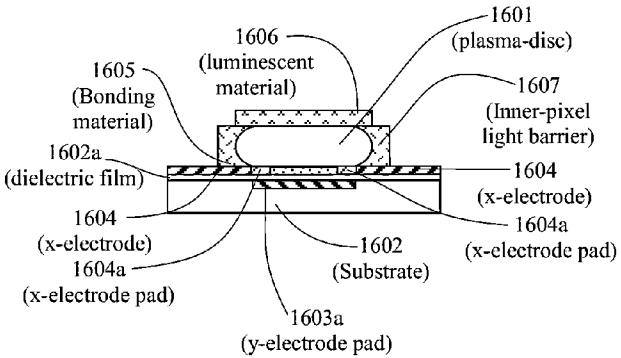
FIG. 16A is a section 16A-16A of FIG. 16.

FIGS. 16, 16A, 16B, and 16C are several views of an alternate two-electrode configuration and embodiment. FIG. 16 shows dielectric film or layer 1602*a* on substrate 1602 (not shown) with bottom x-electrode 1604, luminescent material 1606, and inner-pixel light barrier 1607. The x-electrode 1604 is cross-hatched for identification purposes. FIG. 16A is a section 16A-16A view of FIG. 16 and FIG. 16B is a section 16B-16B view of FIG. 16, each section view showing the plasma-disc 1601 mounted on the surface of dielectric film 1602*a* with bottom y-electrode 1603, bottom x-electrode pad 1604*a*, inner-pixel light barrier 1607, and luminescent material 1606. The plasma-disc 1601 is bonded to the dielectric film 1602*a* with bonding material 1605. Also shown is substrate 1602. FIG. 16C shows the x-electrode 1604 with pad 1604*a* and y-electrode 1603 on the dielectric film 1602*a* with the location of the plasma-disc 1601 (not shown) indicated with broken lines. FIG. 16 differs from FIG. 15 in the shape of the x-electrodes and y-electrodes. This can be seen in FIG. 16C. The x-electrode 1604 is extended along the top surface of substrate 1602, and dielectric film 1602*a*. A spherical hole is cut in x-electrode 1604 to allow capacitive coupling of y-electrode 1603 to the plasma-disc. The y-electrode 1603 is perpendicular to x-electrode 1604.

Figure 17B:
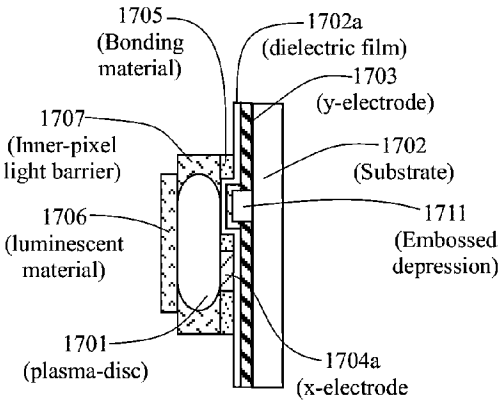
FIG. 17B is a section of 17B-17B of FIG. 17.
Figure 17C:
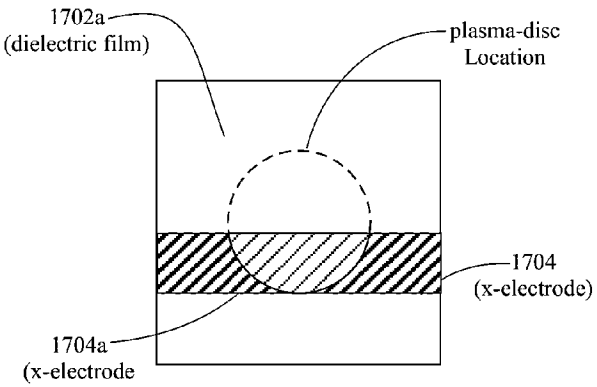
FIG. 17C is a top view of the substrate and electrodes in FIG. 17 with the plasma-disc location shown in broken lines.
Figure 17:
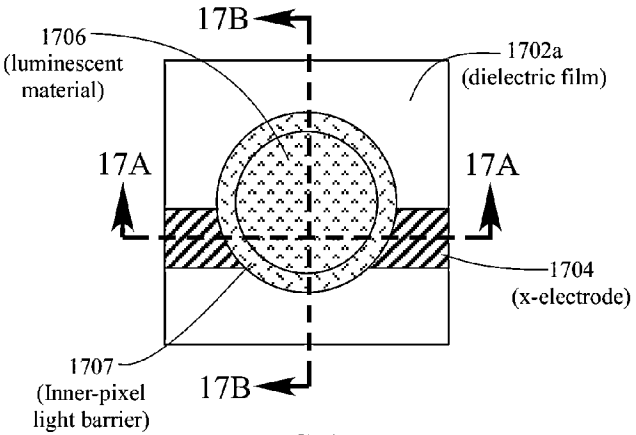
FIG. 17 is a top view of a plasma-disc mounted on a substrate with one x-electrode and one y-electrode.
Figure 17A:
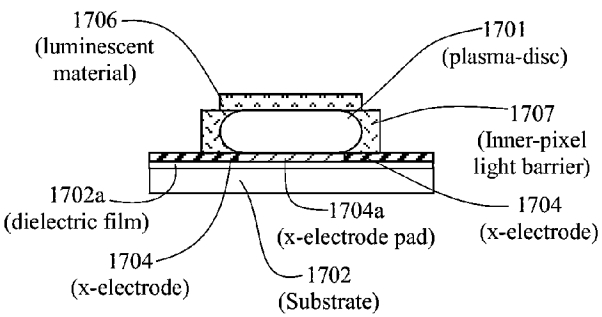
FIG. 17A is a section 17A-17A of FIG. 17.

FIGS. 17, 17A, 17B, and 17C are several views of an alternate two-electrode configuration and embodiment. FIG. 17 shows dielectric film or layer 1702*a* on substrate 1702 (not shown) with bottom x-electrode 1704, luminescent material 1706, and inner-pixel light barrier 1707. The x-electrode 1704 is cross-hatched for identification purposes. FIG. 17A is a section 17A-17A view of FIG. 17 and FIG. 17B is a section 17B-17B view of FIG. 17, each section view showing the plasma-disc 1701 mounted on the surface of dielectric film or layer 1702*a* with bottom y-electrode 1703, bottom x-electrode 1704 and x-electrode pad 1704*a*, inner-pixel light barrier 1707, and luminescent material 1706. The plasma-disc 1701 is bonded to the dielectric layer 1702*a* with bonding material 1705. FIG. 17C shows the electrode 1704 with pad 1704*a* on the substrate 1702 with the location of the plasma-disc 1701 (not shown) indicated with broken lines. FIG. 17 serves to illustrate that the y-electrode 1703 may be applied to the top of substrate 1702 as shown in FIG. 17B. Dielectric layer or film 1702*a* is applied over the substrate and the y-electrode. The x-electrode 1704 is applied over the dielectric layer to make direct contact with plasma-disc 1701. In this embodiment substrate 1702 contains embossed depression 1711 to bring y-electrode 1703 closer to the surface of the plasma-disc and in essentially the same plane as x-electrode pad 1704*a*.

Figure 18B:
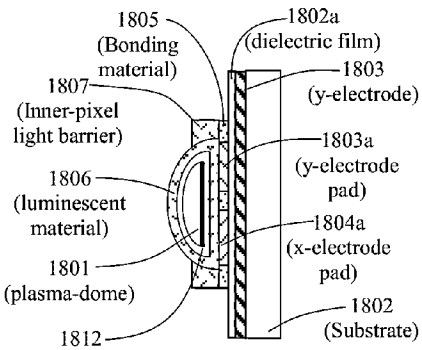
FIG. 18B is a section of 18B-18B of FIG. 18.
Figure 18C:
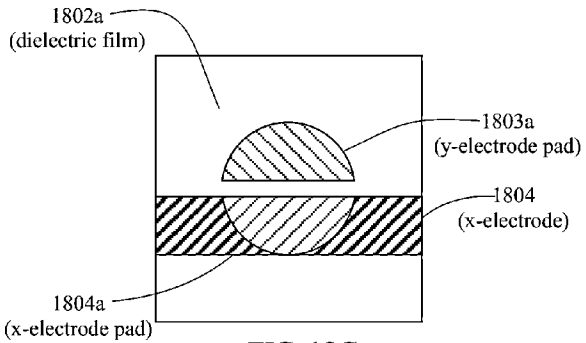
FIG. 18C is a top view of the substrate and electrodes.
Figure 18:
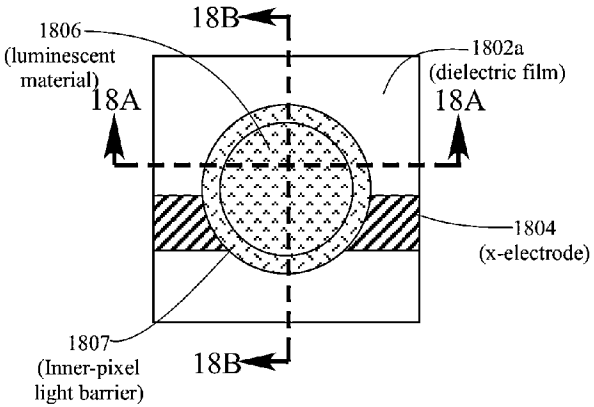
FIG. 18 is a top view of a plasma-dome mounted on a substrate with two x-electrodes and one y-electrode.
Figure 18A:
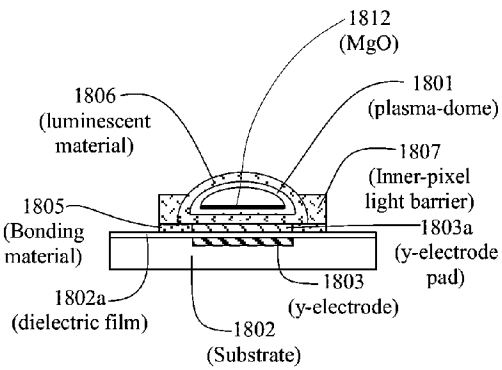
FIG. 18A is a section 18A-18A of FIG. 18.

FIG. 18 shows dielectric film or layer 1802*a* substrate 1802 (not shown) with bottom x-electrode 1804, luminescent material 1806, and inner-pixel light barrier 1807. The x-electrode 1804 is cross-hatched for identification purposes. FIG. 18A is a section 18A-18A view of FIG. 18 and FIG. 18B is a section 18B-18B view of FIG. 18, each section view showing a plasma-dome 1801 mounted on the surface of dielectric 1802*a* with connecting bottom y-electrode 1803, inner-pixel light barrier 1807, and luminescent material 1806. The plasma-dome 1801 is bonded to the substrate 1802*a* with bonding material 1805. Also shown are substrate 1802, y-electrode pad 1803*a* and x-electrode pad 1804*a*. Magnesium oxide 1812 is shown on the inside of the plasma-dome 1801. FIG. 18C shows the electrode 1804 with pad 1804*a* and pad 1803*a* on the dielectric film 1802*a* with the location of the plasma-dome 1801 (not shown) by semi-circular pads 1804*a* and 1803*a* all attached to substrate 1802.

Figure 19:
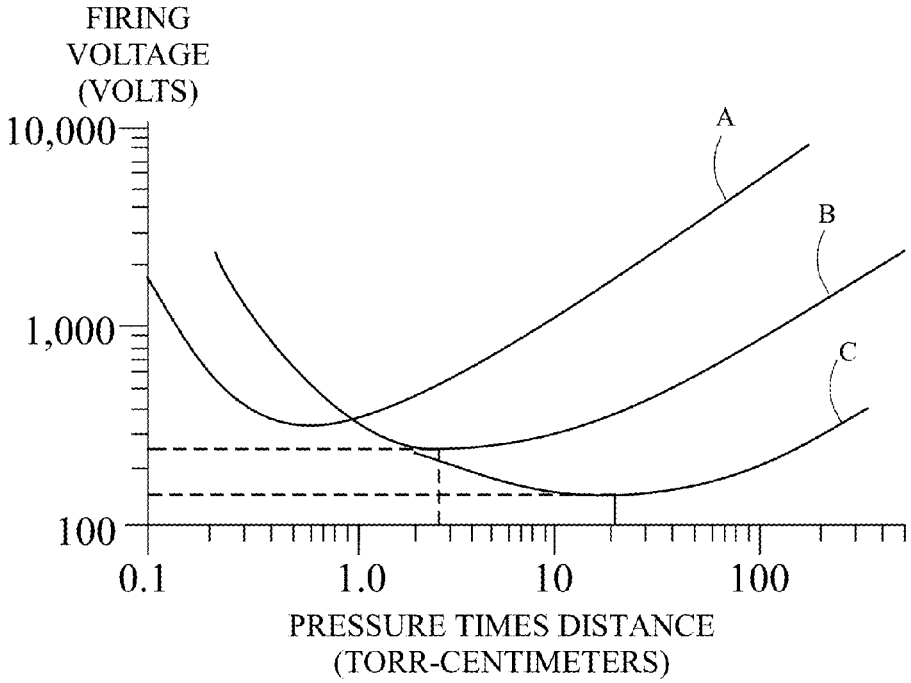
FIG. 19 shows hypothetical Paschen curves for three typical hypothetical gases.

The plasma-shell is filled with an ionizable gas. Each gas composition or mixture has a unique curve associated with it, called the Paschen curve as illustrated in FIG. 19. The Paschen curve is a graph of the breakdown voltage versus the product of the pressure times the discharge distance. It is usually given in Torr-centimeters. As can be seen from the illustration in FIG. 19, the gases typically have a saddle region in which the voltage is at a minimum. Often it is desirable to choose pressure and gas discharge distance in the saddle region to minimize the voltage. In the case of a plasma-sphere, the distance is the diameter of the sphere or some chord of the sphere as defined by the locating and positioning of the electrodes. In the case of another geometric shape such as a plasma-disc or plasma-dome, it is an axis across the geometric body selected for gas discharge as determined by the locating and positioning of the electrodes. In one embodiment, the inside of the plasma-shell contains a secondary electron emitter. Secondary electron emitters lower the breakdown voltage of the gas and provide a more efficient discharge. Plasma displays traditionally use magnesium oxide for this purpose, although other materials may be used including other Group IIA oxides, rare earth oxides, lead oxides, aluminum oxides, and other materials. Mixtures of secondary electron emitters may be used. It may also be beneficial to add luminescent substances such as phosphor to the inside or outside of the sphere. In one embodiment and mode hereof, the plasma-shell material is a metal or metalloid oxide with an ionizable gas of 99.99% atoms of neon and 0.01% atoms of argon or xenon for use in a monochrome PDP. Examples of shell materials include glass, silica, aluminum oxides, zirconium oxides, and magnesium oxides. In another embodiment, the plasma-shell contains luminescent substances such as phosphors selected to provide different visible colors including red, blue, and green for use in a full color PDP. The metal or metalloid oxides are typically selected to be highly transmissive to photons produced by the gas discharge especially in the UV range. In one embodiment, the ionizable gas is selected from any of several known combinations that produce UV light including pure helium, helium with up to 1% atoms neon, helium with up to 1% atoms of argon and up to 15% atoms nitrogen, and neon with up to 15% atoms of xenon or argon. For a color PDP, red, blue, and/or green light-emitting luminescent substance may be applied to the interior or exterior of the sphere shell. The exterior application may comprise a slurry or tumbling process with curing, typically at low temperatures. Infrared curing can also be used. The luminescent substance may be applied by other methods or processes, which include spraying, ink jet, dipping, and so forth. Thick film methods such as screen-printing may be used. Thin film methods such as sputtering and vapor phase deposition may be used. The luminescent substance may be applied externally before or after the plasma-shell is attached to the PDP substrate. As discussed hereinafter, the luminescent substance may be organic and/or inorganic. The internal or external surface of the plasma-shell may be partially or completely coated with luminescent material. In one preferred embodiment the external surface is completely coated with luminescent material. The bottom or rear of the plasma-shell may be coated with a suitable light reflective material in order to reflect more light toward the top or front viewing direction of the plasma-shell. The light reflective material may be applied by any suitable process, such as spraying, ink jet, dipping, and so forth. Thick film methods such as screen-printing may be used. Thin film methods such as sputtering and vapor phase deposition may be used. The light reflective material may be applied over the luminescent material or the luminescent material may be applied over the light reflective material. In one embodiment, the electrodes are made of or coated with a light reflective material such that the electrodes also may function as a light reflector.

Plasma-Disc

Figure 20A:
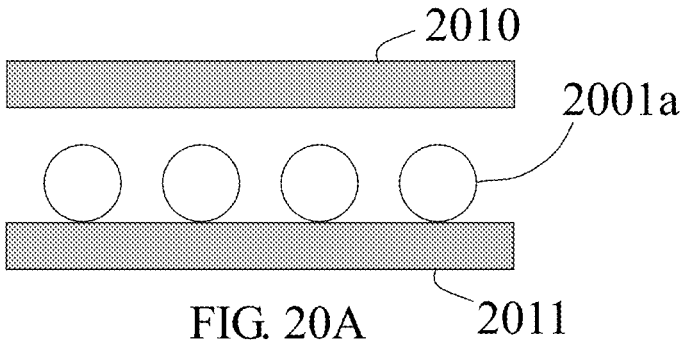
FIGS. 20A, 20B, and 20C show process steps for making plasma-discs.
Figure 20B:
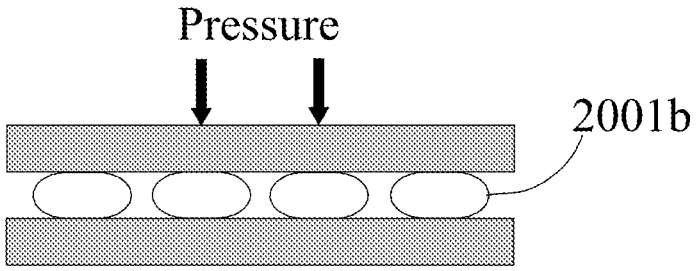
Figure 20C:
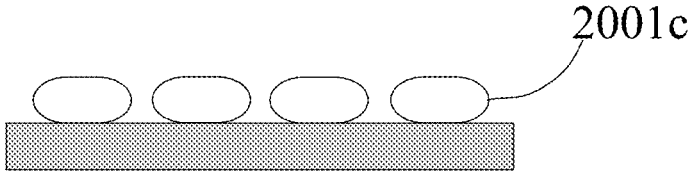

A plasma-shell with two substantially flattened opposite sides, i.e., top and bottom is called a plasma-disc. A plasma-disc may be formed by flattening a plasma-sphere to form a pair of opposing sides such as top and bottom. The flat sides enhance the mounting of the plasma-disc to the substrate and the connecting of the plasma-disc to electrical contacts such as the electrodes. The flattening of the plasma-sphere to form a plasma-disc is typically done while the sphere shell is at an ambient temperature or at elevated softening temperature below the melting temperature. The flat viewing surface in a plasma-disc tends to increase the overall luminous efficiency of a PDP. Plasma-discs are typically produced while the plasma-sphere is at an elevated temperature below its melting point. While the plasma-sphere is at the elevated temperature, a sufficient pressure or force is applied with member 2010 to flatten the spheres between members 2010 and 2011 into disc shapes with flat top and bottom as illustrated in FIGS. 20A, 20B, and 20C. FIG. 20A shows a plasma-sphere 2001*a*. FIG. 20B shows uniform pressure applied to the plasma-sphere to form a flattened plasma-disc 2001*b*. Heat can be applied during the flattening process such as by heating members 2010 and 2011. FIG. 20C shows the resultant flat plasma-disc 2001*c*. One or more luminescent substances can be applied to the plasma-disc. Like a coin that can only land "heads" or "tails," a plasma-disc with a flat top and flat bottom may be applied to a substrate in one of two flat positions. However, in some embodiments, the plasma-disc may be positioned on edge on or within the substrate.

Plasma-Dome

Figure 21:
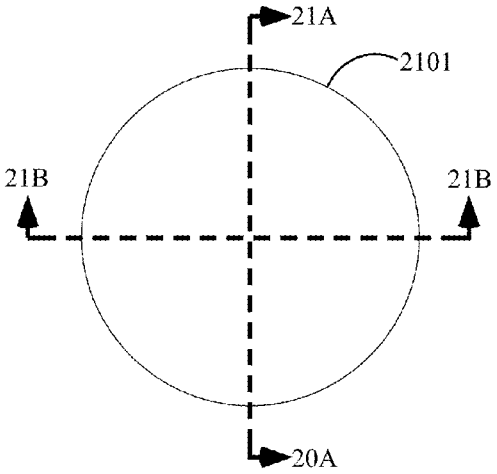
FIGS. 21, 21A, and 21B show a plasma-dome with one flat side.
Figure 21A:
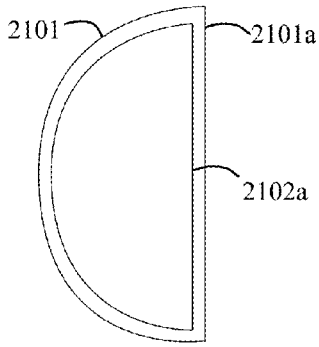
Figure 21B:
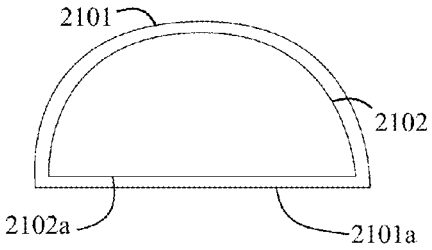

A plasma-dome is shown in FIGS. 21, 21A, and 21B. FIG. 21 is a top view of a plasma-dome showing an outer shell wall 2101. FIG. 21A is a section 21A-21A view of FIG. 21 showing a flattened outer wall 2101*a* and flattened inner wall 2102*a* and domed outer wall 2101. FIG. 21B is a section 21A-21A view of FIG. 21 showing flattened inner wall 2102*a*, flattened outer wall 2101*a*, domed outer wall 2101 and domed inner wall 2102.

Figure 22:
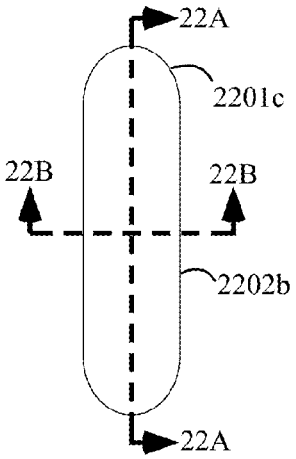
FIGS. 22, 22A, and 22B show a plasma-dome with multiple flat sides.
Figure 22A:
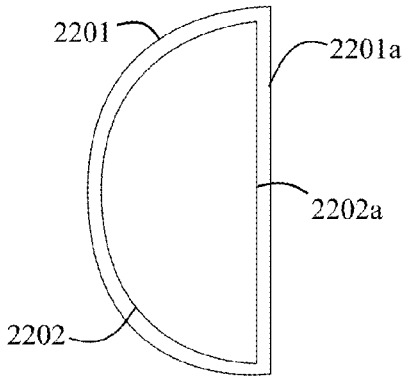
Figure 22B:
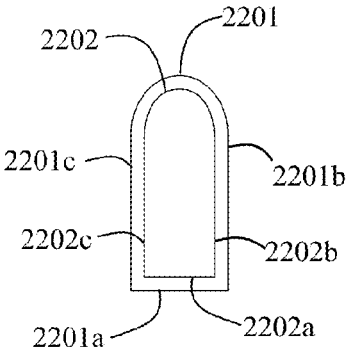

FIG. 22 is a top view of a plasma-dome with flattened outer shell wall 2201*b* and domed outer wall 2201*c*. FIG. 22A is a section 22A-22A view of FIG. 22 showing flattened outer wall 2201*a* and flattened inner wall 2202*a* with a dome having outer wall 2201 and inner wall 2202. FIG. 22B is a section 22B-22B view of FIG. 22 showing flattened outer wall 2201*b*, flattened inner wall 2202*b*, flattened outer wall 2201*a*, flattened inner wall 2202*a*, flattened outer wall 2201*c*, flattened inner wall 2202*c*, domed outer wall 2201, and domed inner wall 2202. In forming a PDP, the dome portion may be positioned within the substrate with the flat side up in the viewing direction or with the dome portion up in the viewing direction.

Figure 23:
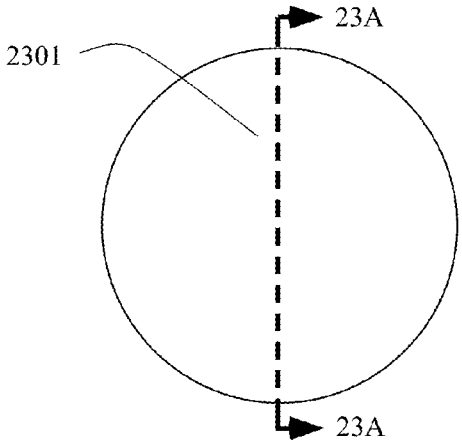
FIGS. 23 and 23A show a plasma-disc.
Figure 23A:
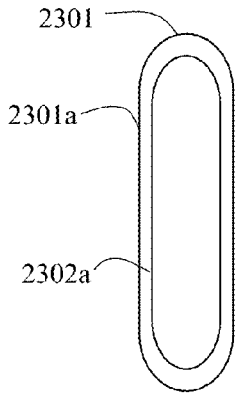

FIGS. 23 and 23A show a plasma-disc with opposing flattened walls 2301. FIG. 23A is a section 23A-23A view of opposite flat sides 2301*a*, flat inner wall 2302*a*, rounded wall 2301, and rounded inner wall 2302.

Figure 24:
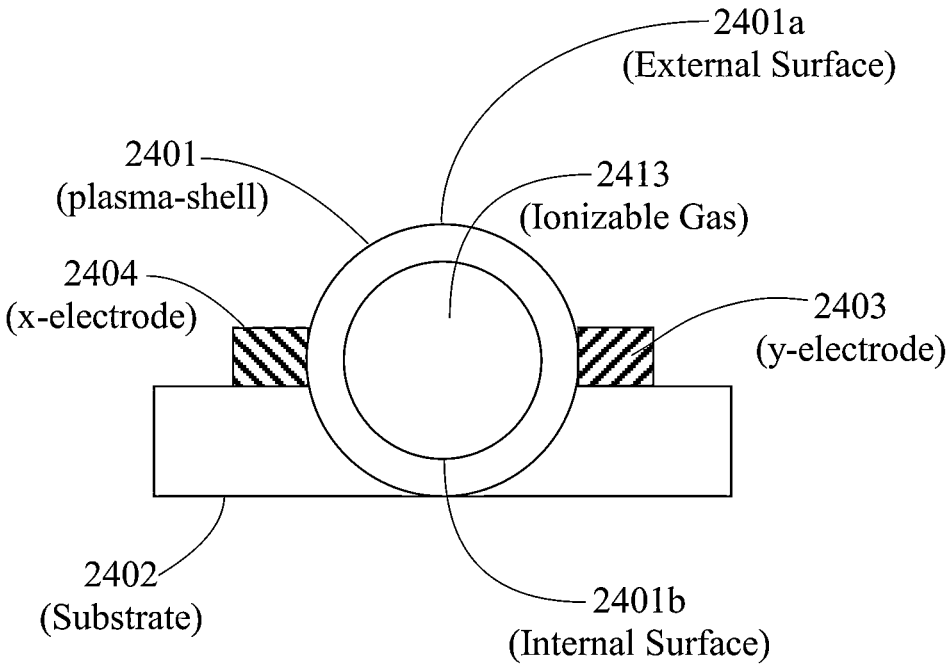
FIG. 24 shows a plasma-shell mounted on a substrate as a PDP pixel element.

In one embodiment of this invention, the plasma-shell is used as the pixel element of a single substrate PDP device as shown in FIG. 24. In FIG. 24 the plasma-shell 2401 may be a plasma-disc, or any other geometric shape. For the assembly of multiple PDP cells or pixels, it is contemplated using plasma-discs alone or in combination with other plasma-shells such as plasma-spheres or plasma-domes. The plasma-shell 2401 has an external surface 2401*a* and an internal surface 2401*b* and is positioned in a well or cavity on a PDP substrate 2402 and is composed of a material selected to have the properties of transmissivity to light, while being sufficiently impermeable as to the confined ionizable gas 2413. The gas 2413 is selected so as to discharge and produce light in the visible, IR, near UV, or UV range when a voltage is applied to electrodes 2404 and 2403. In the case where the discharge of the ionizable gas produces UV, a UV excitable phosphor (not shown) may be applied to the exterior or interior of the plasma-shell 2401 or embedded within the shell to produce light. Besides phosphors, other coatings may be applied to the interior and exterior of the shell to enhance contrast, and/or to decrease operating voltage. One such coating contemplated in the practice of this invention is a secondary electron emitter material such as magnesium oxide. Magnesium oxide is used in a PDP to decrease operating voltages. Also light reflective material coatings may be used. In accordance with this invention, there is provided apparatus and method comprising a very sensitive ionizing radiation sensor made from an array of plasma-shells. The inherent sensitivity of each plasma-shell to ionizing radiation is multiplied by the large surface area that can be combined into a single sensor. This is even more so when a plasma-disc is used.

Radiation Detection

Figure 25:
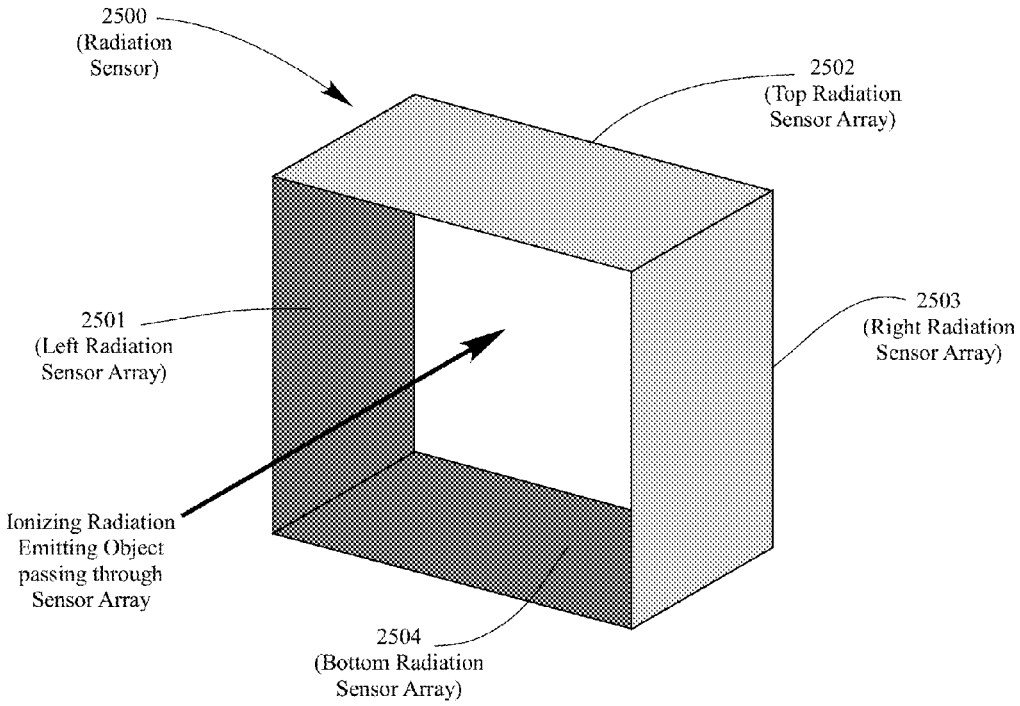
FIG. 25 is a perspective view of a rectangular ring plasma-shell array arranged to detect ionizing radiation sources passed through it.

FIG. 25 shows a rectangular ring plasma-shell array 2500 arranged to detect ionizing radiation sources passed through it. The sensor sensitivity is augmented by the sum of the radiation detected by all four-sensor arrays 2501, 2502, 2503, and 2504. The ring may comprise a cylinder or other hollow body of any suitable geometric shape through which an object can be passed through and inspected for radiation emissions. Typical geometric shapes include a circle, square, rectangle, triangle, pentagon, or hexagon. The ring or cylinder may comprise a tunnel, channel, groove, furrow, rut, passageway, subway, hollow, or excavated area. Examples of objects to be inspected include not by way of limitation a container, case, freight, luggage, cargo, clothing, garment, attire, or vehicles such as motorcycles, automobiles, trucks, trains, ships, or boats.

Figure 26:
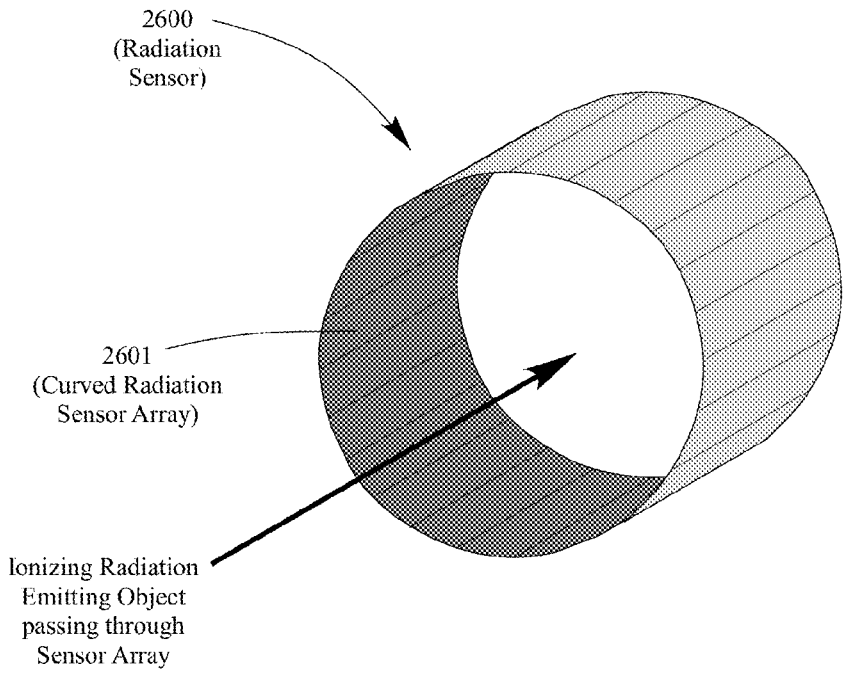
FIG. 26 is a perspective view of a cylindrical ring plasma-shell array arranged to detect ionizing radiation sources passed through it.

FIG. 26 shows a cylindrical ring plasma-shell array 2600 arranged to detect ionizing radiation sources passed through it. The sensor sensitivity is augmented by the sum of the radiation detected by the entire area of the cylindrical arrays 2601.

Figure 27:
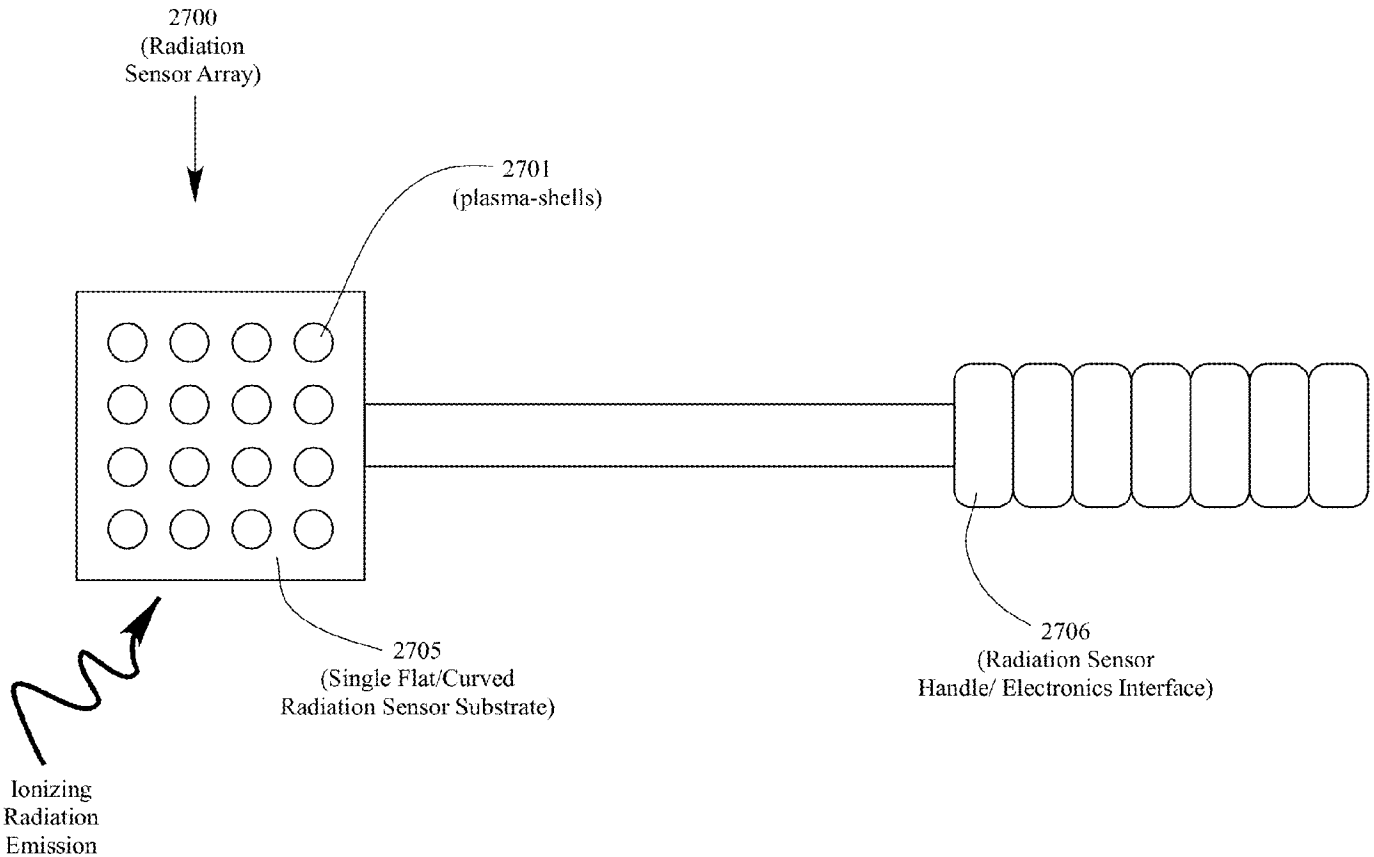
FIG. 27 shows a flat or curved panel plasma-shell array arranged to detect ionizing radiation sources in proximity to it.

FIG. 27 shows a flat or curved panel plasma-shell array 2700 arranged to detect ionizing radiation sources in proximity to it. The paddle wand has a substrate 2705 containing a large array of plasma-shells 2701. This arrangement can be used in like or in conjunction with widely used metal detector wands. Handle 2706 contains the sensor electronics interface.

Figure 28:
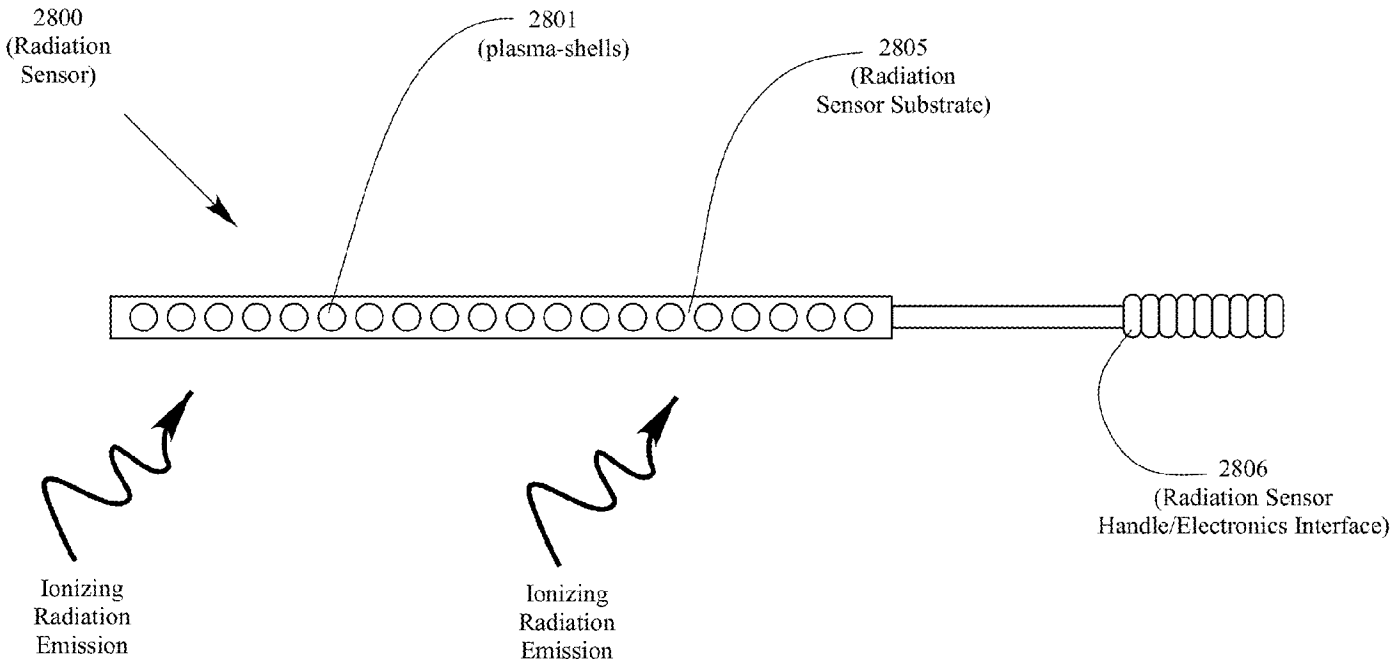
FIG. 28 shows a rod like plasma-shell array arranged to detect ionizing radiation sources in proximity to it.

FIG. 28 shows a rod-like panel plasma-shell array 2800 arranged to detect ionizing radiation sources in proximity to it. The rod has a substrate 2805 containing a large array of plasma-shells 2801. This arrangement can be used to probe deep into ship cargo holds or containers to detect radioactive material that is both buried and shielded to conceal its presence. The rod like shape of this detector together with the large number of detectors along its length enhances detection sensitivity. Further, the rod detector shape allows the detector to be brought into close proximity to a shielded radioactive source. For example a ship's cargo hold full of grain may be probed with a long rod detector. Handle 2806 contains the sensor electronics interface.

Figure 29:
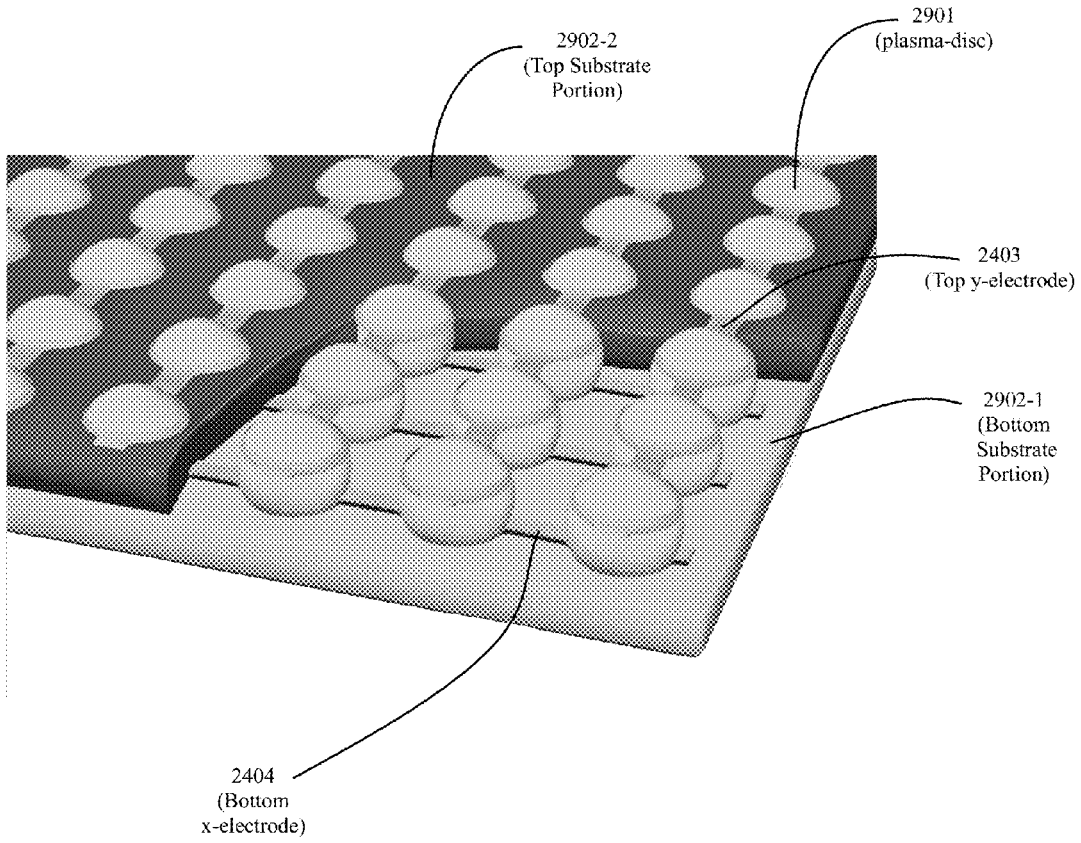
FIG. 29 is a computerized three dimensional illustration of plasma-domes mounted on a substrate with connecting electrodes.

FIG. 29 is a computer illustration of plasma-domes 2901 mounted on a substrate 2902 that is shown in a cut away with a bottom substrate portion 2902-1 and top substrate portion 2902-2. Also shown are bottom x-electrode 2404 and top y-electrode 2403. In this embodiment, the plasma-domes have a 2 mm diameter shell. Each plasma-dome detector has a 1 mm gas depth. The dome shell is approximately 40 to 60 microns thick and there is no electrode or cover plate between the sphere surface and the radiation source. Although plasma-domes are shown, plasma-discs, plasma-spheres, or any other suitable shape may be used.

PDP Electronics

Figure 30:
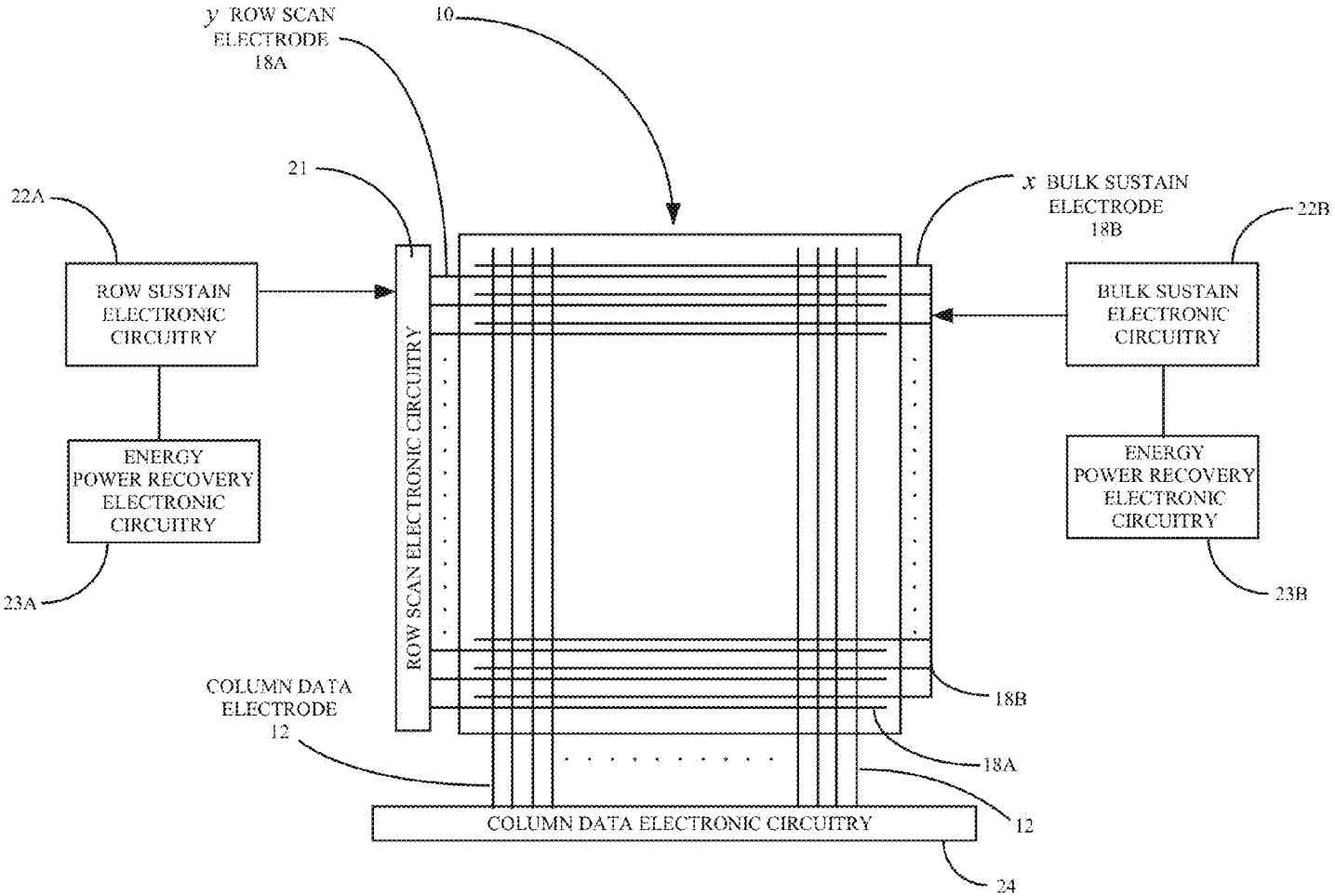
FIG. 30 shows a block diagram of electronics for driving an AC gas discharge plasma display with plasma-shells as pixels.

FIG. 30 is a block diagram of a plasma display panel (PDP) 10 with electronic circuitry 21 for y row scan electrodes 18A, bulk sustain electronic circuitry 22B for x bulk sustain electrode 18B and column data electronic circuitry 24 for the column data electrodes 12. The pixels or subpixels of the PDP comprise plasma-shells not shown in FIG. 30. There is also shown row sustain electronic circuitry 22A with an energy power recovery electronic circuit 23A. There is also shown energy power recovery electronic circuitry 23B for the bulk sustain electronic circuitry 22B. The electronics architecture used in FIG. 30 is ADS as described in the Shinoda and other patents cited herein including U.S. Pat. No. 5,661,500. In addition, other architectures as described herein and known in the prior art may be utilized. These architectures including Shinoda ADS may be used to address plasma-shells. The shells may be operated discretely or collectively. The collective operation may include some or all of the shells being electrically connected together.

Electrode Structure

Figure 31:
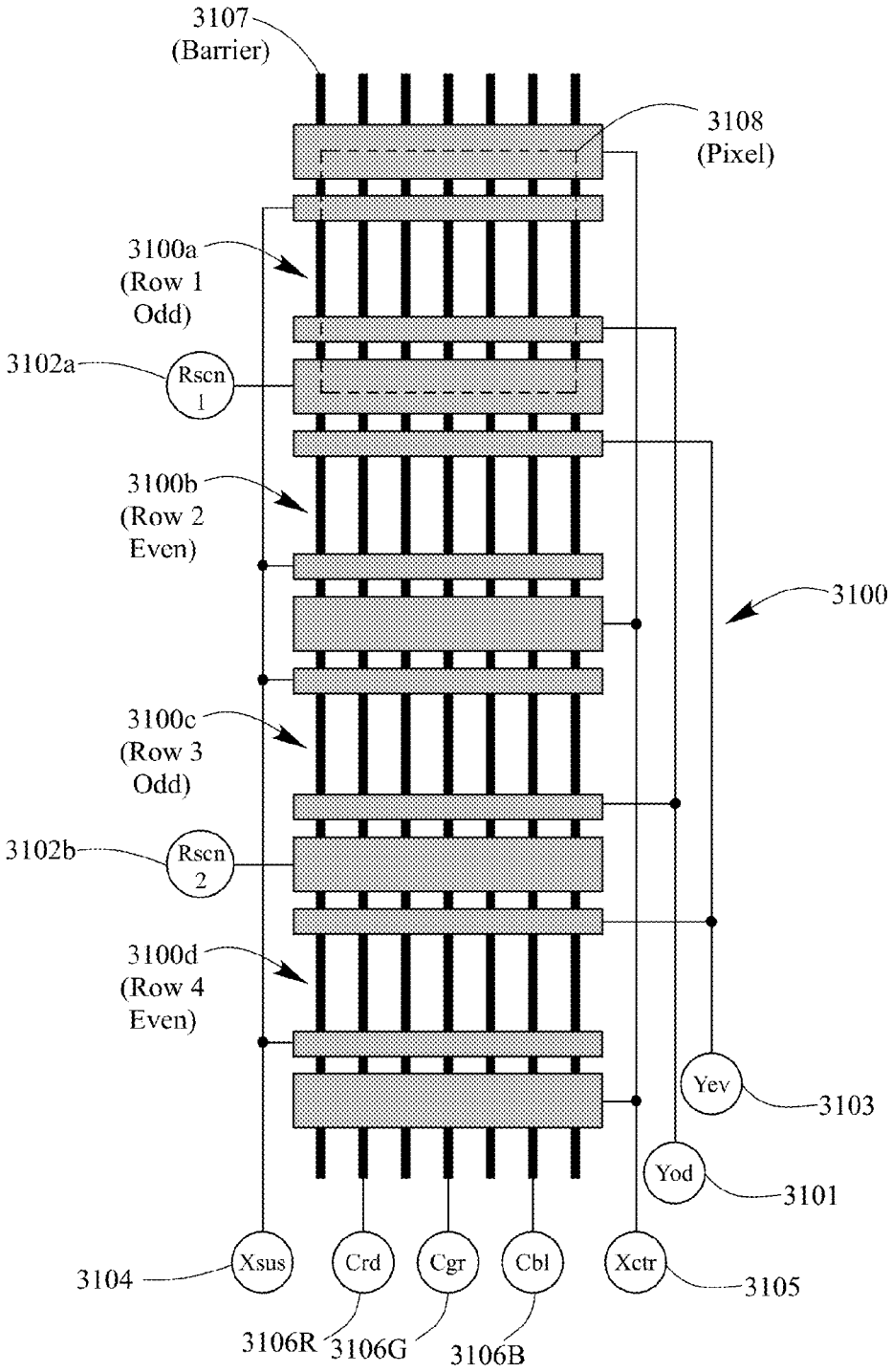
FIG. 31 illustrates an overview of an AC plasma display panel electrode structure with positive column discharge.

FIG. 31 shows the electrode structure for an AC plasma display 3100 with odd and even rows 3100*a*, 3100*b*, 3100*c*, and 3100*d* and a multiplicity of pixels or sub-pixels 3108 to be operated in the positive column discharge mode in accordance with this invention. Each row has a wide separation between the X sustain (Xsus) 3104 and Y odd (Yod) 3101 or Y even (Yev) 3103 sustain electrodes for the positive column gas discharge sustaining. Row scan electrodes (Rscn) 3102*a* and 3102*b* are positioned between Yod 3101 and Yev 3103 sustain electrodes. The X Center electrodes (Xctr) 3105 are located in the space between the adjacent Xsus 3104 electrodes. High dark room contrast ratio is made possible by covering the area between rows with horizontal black strips (not shown). These strips mask unwanted light output from setup and addressing discharges.

Column Data electrodes 3106R, 3106B, and 3106G are used in addressing each subpixel. Full color RGB is addressed by the Column Data electrode (Crd) 3106R (red), Column Data electrode (Cgr) 3106G (green) and Column Data electrode (Cbl) 3106B (blue). Also shown in FIG. 31 are barriers 3107 that separate the subpixels. The Row Scan electrodes 3102 and Column Data electrodes 3106 R, 3106B, and 3106G are the addressing electrodes. In this embodiment, the wide Row Scan electrodes 3102*a* and 3102*b* have a greater area facing to the Column Data electrodes 3106 R, 3106B, and 3106G, which reduce the discharge delay. The addressing electrodes are separate from and driven independently from sustain X and Y electrodes. Therefore this embodiment is an independent sustain/address type. All electrodes whose drive voltage pulses are in opposition have their electrode connections to opposite sides of the panel.

Figure 32A:
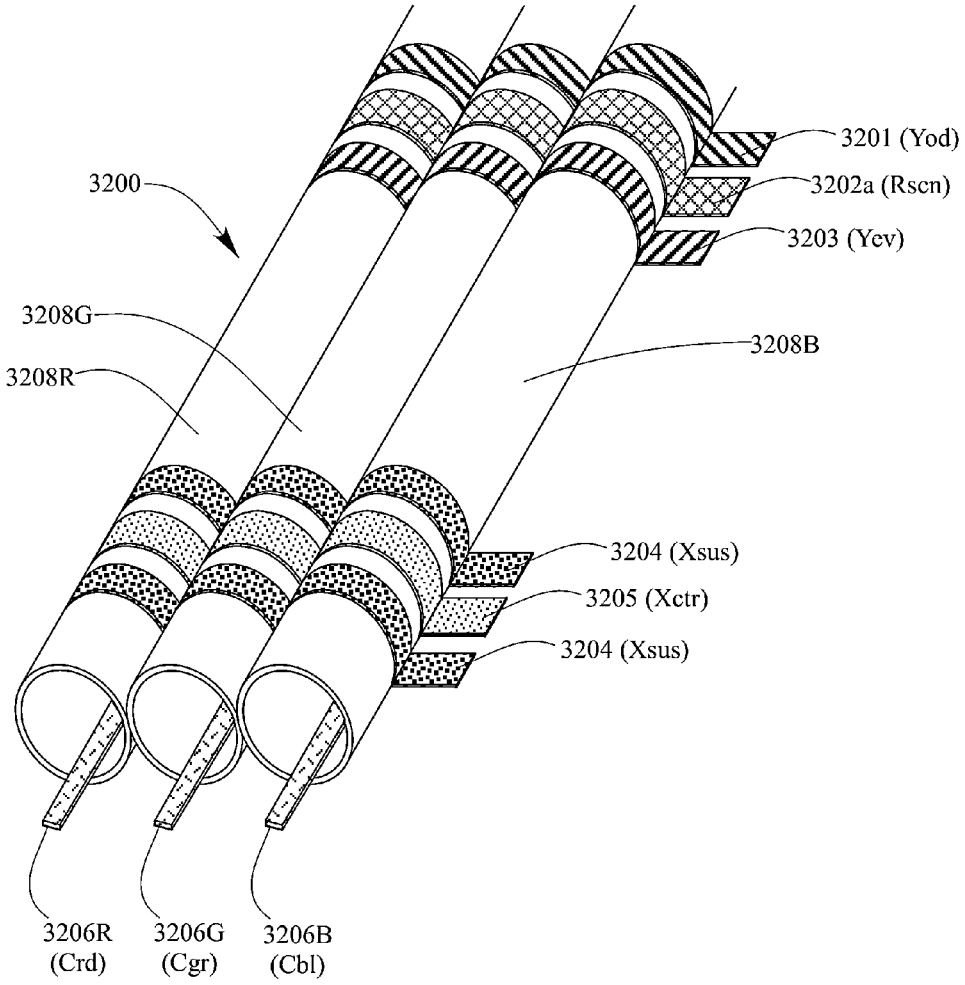
FIG. 32A illustrates the electrode structure for an AC plasma display pixel using elongated plasma-tubes.

FIG. 32A shows a tubular PDP electrode structure 3200 that illustrates a reduced portion of FIG. 31. As shown there are three tubes 3208R, 3208G, 3208B filled with ionizable gas to define RGB pixels or sub-pixels. The RGB subpixels may be defined by a luminescent material located inside or outside each designated tube 3208R, 3208G, 3208B. Each tube may contain a color gas such as an excimer and/or made from a color material such as tinted glass. The display's row sustain electrodes, consisting of X sustain (Xsus) 3204 and opposing Y odd (Yod) 3201 or Y even (Yev) 3203 sustain electrodes, have a distance separation between them. The separation is sufficient to allow positive column gas discharge sustaining, typically 800 microns or more. Row scan electrodes (Rscn) 3202*a* are positioned between Yod 3201 and Yev 3203 sustain electrodes. The X Center electrodes (Xctr) 3205 are in the space between the Xsus electrodes 3204. During the setup or conditioning period plasma discharges produce unwanted light output at these electrodes. Also, during the addressing period unwanted light is produced at the Row Scan electrodes (Rscn) 3202*a*. While the X Center electrodes (Xctr) 3205 and Row Scan electrodes (Rscn) 3202*a* mask out a substantial portion of this unwanted light, further improvement is made possible by the addition of horizontal black strips (not shown) covering the area between the display's rows. The masking out of unwanted light and the use of black stripes provides a very high contrast ratio for the display. Column Data electrodes 3206R, 3206G, 3206B are used in addressing each subpixel. Full color RGB is addressed by (Crd) 3206R (red), (Cgr) 3206G (green) and (Cbl) 3206B blue electrodes.

The Row Scan and Column Data electrodes are the display's addressing electrodes. In this design the wide Row Scan electrode has a greater area facing to the Column Data electrode, which reduces the discharge delay. The addressing electrodes are separate from and driven independently from sustain X and Y electrodes. Therefore this design is a true independent sustain/address type. All electrodes whose drive voltage pulses are in opposition make their electrode connections to opposite sides of the panel.

Figure 32B:
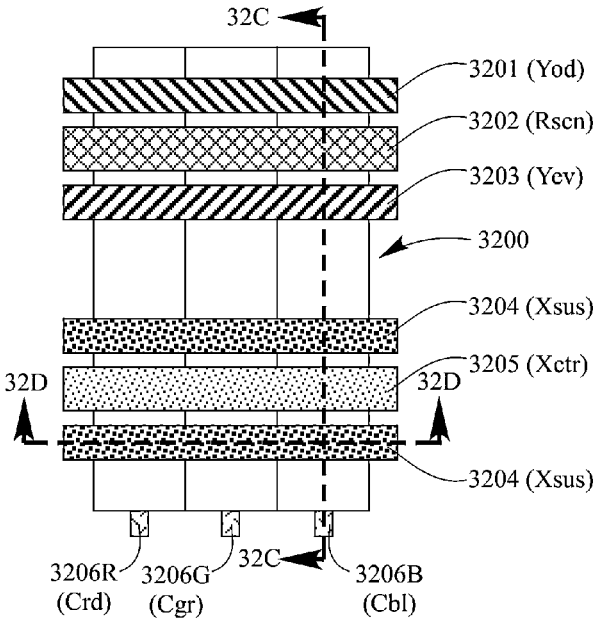
FIG. 32B illustrates the top view of the electrode structure of FIG. 32A.

FIG. 32B is a top view of a tubular PDP electrode structure 3200 showing Y odd electrode 3201, Row scan electrode 3202, Y even electrode 3203, X sustain electrode 3204, X center electrode 3205, and Column Data electrodes 3206R, 3206G, 3206B.

Figure 32C:
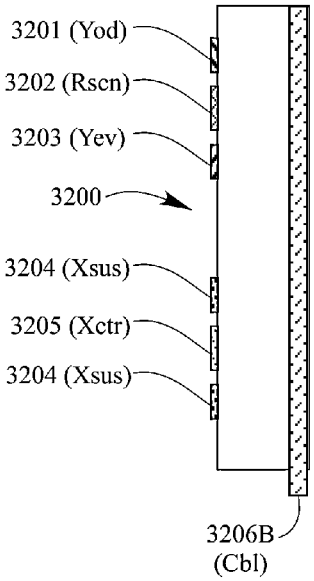
FIG. 32C illustrates a section A-A view of the structure of FIG. 32A.

FIG. 32C is a section 32C-32C view of the tubular PDP electrode structure 3200 seen in FIG. 32B. Shown are Y odd electrode 3201, Row scan electrode 3202, Y even electrode 3203, X sustain electrode 3204, X center electrode 3205, and Column Data electrode 3206B.

Figure 32D:
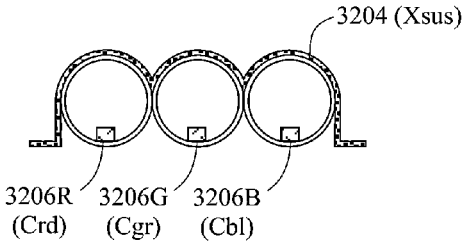
FIG. 32D illustrates a section B-B view of the structure of FIG. 32A.

FIG. 32D is a section 32D-32D view of the tubular PDP electrode structure 3200 seen in FIG. 32B. Shown are X sustain electrode 3204 and Column Data electrodes 3206R, 3206G, 3206B.

Drive Scheme

Figure 33:
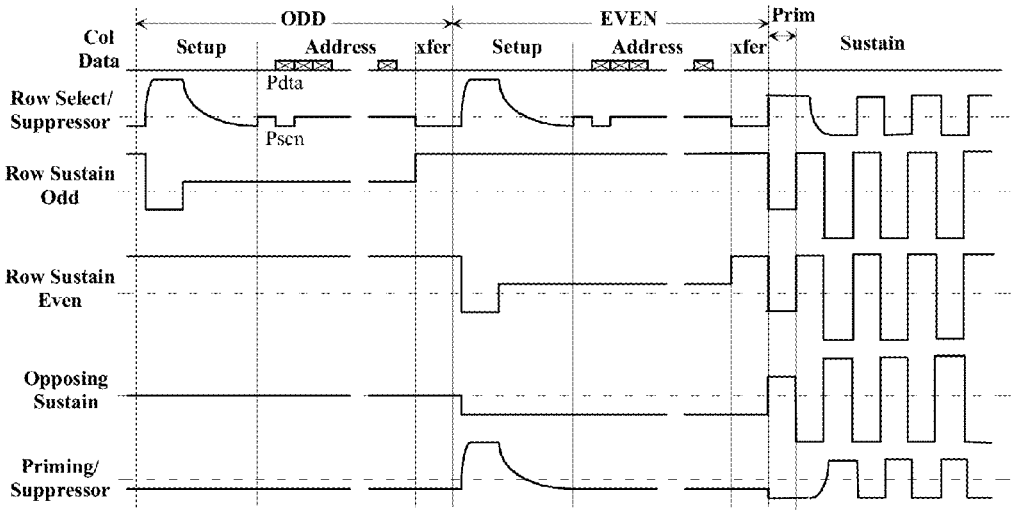
FIG. 33 illustrates drive waveforms for operating of a plasma display panel with positive column discharge.
Figure 34:
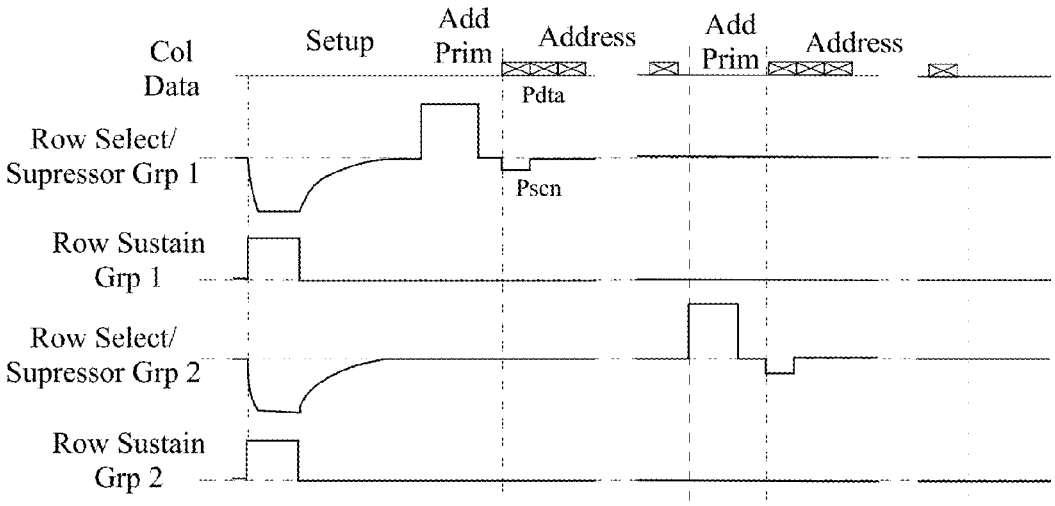
FIG. 34 illustrates address-priming waveforms.

FIGS. 33 and 34 show one set of driving waveforms. As shown in FIG. 33, the waveforms are divided into odd and even row periods consisting of setup (conditioning), selective erase-addressing operation, and transfer. The X OFF Reset or conditioning period eliminates X sustain priming discharges in OFF cells. Last is the sustain period whose positive column gas discharge sustaining of ON cells produce the display light output.

Figure 35:
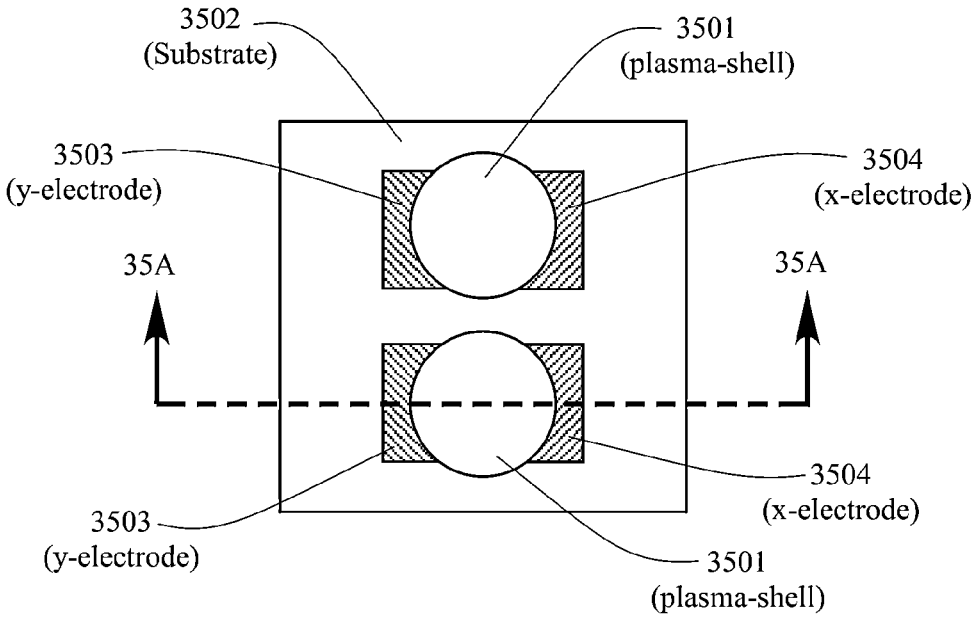
FIG. 35 is a top view of plasma-shells on the top and bottom surfaces of a substrate.

FIG. 35 is a top view of plasma-shells 3501 on the top and bottom surfaces of a substrate 3502. This view shows two plasma-shells 3501 their respective y-electrodes 3503, x-electrodes 3504 as visible on the top or bottom of the substrate 3502.

Figure 35A:
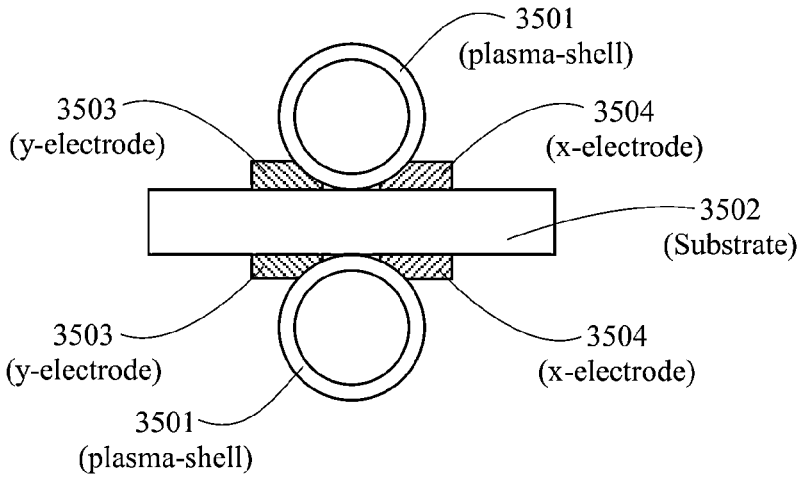
FIG. 35A is a section 35A-35A view of plasma-shells on the top and bottom surfaces of a substrate.

FIG. 35A is a section 35A-35A view of plasma-shells 3501 on the top and bottom surfaces of a substrate 3502, their respective y-electrodes 3503 and x-electrodes 3504.

Figure 36:
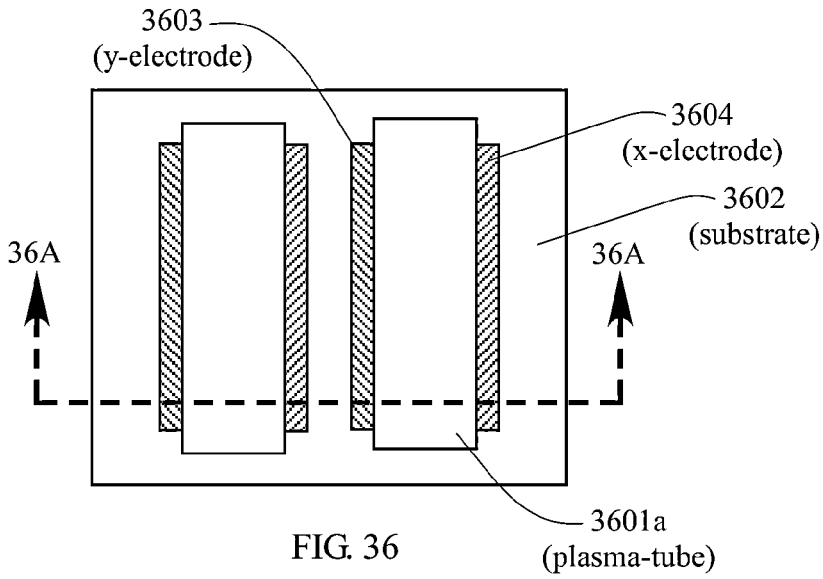
FIG. 36 is a top view of plasma-tubes on the top and bottom surfaces of a substrate.

FIG. 36 is a top view of plasma-tubes 3601*a* on the top and bottom surfaces of a substrate 3602. This view shows two plasma-tubes 3601*a* their respective y-electrodes 3603, x-electrodes 3604 as visible on the top or bottom of the substrate 3602.

Figure 36A:
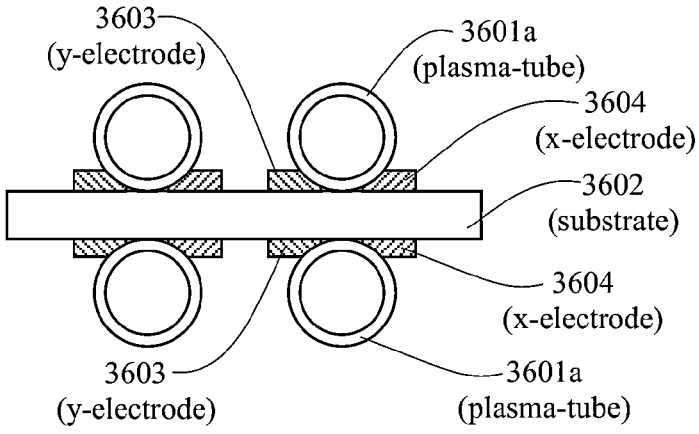
FIG. 36A is a section 36A-36A view of plasma-tubes on the top and bottom surfaces of a substrate.

FIG. 36A is a section 36A-36A view of plasma-tubes 3601*a* on the top and bottom surfaces of a substrate 3602, their respective y-electrodes 3603 and x-electrodes 3604.

Figure 36B:
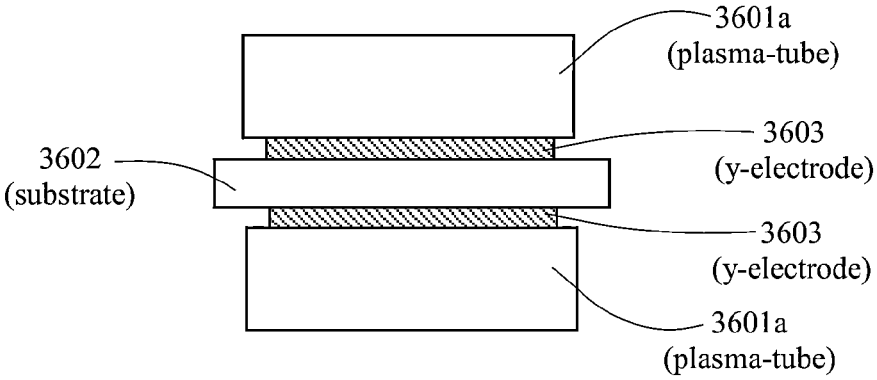
FIG. 36B is a side view of plasma-tubes on the top and bottom surfaces of a substrate.

FIG. 36B is a side view of plasma-tubes 3601*a* on the top and bottom surfaces of a substrate 3602. Shown are plasma-tube 3601*a*, y-electrode 3603, and substrate 3602.

Figure 37:
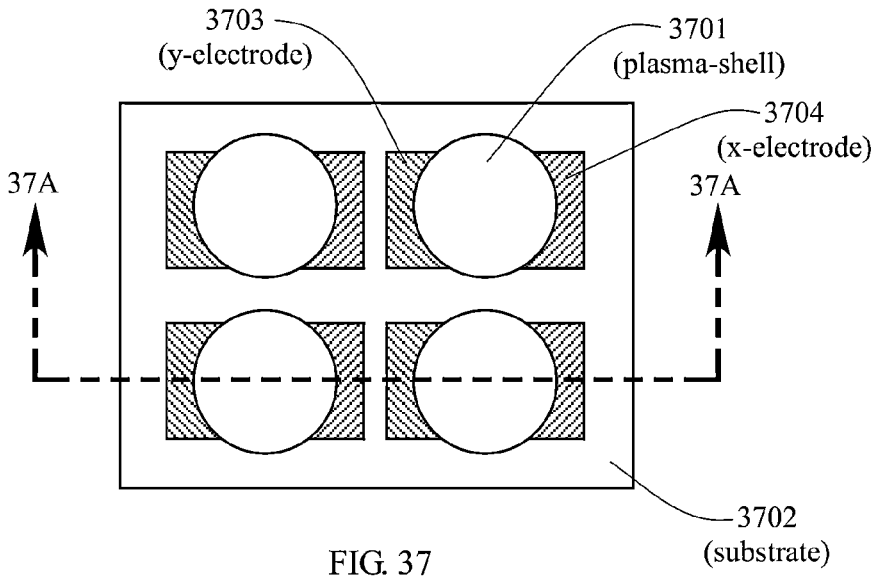
FIG. 37 is a top view of stacked plasma-shells on a substrate.

FIG. 37 is a top view of plasma-shells 3701 stacked on the top surface of a substrate 3702, connected to their respective x-electrodes 3704 and y-electrodes 3703.

Figure 37A:
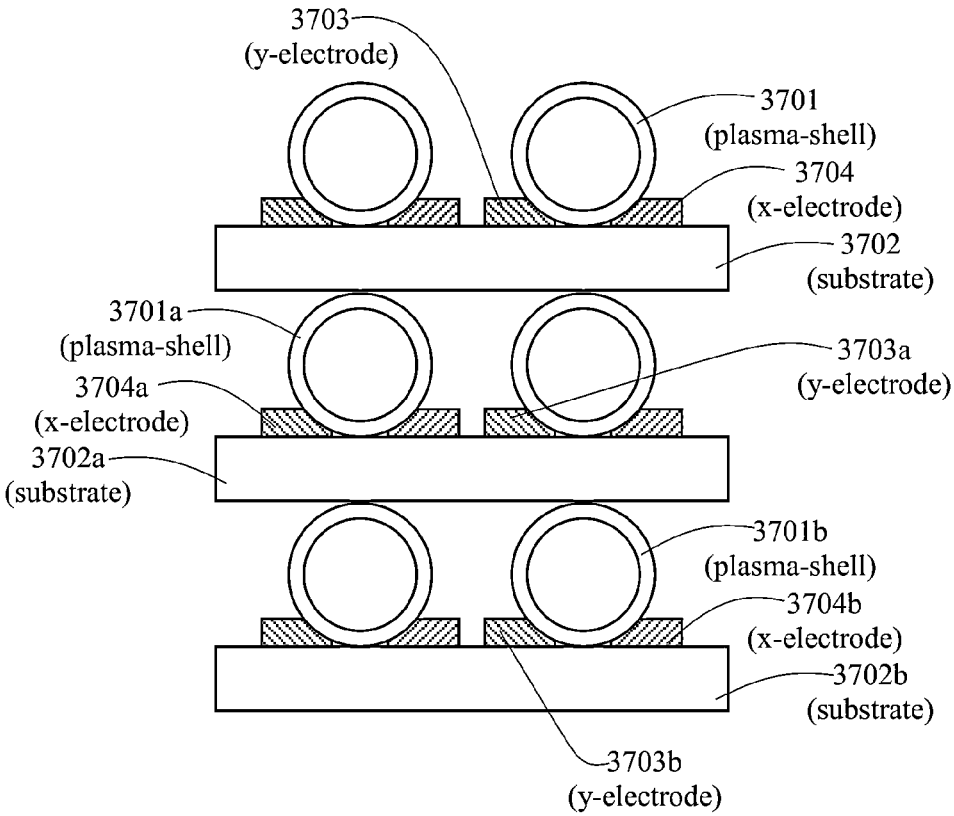
FIG. 37A is a section 37A-37A view of stacked plasma-shells on a substrate.

FIG. 37A is a section 37A-37A view of plasma-shells 3701 on the top surfaces of a substrate 3702, their respective y-electrodes 3703 and x-electrodes 3704 stacked on top of a substrate 3702*a* which has plasma-shells 3701*a* connected to x-electrodes 3704*a* and y-electrodes 3703*a*. These two layers of substrate and plasma-shells are then stacked on top of a substrate 3702*b* which has plasma-shells 3701*b* connected to x-electrodes 3704*b* and y-electrodes 3703*b*.

Figure 38:
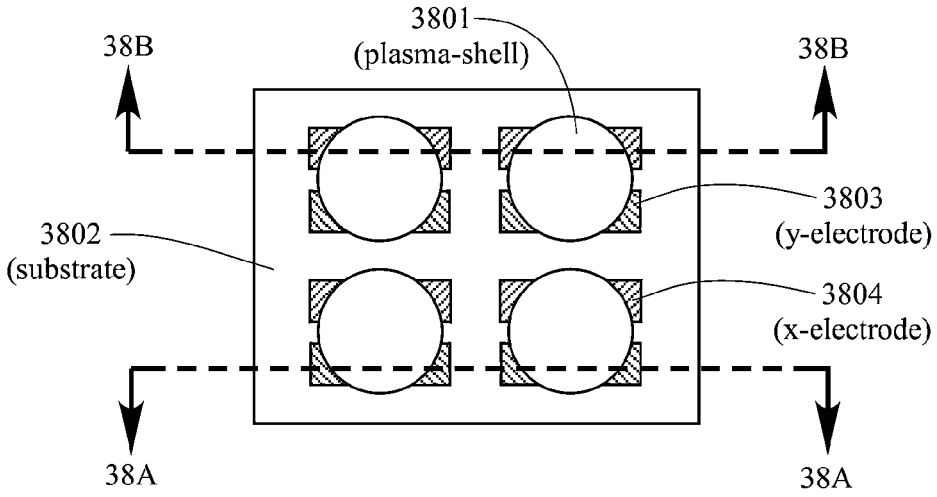
FIG. 38 is a top view of stacked plasma-shells on a substrate.

FIG. 38 is a top view of stacked plasma-shells 3801 on a substrate 3802, x-electrode 3804, and y-electrode 3803.

Figure 38A:
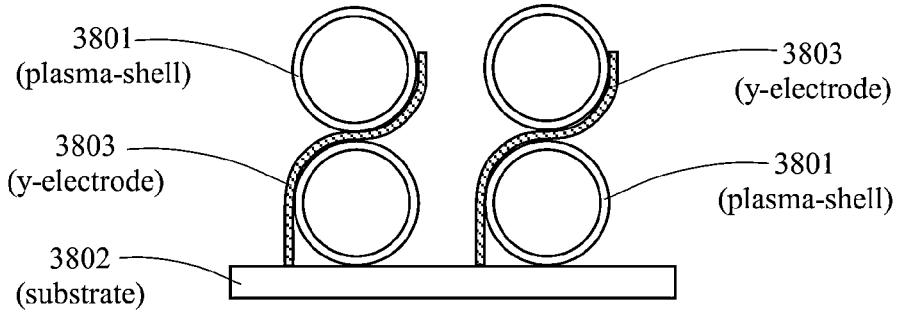
FIG. 38A is a section 38A-38A view of stacked plasma-shells on a substrate.

FIG. 38A is a section 38A-38A view of stacked plasma-shells 3801 on a substrate 3802. Also visible in this view are y-electrodes 3803 weaved in between the plasma-shells 3801.

Figure 38B:
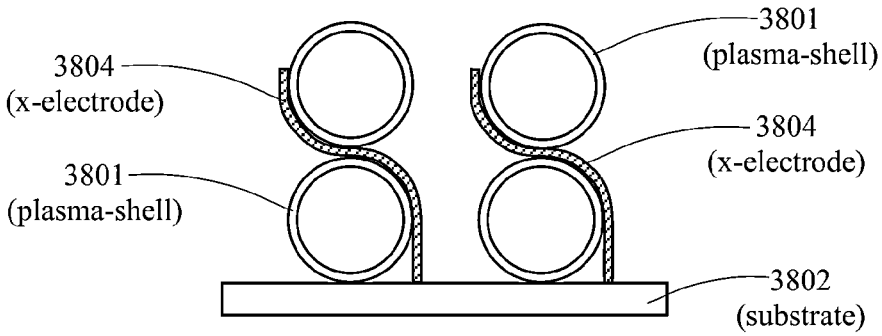
FIG. 38B is a section 38B-38B view of stacked plasma-shells on a substrate.

FIG. 38B is a section 38B-38B view of stacked plasma-shells 3801 on a substrate 3802. Also visible in this view are x-electrodes 3804 weaved in between the plasma-shells 3801.

Figure 39:
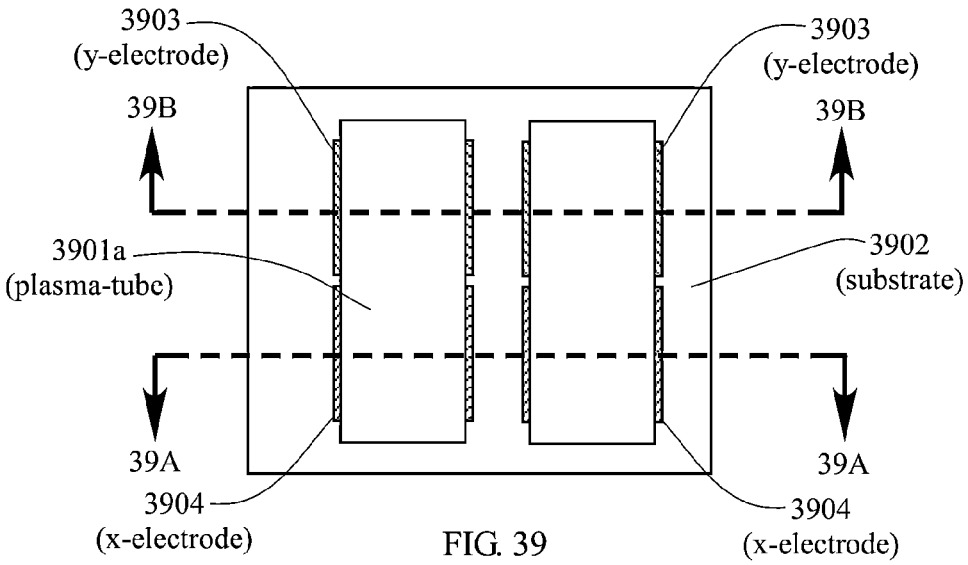
FIG. 39 is a top view of stacked plasma-tubes on a substrate.

FIG. 39 is a top view of stacked plasma-tubes 3901*a* on a substrate 3902, x-electrode 3904, and y-electrode 3903.

Figure 39A:
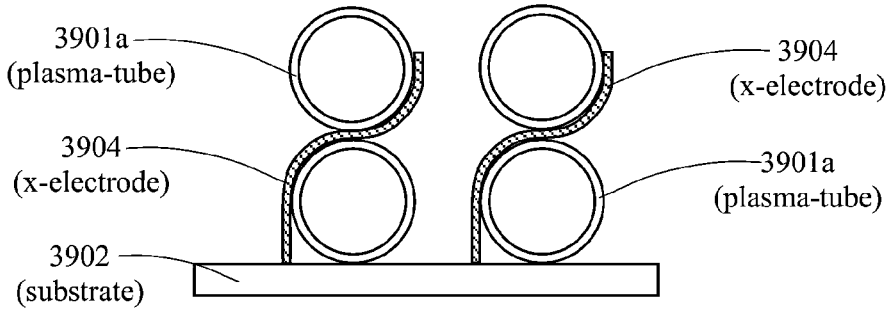
FIG. 39A is a section 39A-39A view of stacked plasma-tubes on a substrate.

FIG. 39A is a section 39A-39A view of stacked plasma-tubes 3901*a* on a substrate 3902. Also visible in this view are y-electrodes 3903 weaved in between the plasma-tubes 3901*a*.

Figure 39B:
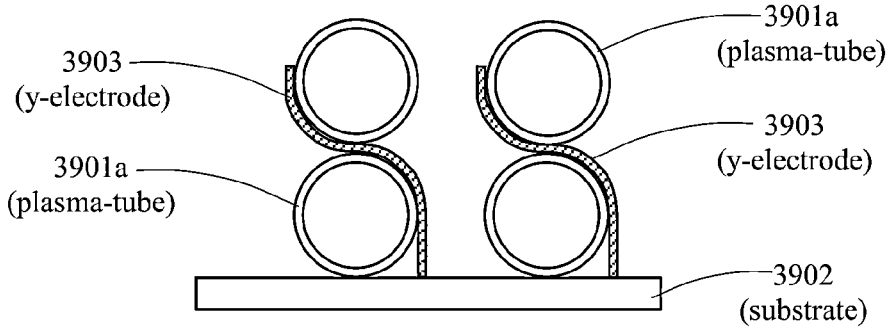
FIG. 39B is a section 39B-39B view of stacked plasma-tubes on a substrate.

FIG. 39B is a section 39B-39B view of stacked plasma-tubes 3901*a* on a substrate 3902. Also visible in this view are x-electrodes 3904 weaved in between the plasma-shells 3901.

Figure 40:
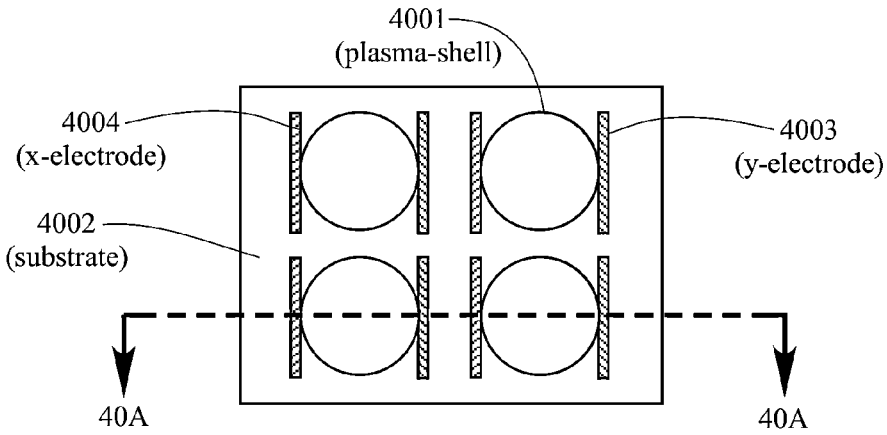
FIG. 40 is a top view of stacked plasma-shells on a substrate.

FIG. 40 is a top view of stacked plasma-shells 4001 on a substrate 4002 with x-electrodes 4003 and y-electrodes 4004.

Figure 40A:
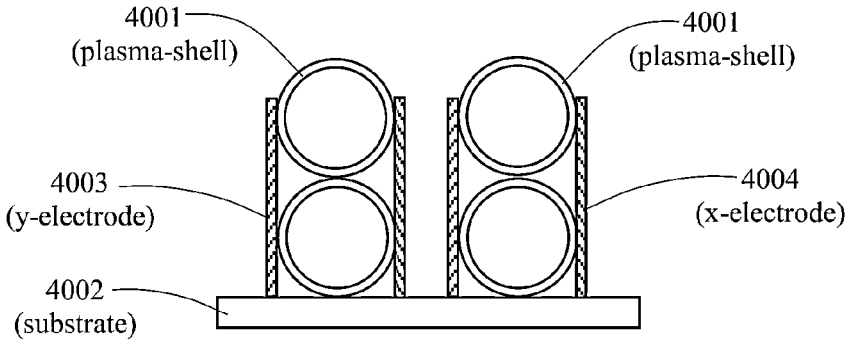
FIG. 40A is a section 40A-40A view of stacked plasma-shells on a substrate.

FIG. 40A is a section 40A-40A view of stacked plasma-shells 4001 on a substrate 4002 with x-electrodes 4003 and y-electrodes 4004 tangent to opposite sides of the plasma-shell 4001.

Figure 41:
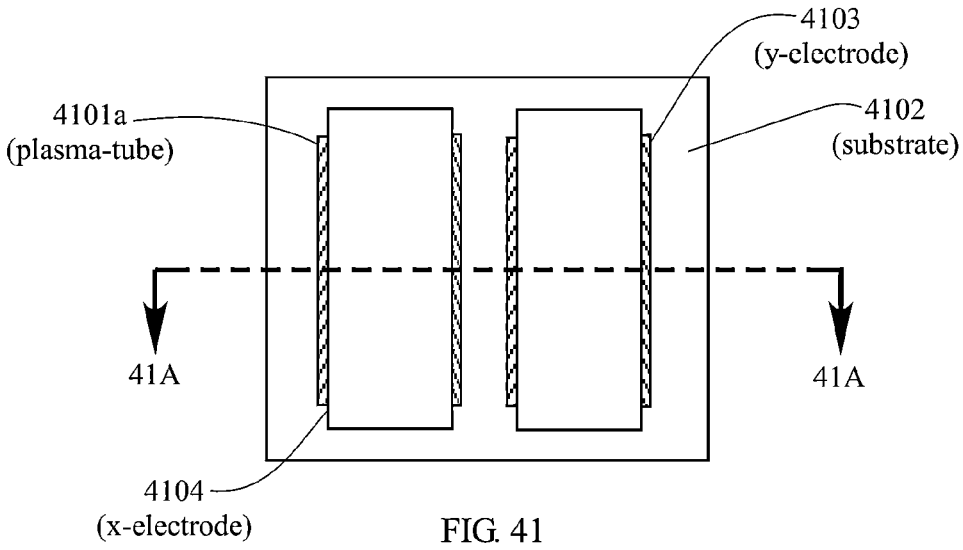
FIG. 41 is a top view of stacked plasma-tubes on a substrate.

FIG. 41 is a top view of stacked plasma-tubes 4101*a* on a substrate 4102 with x-electrodes 4103 and y-electrodes 4104.

Figure 41A:
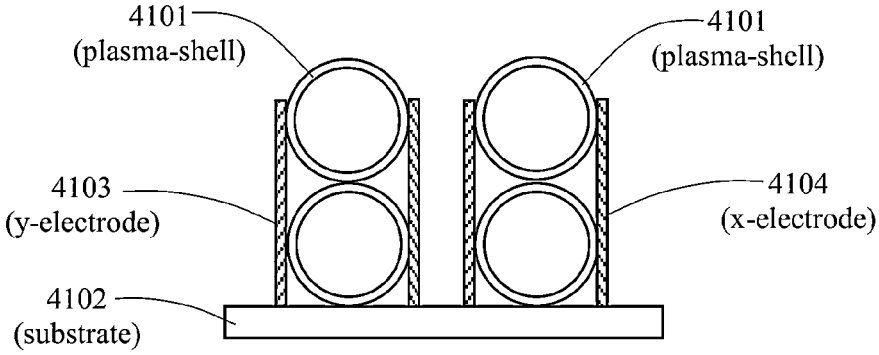
FIG. 41A is a section 41A-41A view of stacked plasma-tubes on a substrate.

FIG. 41A is a section 41A-41A view of stacked plasma-tubes 4101*a* on a substrate 4102 with x-electrodes 4103 and y-electrodes 4104 tangent to opposite sides of the plasma-tubes 4101*a*.

Figure 42A:
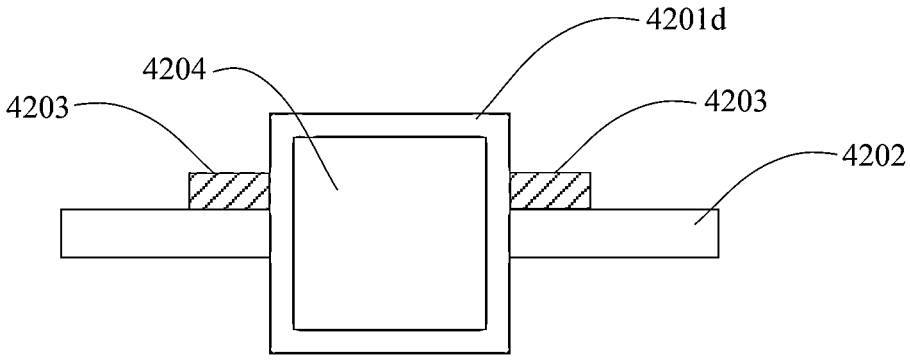
FIG. 42A shows a plasma-cube located within a substrate with a x-electrode and y-electrode.

FIG. 42A shows a hollow plasma-cube 4201*d* embedded within a substrate 4202. Gas 4204 is contained within the plasma-cube 4201*d*. Electrodes 4203 are attached or bonded to the plasma-cube 4201*d*. The electrodes 4203 are shown in contact with substrate 4202 and may be bonded or attached to the substrate 4202.

Figure 42B:
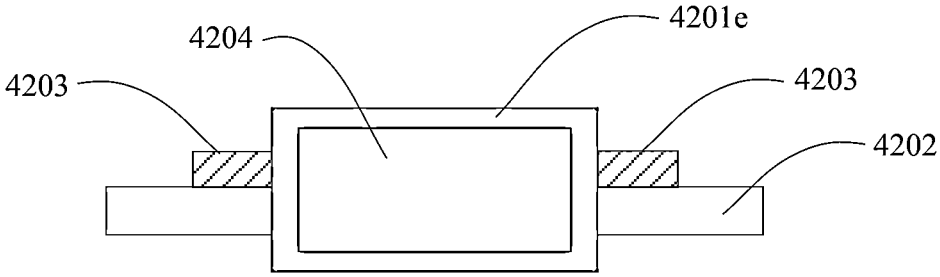
FIG. 42B shows a plasma-cuboid located within a substrate with a x-electrode and y-electrode.

FIG. 42B shows a hollow plasma-cuboid 4201*e* embedded within a substrate 4202. Gas 4204 is contained within the plasma-cuboid 4201*e*. Electrodes 4203 are attached or bonded to the plasma-cuboid 4201*e*. The electrodes 4203 are shown in contact with substrate 4202 and may be bonded or attached to the substrate 4202.

Figure 43A:
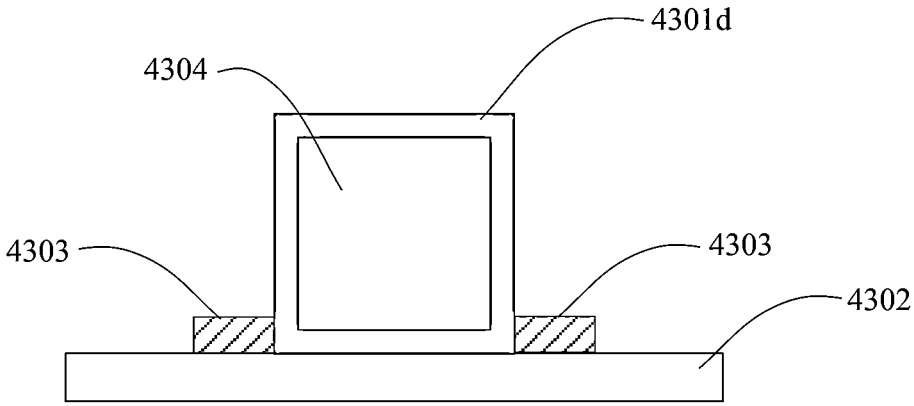
FIG. 43A shows a plasma-cube located on a substrate with a x-electrode and y-electrode.

FIG. 43A shows a hollow plasma-cube 4301*d* located on the surface of a substrate 4302. Gas 4304 is contained within the plasma-cube 4301*d*. Electrodes 4303 are attached or bonded to the plasma-cube 4301*d*. The electrodes 4303 are shown in contact with substrate 4302 and may be bonded or attached to the substrate 4302.

Figure 43B:
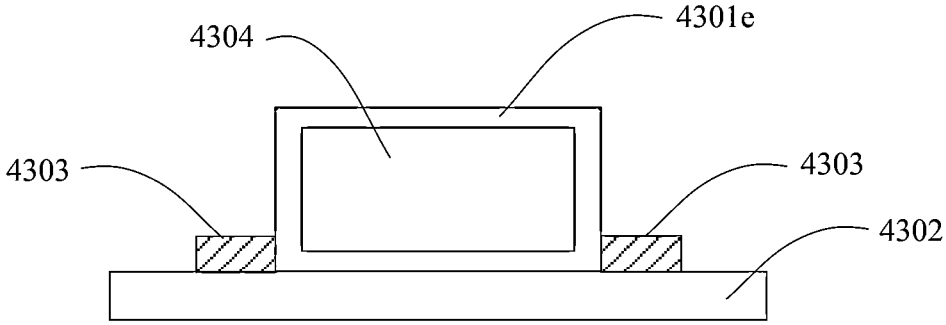
FIG. 43B shows a plasma-cuboid located on a substrate with a x-electrode and y-electrode.

FIG. 43B shows a hollow plasma-cuboid 4301*e* located on the surface of a substrate 4302. Gas 4304 is contained within the plasma-cuboid 4301*e*. Electrodes 4303 are attached or bonded to the plasma-cuboid 4301*e*. The electrodes 4303 are shown in contact with substrate 4302 and may be bonded or attached to the substrate 4302.

Figure 44:
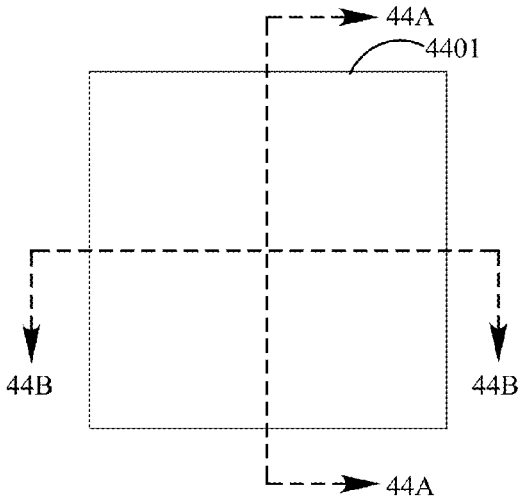
FIGS. 44, 44A, and 44B show a plasma-cube.
Figure 44A:
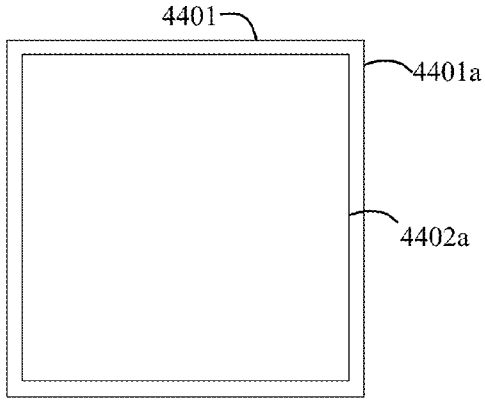
Figure 44B:
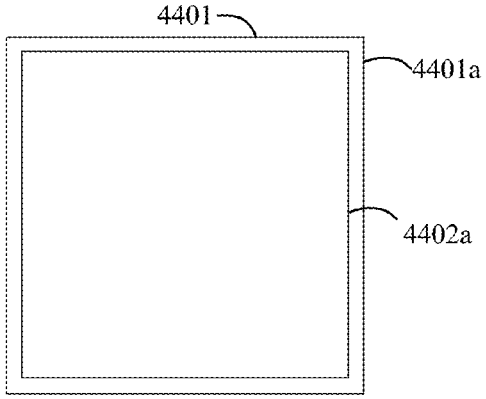

FIGS. 44, 44A, and 44B show a plasma-shell in the shape of a plasma-cube. As illustrated in FIG. 44, the plasma-cube has opposing flat, parallel sides 4401.

FIG. 44A is a section 44A-44A view of FIG. 44 with flat, parallel sides 4401, inside wall surface 4402*a*, and outer wall surface 4401*a*.

FIG. 44B is a section 44B-44B view of FIG. 44 with flat, parallel sides 4401, inside wall surface 4402*a*, and outer wall surface 4401*a*.

Figure 45:
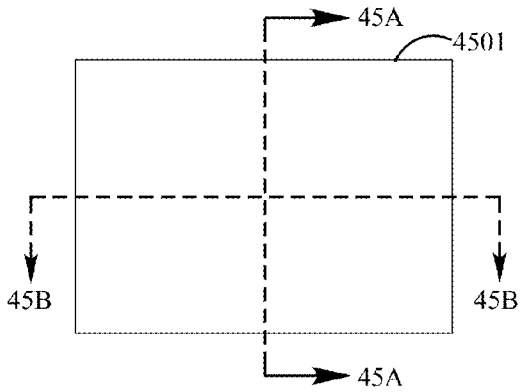
FIGS. 45, 45A, and 45B show a plasma-cuboid.
Figure 45A:
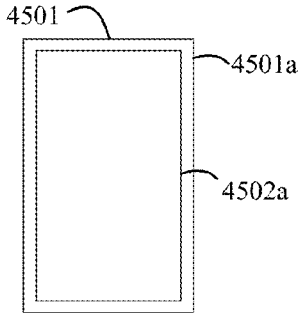
Figure 45B:
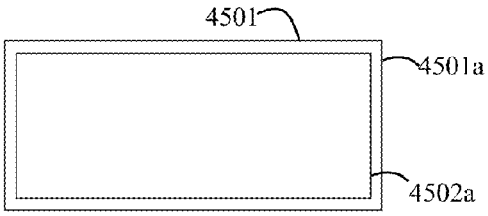

FIGS. 45, 45A, and 45B show a plasma-shell in the shape of a plasma-cuboid. As illustrated in FIG. 45, the plasma-cuboid has opposing flat, parallel sides 4501.

FIG. 45A is a section 45A-45A view of FIG. 45 with flat, parallel sides 4501, inside wall surface 4502*a*, and outer wall surface 4501*a*.

FIG. 45B is a section 45B-45B view of FIG. 45 with flat, parallel sides 4501, inside wall surface 4502*a*, and outer wall surface 4501*a*.

Figure 46A:
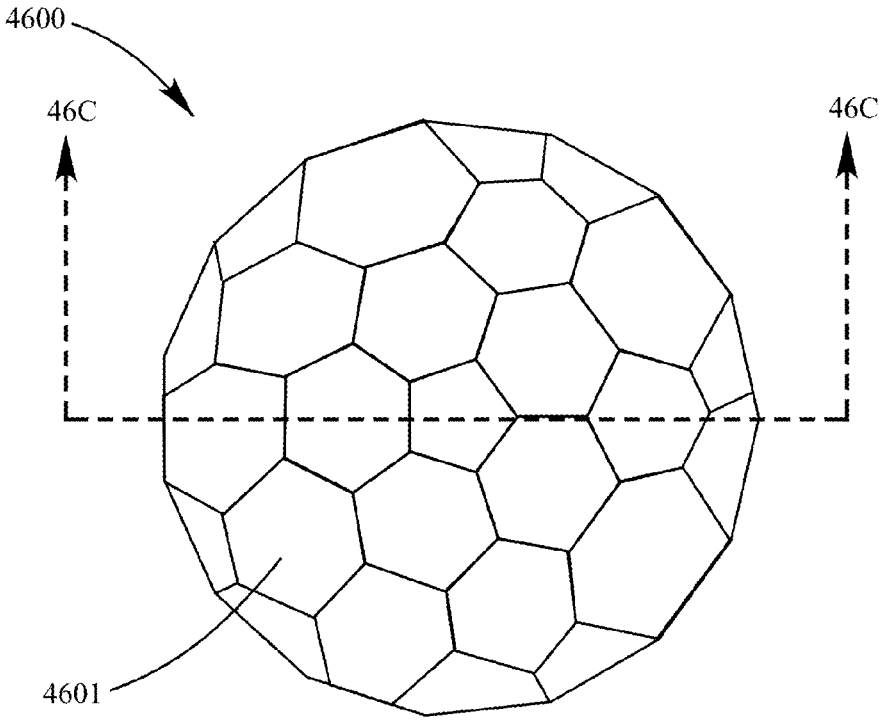
FIG. 46A is a top view of a hexagonal tiled gas discharge radiation shielding device.

FIG. 46A shows a top view of a domed gas discharge structure 4600 with hexagonal tiled substrates 4601 forming the structure. Each hexagonal substrate 4601 is tiled and sealed edge to edge to another substrate 4601 and comprises an array of pixel elements not shown in FIG. 46A for screening or shielding radiation. The array of pixel elements can be of any technology including plasma, LED, LCD, OLED, or electrophoretic. Other technologies are possible. Each pixel element can emit UV, visible, and/or infrared light, alone or in combination. Each pixel on each tiled substrate 4601 may be electronically controlled alone or in combination with other pixels on the same tile or on other tiles.

Figure 46B:
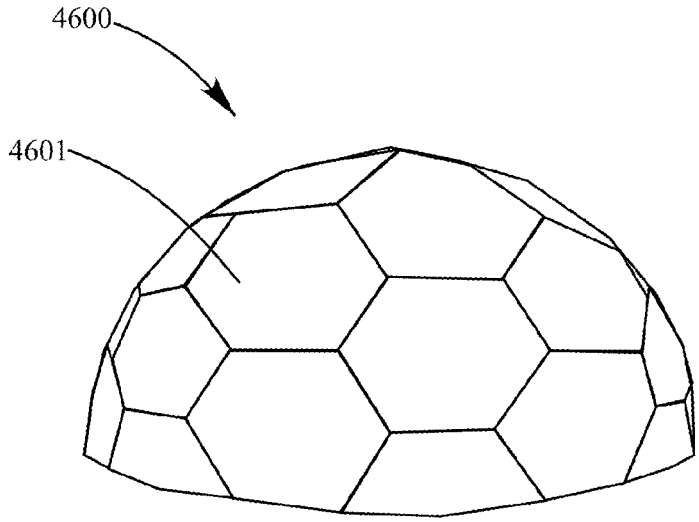
FIG. 46B is a side view of a hexagonal tiled gas discharge radiation shielding device.

FIG. 46B shows a left or right side view of the domed gas discharge radiation structure 4600 with hexagonal tiled substrates 4601 forming the structure. Each hexagonal tile 4601 comprises an array of pixel elements not shown in FIG. 46B. The array of pixel elements can be of any technology including plasma, LED, LCD, OLED, or electrophoretic. Other technologies are possible. Each pixel element can emit UV, visible, and/or infrared light, alone or in combination. Each pixel on each tiled substrate 4601 may be electronically controlled alone or in combination with other pixels on the same tile or on other tiles.

Figure 46C:
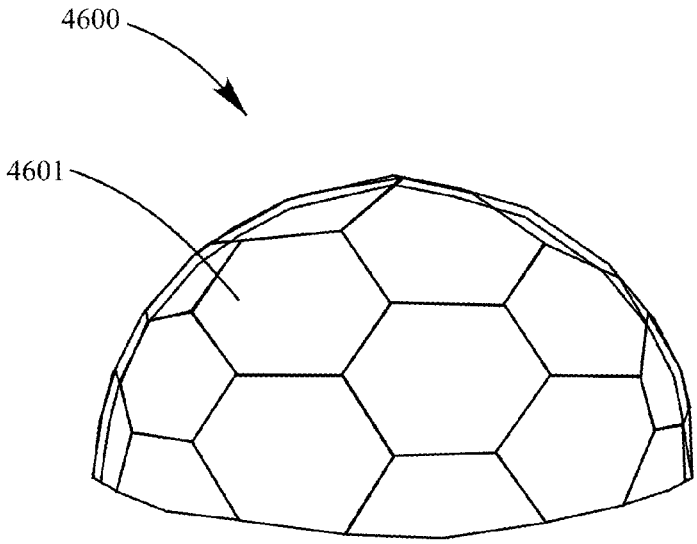
FIG. 46C is a section view of a hexagonal tiled gas discharge radiation shielding device.

FIG. 46C shows a section view of a hexagonal tiled substrate structure 4600, comprised of a plurality of hexagonal tiled substrates 4601.

Figure 46D:
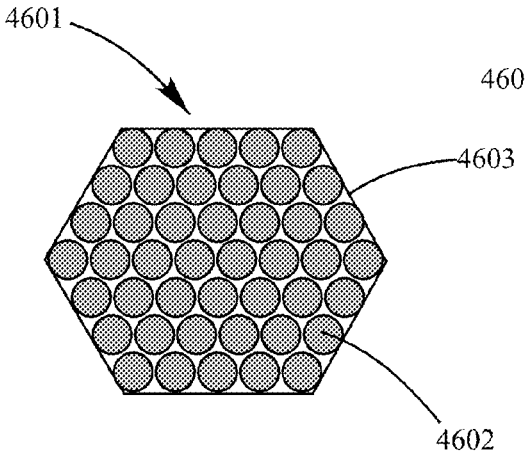
FIG. 46D is a top view of a single hexagonal tile.

FIG. 46D shows a top view of a single hexagonal substrate 4601 with plasma-shells 4602 mounted to the substrate 4603.

Figure 46E:
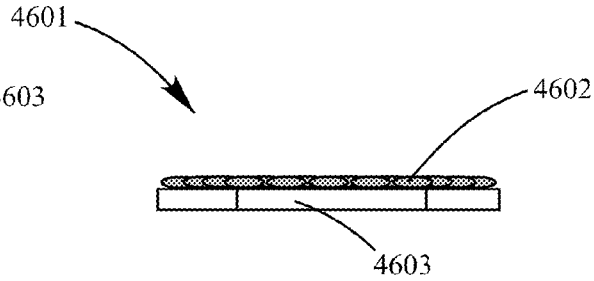
FIG. 46E is a side view of a single hexagonal tile.

FIG. 46E shows a side view of the single hexagonal substrate 4601 with the plasma-shells 4602 mounted to the substrate 4603. The substrate 4603 may be rigid, flexible, or semi-flexible.

Figure 47:
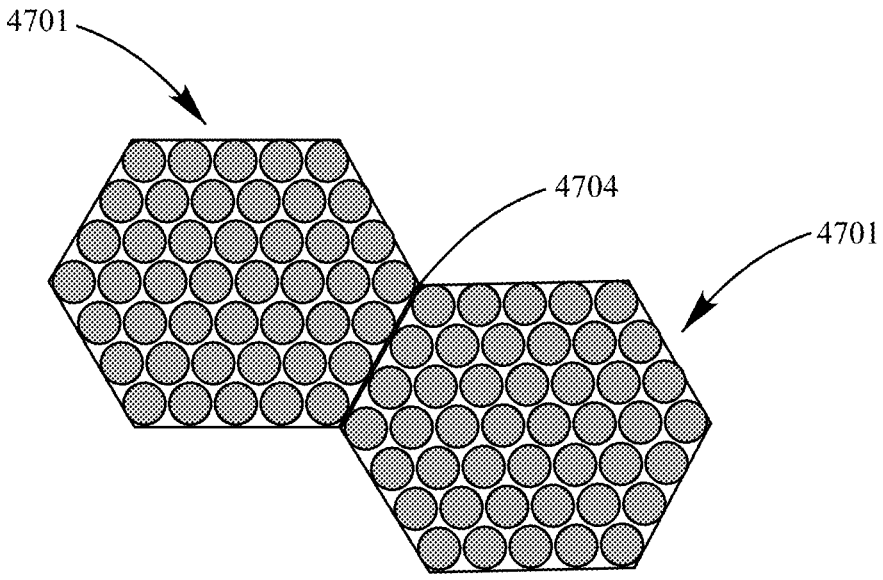
FIG. 47 shows two single hexagonal substrate tiles tiled and sealed together edge to edge.

FIG. 47 shows two single hexagonal substrates 4701 tiled and sealed together edge to edge with seal 4704.

A range of various means can be used for optically and/or electronically processing, recording, monitoring and/or analyzing data from the plasma-shells and/or plasma-tubes, including fiber optic systems, amplifiers, cameras, video monitors, computers, and so forth. Examples are disclosed in U.S. Patent Application Publication Nos. 2007/0205891, 2007/0274426, 2007/0294059, and 2008/0121809, all incorporated herein by reference.

ADS

A basic electronics architecture for addressing and sustaining a surface discharge AC plasma display is called Address Display Separately (ADS). The ADS architecture may be used for a monochrome or multi-color display. The ADS architecture is disclosed in U.S. Pat. Nos. 5,541,618 (Shinoda) and 5,724,054 (Shinoda), incorporated herein by reference. Also see U.S. Pat. No. 5,446,344 (Kanazawa) and 5,661,500 (Shinoda et al.), both incorporated herein by reference. ADS sustains the entire panel (all rows) after the addressing of the entire panel. The addressing and sustaining are done separately, but not simultaneously. ADS may be used to address plasma-shells plasma-tubes in a PDP.

ALIS

The ALIS architecture uses a shared electrode or drive system as disclosed in U.S. Pat. Nos. 6,489,939 (Asso et al.), 6,498,593 (Fujimoto et al.), 6,531,819 (Nakahara et al.), 6,559,814 (Kanazawa et al.), 6,577,062 (Itokawa et al.), 6,603,446 (Kanazawa et al.), 6,630,790 (Kanazawa et al.), 6,636,188 (Kanazawa et al.), 6,667,579 (Kanazawa et al.), 6,667,728 (Kanazawa et al.), 6,703,792 (Kawada et al.), and U.S. Patent Application Publication 2004/0046509 (Sakita), all incorporated herein by reference. ALIS may be used to address plasma-shells and/or plasma-tubes in a PDP.

AWD

Address While Display (AWD) comprises write and/or erase address pulses interspersed with the sustain waveform including the incorporation of the pulses onto the sustain waveform. Such address pulses may be on top of the sustain and/or on a sustain notch or pedestal. For example see U.S. Pat. Nos. 3,801,861 (Petty et al.) and 3,803,449 (Schmersal), both incorporated herein by reference. FIGS. 1 and 3 of the Shinoda '054 ADS patent disclose AWD architecture as prior art. See High-Luminance and High-Contrast HDTV PDP with Overlapping Driving Scheme, J. Ryeom et al., pages 743 to 746, *Proceedings of the Sixth International Display Workshops*, IDW 99, Dec. 1-3, 1999, Sendai, Japan and U.S. Pat. No. 6,208,081 (Eo et al.), incorporated herein by reference. LG Electronics Inc. has disclosed a variation of AWD with a Multiple Addressing in a Single Sustain (MASS) in U.S. Pat. No. 6,198,476 (Hong et al.), incorporated herein by reference. Also see U.S. Pat. No. 5,914,563 (Lee et al.). AWD may be used to address plasma-shells of any suitable geometric shape.

Energy Recovery

Energy recovery is used for the efficient operation of a PDP. Examples of energy recovery architecture and circuits are well known in the prior art. These include U.S. Pat. Nos. 4,772,884 (Weber et al.), 4,866,349 (Weber et al.), 5,081,400 (Weber et al.), 5,438,290 (Tanaka), 5,642,018 (Marcotte), 5,670,974 (Ohba et al.), 5,808,420 (Rilly et al.) and 5,828,353 (Kishi et al.), all incorporated herein by reference.

Ramp Waveforms

Ramp or slope waveforms may be used in the practice of this invention. The prior art discloses both fast and slow rise slopes and ramps for the addressing of AC plasma displays. These include fast and slow rise slopes include U.S. Pat. Nos. 4,063,131 (Miller), 4,087,805 (Miller), 4,087,807 (Miavecz), 4,611,203 (Criscimagna), and 4,683,470 (Criscimagna et al.) all incorporated herein by reference.

Architecture for a ramp waveform address is disclosed in U.S. Pat. Nos. 5,745,086 (Weber), 6,738,033 (Hibino et al.), and 6,900,598 (Hibino et al.), all incorporated herein by reference.

Artifact Reduction

Artifact reduction techniques may be used in the practice of this invention. The PDP industry has used various techniques to reduce motion and visual artifacts in a PDP display. Pioneer of Tokyo, Japan has disclosed a technique called CLEAR for the reduction of false contour and related problems. See Development of New Driving Method for AC-PDPs by Tokunaga et al. of Pioneer *Proceedings of the Sixth International Display Workshops*, IDW 99, pages 787-790, Dec. 1-3, 1999, Sendai, Japan. Also see European Patent Application EP 1020838A1 by Tokunaga et al. of Pioneer. The CLEAR techniques disclosed in the above Pioneer IDW publication and Pioneer EP 1020838A1 are incorporated herein by reference.

SAS

In one embodiment, it is contemplated using SAS electronic architecture to address a PDP panel constructed of plasma-shells and/or plasma-tubes. SAS architecture comprises addressing one display section of a surface discharge PDP while another section of the PDP is being simultaneously sustained. This architecture is called Simultaneous Address and Sustain (SAS). SAS offers a unique electronic architecture, which is different from prior art columnar discharge and surface discharge electronics architectures including ADS, AWD, and MASS. It offers important advantages as discussed herein. In accordance with the practice of SAS with a surface discharge PDP, addressing voltage waveforms are applied to a surface discharge PDP having an array of data electrodes on a bottom or rear substrate and an array of at least two-electrodes on a top or front viewing substrate, one top electrode being a bulk sustain electrode x and the other top electrode being a row scan electrode y. The row scan electrode y may also be called a row sustain electrode because it performs the dual functions of both addressing and sustaining. An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y. In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP. In another embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x-electrodes. In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained. In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields. Addressing is the selective application of data to individual pixels. It includes the writing or erasing of individual pixels. Reset is a voltage pulse, which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield. In another embodiment of the SAS architecture, there is applied a slow rise time or slow ramp reset voltage as disclosed in U.S. Pat. No. 5,745,086 (Weber), cited above and incorporated herein by reference. As used herein slow rise time or slow ramp voltage is a bulk address commonly called a reset pulse with a positive or negative slope so as to provide a uniform wall charge at all pixels in the PDP. The slower the rise time of the reset ramp, the less visible the light or background glow from those off-pixels (not in the on-state) during the slow ramp bulk address. Less background glow is particularly desirable for increasing the contrast ratio, which is inversely proportional to the light-output from the off-pixels during the reset pulse. Those off-pixels, which are not in the on-state, will give a background glow during the reset. The slower the ramp, the less light output with a resulting higher contrast ratio. Typically the slow ramp reset voltages disclosed in the prior art have a slope of about 3.5 volts per microsecond with a range of about 2 to about 9 volts per microsecond. In the SAS architecture, it is possible to use slow ramp reset voltages below 2 volts per microsecond, for example about 1 to 1.5 volts per microsecond without decreasing the number of PDP rows, without decreasing the number of sustain pulses or without decreasing the number of subfields.

Positive Column Gas Discharge

In one embodiment of this invention, it is contemplated that the gas discharge device may be operating using positive column discharge. The use of plasma-shells allows the device to be operated with positive column gas discharge, for example as disclosed in prior art cited hereinafter and incorporated herein by reference. The discharge length inside the plasma-shell must be sufficient to accommodate the length of the positive column gas discharge, generally up to about 1400 micrometers. The following prior art references relate to positive column discharge and are incorporated herein by reference.

U.S. Pat. No. 6,184,848 (Weber) discloses the generation of a positive column gas plasma discharge wherein the plasma discharge evidences a balance of positively charged ions and electrons. The PDP discharge operates using the same fundamental principle as a fluorescent lamp, i.e., a PDP employs ultraviolet light generated by a gas discharge to excite visible light emitting phosphors. Weber discloses an inactive isolation bar.

PDP With Improved Drive Performance at Reduced Cost by James Rutherford, *Proceedings of the Ninth International Display Workshops*, Hiroshima, Japan, pages 837 to 840, Dec. 4-6, 2002, discloses an electrode structure and electronics for a positive column plasma display. Rutherford discloses the use of the isolation bar as an active electrode.

Additional positive column gas discharge prior art incorporated herein by reference include: Positive Column AC Plasma Display, Larry F. Weber, 23rd International Display Research Conference (IDRC 03), September 16-18, *Conference Proceedings*, pages 119-124, Phoenix, Ariz. Dielectric Properties and Efficiency of Positive Column AC PDP, Nagorny et al., 23rd International Display Research Conference (IDRC 03), Sep. 16-18, 2003, *Conference Proceedings*, P-45, pages 300-303, Phoenix, Ariz. Simulations of AC PDP Positive Column and Cathode Fall Efficiencies, Drallos et al., 23rd International Display Research Conference (IDRC 03), Sep. 16-18, 2003, *Conference Proceedings*, P-48, pages 304-306, Phoenix, Ariz., U.S. Pat. Nos. 6,376,995 (Kato et al.), 6,528,952 (Kato et al.), 6,693,389 (Marcotte et al.), 6,768,478 (Wani et al.), and U.S. Patent Application Publication 2003/0102812 (Marcotte et al.). Also incorporated herein by reference are U.S. Pat. Nos. 7,176,628, 7,157,854, and 7,122,961, all issued to Carol Ann Wedding.

Radio Frequency

Radio frequency (RF) can be used to cause and maintain a gas discharge in each shell. The use of RF in a gas discharge device is disclosed in U.S. Pat. Nos. 6,271,810 (Yoo et al.), 6,340,866 (Yoo), 6,473,061 (Lim et al.), 6,476,562 (Yoo et al.), 6,483,489 (Yoo et al.), 6,501,447 (Kang et al.), 6,605,897 (Yoo), 6,624,799 (Kang et al.), 6,661,394 (Choi), and 6,794,820 (Kang et al.), all incorporated herein by reference.

Shell Materials

The plasma-shell is constructed of any suitable material including glass, ceramic, plastic, metal, metalloids, and so forth. The material may be selected based on its transmissivity to the radiation to be absorbed and/or detected. The shell may be made of a radiation absorbing material (RAM) and/or a radiation sensing material. Suitable shell materials include inorganic compounds of metals and/or metalloids, including mixtures or combinations thereof which may be used as for radiation screening. Contemplated inorganic compounds include the oxides, carbides, nitrides, nitrates, silicates, silicides, aluminates, phosphates, sulfates, sulfides, borates, and borides.

The metals and/or metalloids are selected from lithium, sodium, potassium, rubidium, cesium, magnesium, calcium, strontium, barium, scandium, yttrium, lanthanum, cerium, praseodymium, neodymium, promethium, samarium, europium, gadolinium, terbium, erbium, actinium, thorium, protactinium, uranium, neptunium, titanium, zirconium, hafnium, vanadium, niobium, tantalum, chromium, molybdenum, tungsten, manganese, technetium, rhenium, iron, ruthenium, osmium, cobalt, rhodium, iridium, nickel, palladium, copper, silver, zinc, cadmium, boron, aluminum, gallium, indium, thallium, carbon, silicon, germanium, tin, lead, phosphorus, arsenic, antimony and bismuth.

Suitable inorganic materials include magnesium oxide(s), aluminum oxide(s), zirconium oxide(s), and silicon carbide(s) such as MgO, $Al_2O_3$, $ZrO_2$, $SiO_2$, and/or SiC.

In one embodiment, the shell is composed wholly or in part of one or more borides of one or more members of Group IIIB of the Periodic Table and/or the rare earths including both the Lanthanide Series and the Actinide Series of the Periodic Table.

Contemplated Group IIIB borides include scandium boride and yttrium boride. Contemplated rare earth borides of the Lanthanides and Actinides include lanthanum boride, cerium boride, praseodymium boride, neodymium boride, gadolinium boride, terbium boride, actinium boride, and thorium boride.

In one embodiment, the shell is composed wholly or in part of one or more Group IIIB and/or rare earth hexaborides with the Group IIIB and/or rare earth element being one or more members selected from Sc, Y, La, Ce, Pr, Nd, Sm, Eu, Gd, Tb, Dy, Ho, Yb, Ac, Th, Pa, and U. Examples include lanthanum hexaboride, cerium hexaboride, and gadolinium hexaboride.

Rare earth borides, including rare earth hexaboride compounds, and methods of preparation are disclosed in the following prior art, incorporated herein by reference: U.S. Patent Nos. 3,258,316 (Tepper et al.), 3,784,677 (Versteeg et al.), 4,030,963 (Gibson et al.), 4,260,525 (Olsen et al.), 4,999,176 (Iltis et al.), 5,238,527 (Otani et al.), 5,336,362 (Tanaka et al.), 5,837,165 (Otani et al.), and 6,027,670 (Otani et al.).

Group IIA alkaline earth borides are contemplated including borides of Mg, Ca, Ba, and Sr. In one embodiment, there is used a material containing trivalent rare earths and/or trivalent metals such as La, Ti, V, Cr, Al, Ga, and so forth having crystalline structure similar to the perovskite structure, for example as disclosed in U.S. Pat. No. 3,386,919 (Forrat), incorporated herein by reference.

The shell may also be composed of or contain carbides, borides, nitrides, silicides, sulfides, oxides and other compounds of metals and/or metalloids of Groups IV and V as disclosed and prepared in U.S. Pat. No. 3,979,500 (Sheppard et al.), incorporated herein by reference. Compounds including borides of Group IVB metals such as titanium, zirconium, and hafnium and Group VB metals such as vanadium, niobium, and tantalum are contemplated.

In one embodiment of this invention, the plasma-shell is made of fused particles of glass, ceramic, glass ceramic, refractory, fused silica, quartz, or like amorphous and/or crystalline materials including mixtures of such. In one embodiment, a ceramic material is selected based on its transmissivity to light after firing. This may include selecting ceramic material with various optical cutoff frequencies to produce various colors. One material contemplated for this application is aluminum oxide. Aluminum oxide is transmissive from the UV range to the IR range. Because it is transmissive in the UV range, luminescent materials such as phosphors excited by UV may be applied to the exterior of an aluminum oxide to produce various colors. The application of the phosphor to the exterior of the plasma-shell may be executed by any suitable means before or after the plasma-shell is positioned in the PDP. There may be several layers or coatings of phosphors, each of a different composition, applied to the exterior of the plasma-shell.

In one embodiment of this invention, the plasma-shell is made of an aluminate silicate or contains a layer of aluminate silicate. When the ionizable gas mixture contains helium, the aluminate silicate is especially beneficial in preventing the escape of helium. It is also contemplated that the plasma-shell may be made of lead silicates, lead phosphates, lead oxides, borosilicates, alkali silicates, aluminum oxides, and pure vitreous silica.

The plasma-shell may be made in whole or in part from one or more materials such as magnesium oxide having a sufficient Townsend coefficient. These include inorganic compounds of magnesium, calcium, strontium, barium, gallium, lead, aluminum, boron, and the rare earths especially lanthanum, cerium, actinium, and thorium. The contemplated inorganic compounds include oxides, carbides, nitrides, nitrates, silicates, silicides, aluminates, phosphates, sulphates, sulfides, borates, borides, and other inorganic compounds of the above and other elements.

The plasma-shell may also contain or be partially or wholly constructed of luminescent materials such as inorganic and/or organic phosphor(s). The phosphor may be a continuous or discontinuous layer or coating of inorganic and/or organic substance on the interior or exterior of the shell. Inorganic and/or organic luminescent particles may also be introduced inside the plasma-shell or embedded within the shell. Inorganic and/or organic luminescent quantum dots may also be incorporated into the shell.

One or more plasma-shells may be made of selected radiation detection or sensing materials including shell materials disclosed above and/or others known in the prior art. Radiation sensor or detector materials may be used such as CdZnTe, CdTe, ZnTe, ZnSe, CdSe, GaAs, PbCs, GaAlAs, and other substances as disclosed in U.S. Pat. Nos. 7,223,981 (Capote et al.), 7,223,982 (Chen et al.), and 6,740,885 (Wainer et al.), all incorporated herein by reference. Chen et al. '982 further discloses that Group II, III, and IV semiconductor single crystals of the above may be used.

The shell may be made of sensor materials including lithium and boron crystals such as $Li_2B_4O_7$ single crystal or $^6Li$ and $^{11}B$ or $^{10}B$ enriched $^6Li_2{}^{11}B_4O_7$ single crystal as disclosed in U.S. Pat. No. 7,095,029 (Katagiri), crystals of lithium tetraborate or alpha-barium borate as disclosed in U.S. Pat. No. 6,388,260 (Doty et al), alkali and alkali-earth compounds including halides, borates, sulfates, and oxides, as disclosed in U.S. Pat. No. 5,637,875 (Miller), all incorporated herein by reference.

The sensor or detection material may also be selected from organic or polymeric compounds such as π-conjugated molecules including π-conjugated polymers and polyaromatic hydrocarbons as disclosed by U.S. Pat. No. 7,186,987 (Doty et al.), incorporated herein by reference. Doty et al. '987 also discloses inorganic sensor materials such as mercuric iodide, lead iodide, thallium bromide, indium iodide, thallium bromoiodide, mercuric bromoiodide, and cadmium zinc telluride.

Sensor or detection materials are also disclosed in U.S. Pat. Nos. 7,271,395 (DeGeronimo), 7,105,827 (Lechner et al.), 5,434,415 (Terada et al.), 4,677,300 (Tawil et al.), 4,025,793 (Shaw et al.), and 3,452,198 (White), and U.S. Patent Application Publication Nos. 2008/0014643 (Bjorkholm), 2007/0237668 (Loureiro et al.), 2007/0235656 (Capote et al.), all incorporated herein by reference.

A plasma-shell may be made of combinations of different sensor materials to absorb and/or detect different levels and/or different kinds of radiation. Also there may be combinations of plasma-shells, each with a different sensor or detector material. The plasma-shells may be used to detect and distinguish between radiation of different wavelength, for example as disclosed in U.S. Pat. Nos. 3,743,995 (Riedl et al.), 4,224,520 (Greene et al.), 4,423,325 (Foss), 4,737,642 (Steil), and 4,948,976 (Baliga et al.), all incorporated herein by reference.

Conductive Plasma-Shell

The plasma-shell, especially in a DC PDP, may be made, wholly or in part, of a conductive material, for example, as disclosed in the prior art discussed herein below and incorporated by reference. The shell can include conductive materials particularly metals or metalloid oxides, such as used for electrodes, especially the cathode. The following references disclose conductive materials that can be used in the shell and/or electrodes.

U.S. Pat. No. 6,797,662 (Jaffrey) discloses electrically conductive ceramics. A metal oxide ceramic material such as alumina may be rendered electrically conductive through its thickness by the incorporation of silver into the material.

U.S. Pat. No. 6,631,062 (Minamisawa et al.) discloses an electrically conductive ceramic material and a process of producing same. The material comprises a compound containing at least one element belonging to the Group IIIA of the Periodic Table and $TiO_{2-x}$ where $(0<x<2)$ is in a range such that the $TiO_{2-x}$ $(0<x<2)$ accounts for 1% to 60% by weight % of the total amount of the ceramics, and at least part of the compound and the $TiO_{2-x}$ form a composite oxide.

U.S. Pat. No. 6,531,408 (Iwata et al.) discloses a method for growing zinc oxide based semi-conductor layers. U.S. Pat. No. 6,146,552 (Iga et al.) discloses a method for producing zinc oxide for low and high voltages. U.S. Pat. Nos. 5,770,113 (Iga et al.) and 5,739,742 (Iga et al.) disclose zinc oxide compositions including methods of preparation.

U.S. Pat. No. 5,795,502 (Terashi et al.) discloses electrically conducting ceramics and/or process for producing the same. The electrically conducting ceramics have as a chief crystalline phase a perovskite crystalline phase containing La, Cr and Mg and also having, in addition to the chief crystalline phase, an oxide phase containing La. The ceramics are dense, exhibit excellent sintering properties at low temperatures, have high electrical conductivity, and remain stable in a reducing atmosphere.

U.S. Pat. Nos. 5,656,203 (Mikesha) and 5,601,853 (Bednarz et al.) disclose electrically conductive ceramics with oxides of Al, Cr, and Mg such as alumina, chromia, and magnesia. Ceramics are disclosed which exhibit volume resistivities of 1012 ohm-cm or less at 20° C. and have excellent electrical stability and superior mechanical properties.

U.S. Pat. No. 5,604,048 (Nishihara et al.) discloses an electrically conducting ceramic having improved electrical conductivity, which comprises a perovskite-type composite oxide. U.S. Pat. No. 5,688,731 (Chatterjee et al.) discloses a ceramic composite containing doped zirconia having high electrical conductivity. These electrically conductive ceramics comprise tetragonal zirconia or a composite of zirconia-alumina and zirconium diboride. U.S. Pat. No. 5,397,920 (Tran) discloses light transmissive electrically conductive compositions including methods of preparation. U.S. Pat. No. 5,126,218 (Clarke) discloses a conductive ceramic substrate for batteries formed from a sub-stiochemetric titanium dioxide material. The disclosed preferred material is $TiO_x$, where x is in the region of 1.55 to 1.95.

U.S. Pat. No. 5,066,423 (Kubo et al.) discloses a conductive ceramic sintered body substantially free from large variation of electric resistivity, which consists essentially of: (a) a silicon nitride-base ceramic as a matrix; (b) 10% to 70% volume of a first conductive material which consists of one or more conductive compounds selected from carbides, nitrides, oxides and their composite compounds of transition metals in Groups IVA, VA and VIA of the Periodic Table; and (c) 0.1% to 50% volume of a second conductive material consisting of SiC; the first conductive material and the second conductive material serving to form paths for electric conduction. U.S. Pat. No. 4,795,723 (Nishikawa et al.) discloses an electrically conductive hot press sintered ceramic comprising boron nitride, titanium diboride and aluminum nitride and having a flexural strength of at least 900 kg/cm$^2$ with a specific resistance of 300 to 2,500 micro ohm-centimeter (μΩ-cm). U.S. Pat. No. 4,645,622 (Keck) discloses an electrically conductive ceramic having the composition $La_xCa_yMnO_3$ where x is 0.44 to 0.48, y is 0.42 to 0.50 and the sum of the mol numbers of La and Ca is between 1% to 15% (preferably about 10%) and smaller than the mol number of Mn.

U.S. Pat. No. 4,113,928 (Virkar et al.) discloses the preparation of dense, high strength, and electrically conductive ceramics containing β"-alumina. There is prepared a dense and strong polycrystalline β"-alumina-containing ceramic body exhibiting an electrical resistivity for sodium ion conduction at 300° C. of 9 ohm-cm or lower obtained directly after sintering and having a controlled fine microstructure exhibiting a uniform grain size under 50 micrometers. The reference discloses methods of uniformly distributing selected metal ions having a valence not greater than 2, e.g. lithium or magnesium, uniformly throughout the beta-type alumina composition prior to sintering to form β"-alumina. This uniform distribution allows more complete conversion of β-alumina to β"-alumina during sintering. As a result, the polycrystalline β"-alumina containing ceramic bodies obtained by these methods exhibit high density, low porosity, high strength, fine grain size (i.e. no grains over 25-50 micrometers with an average size under 5-10 micrometers), low electrical resistivity and a high resistance to degradation by water vapor in an ambient atmosphere.

Secondary Electron Emission

Secondary electron emission (Townsend coefficient) materials may be incorporated into the plasma-shell. Such may also be used in one or more electrodes in a DC PDP.

The use of secondary electron emission materials in a plasma display is known in the prior art and is disclosed in U.S. Pat. No. 3,716,742 (Nakayama et al.), incorporated herein by reference. The use of Group IIA compounds including magnesium oxide is disclosed in U.S. Pat. Nos. 3,836,393 and 3,846,171 incorporated herein by reference. The use of rare earth compounds in an AC plasma display is disclosed in U.S. Pat. Nos. 4,126,807, 4,126,809, and 4,494,038, all issued to Donald K. Wedding et al., and incorporated herein by reference. Lead oxide may also be used as a secondary electron material. Mixtures of secondary electron emission materials may be used.

In one embodiment and mode contemplated for the practice of this invention, a secondary electron emission material such as magnesium oxide is applied to part or all of the internal surface of a plasma-shell and/or to the electrodes, especially the cathode. The secondary electron emission material may also be on the external surface. The thickness of the magnesium oxide may range from about 250 Angstrom Units to about 20,000 Angstrom Units (Å) or more. The plasma-shell may be partially or completely made of a secondary electronic materials such as magnesium oxide and/or rare earth oxides. A secondary electron material may also be dispersed or suspended as particles within the ionizable gas such as with a fluidized bed. Phosphor particles may also be dispersed or suspended in the gas such as with a fluidized bed, and may also be added to the internal or external surface of the plasma-shell.

Magnesium oxide increases the ionization level through secondary electron emission that in turn leads to reduced gas discharge voltages. In one embodiment, the magnesium oxide is on the internal surface of the plasma-shell and phosphor is located on external surface of the plasma-shell. Magnesium oxide is susceptible to contamination. To avoid contamination, gas discharge (plasma) displays are assembled in clean rooms that are expensive to construct and maintain. In traditional plasma panel production, magnesium oxide is applied to an entire open substrate surface and is vulnerable to contamination. The adding of the magnesium oxide layer to the inside of a plasma-shell minimizes exposure of the magnesium oxide to contamination. The magnesium oxide may be applied to the inside of the plasma-shell by incorporating magnesium vapor as part of the ionizable gas or gases introduced into the plasma-shell while the plasma-shell is at an elevated temperature. This may be done with a fluidized bed or other means. The magnesium, rare earth, or other metal or metalloid, may be oxidized while at an elevated temperature. In one embodiment, the rare earth, or other metal or metalloid is introduced into the gas or gasses and is oxidized in situ while in the gas or inside the plasma-shell.

Contemplated secondary electron emission materials also include borides and other compounds listed above for the shell materials especially the rare earth hexaborides such as lanthanum hexaboride ($LaB_6$), gadolinium hexaboride ($GaB_6$), and cerium hexaboride ($CeB_6$). These and other secondary electron emission materials including magnesium oxide can be applied to an electrode, for example as disclosed in U.S. Pat. No. 7,145,612 (Sakai et al.). The rare earth hexaborides are disclosed as good electron-emitting materials in U.S. Pat. No. 5,837,165 (Otami et al.), incorporated herein by reference. Such materials are disclosed by Wedding '807, '809, and '038 cited above.

DC Plasma Memory Mode

The DC plasma memory mode operation of plasma-shells may be provided with resistor elements in series with the electronic drive circuits to provide the memory functionality. In one embodiment, the plasma-shell itself is made of materials that provide both appropriate resistance in series with the electronic circuits as well as electrical isolation between circuits. In another embodiment, the plasma-shell is comprised of both resistive material segments and insulating material segments that isolate resistive electrode members from one another. In another embodiment, portions of an insulating shell may be made into resistive electrode islands by locally diffusing conductive material into the insulating shell material. In another embodiment, conductive electrode elements may penetrate an insulating shell and the resistor is formed on the external surface of the shell. Resistive elements may also be provided elsewhere in the circuit external to the shell. U.S. Pat. No. 4,297,613 (Aboelfotoh) describes the use of external resistors.

A series circuit resistor provides plasma memory functionality by providing a voltage drop across the shell and creating an internal voltage across the gas that is somewhat lower than the externally applied voltage once the gas is ionized. For example, a plasma-shell may require a 200-volt ignition potential to turn ON a plasma discharge. An externally applied voltage waveform in excess of the required 200-volt ignition (gas discharge) voltage may be applied to the plasma-shell to cause gas discharge (ON state). After ignition, the externally applied voltage is reduced to below the 200-volt ignition value, i.e. 150 volts, to sustain the plasma-shell gas discharge in the ON state. Once the gas discharge current is flowing, the internal voltage within the plasma-shell will be redistributed due to the voltage drop across the resistor through which the discharge current is flowing. If the externally applied voltage across the plasma-shell is maintained at 150 volts, and the voltage drop across the resistor is 50 volts, the internal voltage drop across the ionizable gas will be 100 volts. In this mode, the gas discharge within the plasma-shell will continue as long as the externally applied voltage remains above the extinction level, 100 volts in this example. If the externally applied voltage temporarily falls below the extinction level, the gas discharge will be turned off and remain off. As long as the externally applied voltage does not exceed the ignition voltage, the gas discharge will be maintained in an OFF memory state. The plasma-shell gas discharge may be returned to the ON memory state when the externally applied voltage again exceeds the ignition voltage. Thus, an array of plasma-shells operating as a display device would have an operating voltage window of 100 volts, the difference between ignition voltage of 200 volts and the extinction voltage of 100 volts that is common to all of the plasma-shells in the array. Accordingly the ON and OFF states of any plasma-shell within the array may be independently controlled in memory mode. Once turned on, plasma-shell gas discharge may be sustained in the ON state as long as the externally applied voltage remains within the common voltage operating window; and plasma-shell gas discharge will be sustained in the OFF state when the voltage drops below the extinction level until the external voltage again exceeds the ignition voltage.

Sheet Resistance

A DC gas discharge shell may be made of a material having a sheet resistance to prevent or minimize electrical contact between electrodes connected to the shell. This may also enhance the operation of a DC gas discharge in the memory mode.

Sheet resistance is a measure of the resistance of the shell in a direction perpendicular to thickness, that is, in a direction around the surface of the shell. The term is commonly used in the semiconductor industry, for example, to evaluate semiconductor doping, metal deposition, and resistive paste printing. Sheet resistance is disclosed in U.S. Pat. Nos. 4,212,020 (Yariv et al.) and 6,657,439 (Harada), both incorporated herein by reference. A 4-point probe is generally used to measure sheet resistance. The volume of a sphere is $4/3\pi r^3$ where r is the sphere radius. To obtain the shell thickness t of a hollow sphere with an inside radius $r_i$ and an outside radius $r_o$:

$$t=4/3\pi r_o^3-4/3\pi r_i^3$$

$$t=4/3\pi(r_o^3-r_i^3)$$

As used herein, sheet resistance is the resistance of the sphere shell thickness t around the sphere.

Ionizable Gas

The hollow plasma-shell or plasma-tube contains one or more ionizable gas components that can be used to absorb radiation before gas discharge and/or during gas discharge. The gas discharge can be caused by the radiation. The gas can also be selected to absorb radiation alone or in combination with a shell material that absorbs radiation. Different shells may be filled with different gases for absorbing and/or detecting different kinds and/or levels of electromagnetic radiation.

The gas can also be used to detect or sense radiation before and/or during gas discharge. The gas can be selected to detect radiation alone or in combination with a shell material.

The UV spectrum is divided into regions. The near UV region is a spectrum ranging from about 340 nm to 450 nm (nanometers). The mid or deep UV region is a spectrum ranging from about 225 nm to 340 nm. The vacuum UV region is a spectrum ranging from about 100 nm to 225 nm. The PDP prior art has used vacuum UV to excite photoluminescent phosphors. In one embodiment of this invention, it is contemplated using a gas that provides UV over the entire spectrum ranging from about 100 nm to about 450 nm. A PDP operates with greater efficiency at the higher range of the UV spectrum, such as in the mid UV and/or near UV spectrum. In one preferred embodiment, there is selected a gas that emits gas discharge photons in the near UV range. In another embodiment, there is selected a gas which emits gas discharge photons in the mid UV range. In one embodiment, the selected gas emits photons from the upper part of the mid UV range through the near UV range, about 275 nm to 450 nm.

As used herein, ionizable gas or gas means one or more gas components. In the practice of this invention, the gas is typically selected from a mixture of the noble or rare gases of neon, argon, xenon, krypton, helium, and/or radon. The rare gas may be a Penning gas mixture. Other contemplated gases include nitrogen, $CO_2$, CO, mercury, halogens, excimers, oxygen, hydrogen, and mixtures thereof. Isotopes of the above and other gases are contemplated. These include isotopes of helium such as helium-3, isotopes of hydrogen such as deuterium (heavy hydrogen), tritium ($T^3$) and DT, isotopes of the rare gases such as xenon-129, and isotopes of oxygen such as oxygen-18. Other isotopes include deuterated gases such as deuterated ammonia ($ND_3$) and deuterated silane ($SiD_4$). A radioactive gas such as radon may be used in some applications alone or in combination with other gases.

In one embodiment, a two-component gas mixture (or composition) is used such as a mixture of neon and argon, neon and xenon, neon and helium, neon and krypton, neon and radon, argon and xenon, argon and krypton, argon and helium, argon and radon, xenon and krypton, xenon and helium, xenon and radon, krypton and helium, krypton and radon, and helium and radon. Specific two-component gas mixtures (compositions) include about 5% to 90% atoms of argon with the balance xenon. Another two-component gas mixture is a mother gas of neon containing 0.05% to 15% atoms of xenon, argon, and/or krypton. This can also be a three-component gas, four-component gas, or five-component gas by using quantities of an additional gas or gases selected from xenon, argon, krypton, and/or helium. In another embodiment, a three-component ionizable gas mixture is used such as a mixture of argon, xenon, and neon wherein the mixture contains at least 5% to 80% atoms of argon, up to 15% xenon, and the balance neon. The xenon is present in a minimum amount sufficient to maintain the Penning effect. Such a mixture is disclosed in U.S. Pat. No. 4,926,095 (Shinoda et al.), incorporated herein by reference. Other three-component gas mixtures include argon-helium-xenon, krypton-neon-xenon, and krypton-helium-xenon for example as disclosed in U.S. Pat. Nos. 5,510,678 (Sakai et al.) and 5,559,403 (Sakai et al.), both incorporated herein by reference.

U.S. Pat. No. 4,081,712 (Bode et al.), incorporated herein by reference, discloses the addition of helium to a gaseous medium of 90% to 99.99% atoms of neon and 10% to 0.01% atoms of argon, xenon, and/or krypton. In one embodiment, there is used a high concentration of helium with the balance selected from one or more gases of neon, argon, xenon, and nitrogen as disclosed in U.S. Pat. No. 6,285,129 (Park) incorporated herein by reference. Mercury may also be added to the rare gases as disclosed in U.S. Pat. No. 4,041,345 (Sahni), incorporated herein by reference.

A high concentration of xenon may also be used with one or more other gases as disclosed in U.S. Pat. No. 5,770,921 (Aoki et al.), incorporated herein by reference. Pure neon may be used and the plasma-shells operated using the architecture disclosed by U.S. Pat. No. 3,958,151 (Yano) discussed above and incorporated herein by reference.

Excimer gases may also be used as disclosed in U.S. Pat. Nos. 4,549,109 (Nighan et al.) and 4,703,229 (Nighan et al.), both incorporated herein by reference. Nighan et al. '109 and '229 disclose the use of excimer gases formed by the combination of halides with inert gases. The halides include fluorine, chlorine, bromine, and iodine. The inert gases include helium, xenon, argon, neon, krypton, and radon. Excimer gases may emit red, blue, green, or other color light in the visible range or light in the invisible range. The excimer gases may be used alone or in combination with phosphors. U.S. Pat. No. 6,628,088 (Kim et al.), incorporated herein by reference, also discloses excimer gases for a PDP.

Other gases are contemplated including $C_2H_2$—$CF_4$—Ar mixtures as disclosed in U.S. Pat. Nos. 4,201,692 (Christophorou et al.) and 4,309,307 (Christophorou et al.), both incorporated herein by reference. Also contemplated are gases disclosed in U.S. Pat. No. 4,553,062 (Ballon et al.), incorporated herein by reference. Other gases include sulfur hexafluoride, HF, $H_2S$, $SO_2$, SO, $H_2O_2$, and so forth.

There may also be used one or more gases selected from $BF_3$, $CO_2$, $C_4H_{10}$, $CH_4$, $C_2H_6$, $CF_4$, $C_3H_8$, $C_3H_6$, dimethyl ether, ethylene, $SF_6$, $CBr_4$, Freon 11, Freon 12, Freon 22, Freon 113, Freon 114, and Freon 502. Other gases including the above are disclosed in U.S. Pat. Nos. 6,727,504 (Doty), 4,910,149 (Okube et al.), 4,501,988 (Mitrofanov et al.), 4,148,619 (Taylor et al.), and U.S. Patent Application Publication 2006/0023828 (McGregor et al.), all incorporated herein by reference.

Gas Pressure

This invention allows the construction and operation of a gas discharge (plasma) display with gas pressures at or above 1 atmosphere. In the prior art, gas discharge (plasma) displays are operated with the ionizable gas at a pressure below atmospheric. Gas pressures above atmospheric are not used in the prior art because of structural problems. Higher gas pressures above atmospheric may cause the display substrates to separate, especially at elevations of 4000 feet or more above sea level. Such separation may also occur between the substrate and a viewing envelope or dome in a single substrate or monolithic plasma panel structure. In the practice of this invention, the gas pressure inside of the hollow plasma-shell may be equal to or less than atmospheric pressure or may be equal to or greater than atmospheric pressure. The typical sub-atmospheric pressure is about 150 to 760 Torr. However, pressures above atmospheric may be used depending upon the structural integrity of the plasma-shell. In one embodiment of this invention, the gas pressure inside of the plasma-shell is equal to or less than atmospheric, about 150 to 760 Torr, typically about 350 to about 650 Torr. In another embodiment of this invention, the gas pressure inside of the plasma-shell is equal to or greater than atmospheric. Depending upon the structural strength of the plasma-shell, the pressure above atmospheric may be about 1 to 250 atmospheres (760 to 190,000 Torr) or greater. Higher gas pressures increase the luminous efficiency of the plasma display.

Gas Discharge Structure

In one embodiment, the plasma-shells are used in a single substrate or monolithic gas discharge structure. Single substrate PDP structures are disclosed in U.S. Pat. Nos. 3,646,384 (Lay), 3,652,891 (Janning), 3,666,981 (Lay), 3,811,061 (Nakayama et al.), 3,860,846 (Mayer), 3,885,195 (Amano), 3,935,494 (Dick et al.), 3,964,050 (Mayer), 4,106,009 (Dick), 4,164,678 (Biazzo et al.), and 4,638,218 (Shinoda), all incorporated herein by reference. The plasma-shells may be positioned on the surface of a substrate and/or positioned in the substrate such as in channels, trenches, grooves, wells, cavities, hollows, and so forth. These channels, trenches, grooves, wells, cavities, hollows, etc., may extend through the substrate so that the plasma-shells positioned therein are viewed from either side of the substrate. The plasma-shells may also be positioned on or in a substrate within a dual substrate plasma display structure. Each shell is placed inside of a gas discharge (plasma) display device, for example, on the substrate along the channels, trenches or grooves between the barrier walls of a plasma display barrier structure such as disclosed in U.S. Pat. Nos. 5,661,500 (Shinoda et al.), 5,674,553 (Shinoda et al.), and 5,793,158 (Wedding), cited above and incorporated herein by reference. The plasma-shells may also be positioned within a cavity, well, hollow, concavity, or saddle of a plasma display substrate, for example as disclosed by U.S. Pat. No. 4,827,186 (Knauer et al.), incorporated herein by reference. In a device as disclosed by Wedding '158 or Shinoda et al. '500, the plasma-shells are conveniently added to the substrate cavities and the space between opposing electrodes before the device is sealed. AC plasma displays of 40 inches or larger are fragile with the risk of breakage during shipment and handling. The presence of the plasma-shells inside of the display device adds structural support and integrity to the device. The plasma-shells may be sprayed, stamped, pressed, poured, screen-printed, or otherwise applied to the substrate. The substrate surface may contain an adhesive or sticky surface to bind the plasma-shell to the substrate. The practice of this invention is not limited to a flat surface display. The plasma-shell may be positioned or located on a curved or irregular surface. The substrate may be rigid, semi-flexible, or flexible.

Substrate

In accordance with various embodiments of this invention, the gas discharge device may be comprised of a single substrate or dual substrate device with flexible, semi-flexible, or rigid substrates. The substrate may be opaque, transparent, translucent, or non-light transmitting. In some embodiments, there may be used multiple substrates of two, three, or more. Substrates may be flexible films, such as a polymeric film substrate. The flexible substrate may also be made of metallic materials alone or incorporated into a polymeric substrate. Alternatively or in addition, one or both substrates may be made of an optically transparent thermoplastic polymeric material. Examples of such materials are polycarbonate, polyvinyl chloride, polystyrene, polymethyl methacrylate, polyurethane polyimide, polyester, and cyclic polyolefin polymers. More broadly, the substrates may include a flexible plastic such as a material selected from the group consisting of polyether sulfone (PES), polyester terephthalate, polyethylene terephthalate (PET), polyethylene naphtholate, polycarbonate, polybutylene terephthalate, polyphenylene sulfide (PPS), polypropylene, polyester, aramid, polyamide-imide (PAI), polyimide, aromatic polyimides, polyetherimide, acrylonitrile butadiene styrene, and polyvinyl chloride, as disclosed in U.S. Patent Application Publication 2004/0179145 (Jacobsen et al.), incorporated herein by reference. Alternatively, one or both of the substrates may be made of a rigid material. For example, one or both of the substrates may be a glass substrate. The glass may be a conventionally available glass, for example having a thickness of approximately 0.2-1 mm. Alternatively, other suitable transparent materials may be used, such as a rigid plastic or a plastic film. The plastic film may have a high glass transition temperature, for example above 65° C., and may have a transparency greater than 85% at 530 nm. Further details regarding substrates and substrate materials may be found in International Publications Nos. WO 00/46854, WO 00/49421, WO 00/49658, WO 00/55915, and WO 00/55916, the entire disclosures of which are incorporated herein by reference. Apparatus, methods, and compositions for producing flexible substrates are disclosed in U.S. Pat. No. 5,469,020 (Herrick), 6,274,508 (Jacobsen et al.), 6,281,038 (Jacobsen et al.), 6,316,278 (Jacobsen et al.), 6,468,638 (Jacobsen et al.), 6,555,408 (Jacobsen et al.), 6,590,346 (Hadley et al.), 6,606,247 (Credelle et al.), 6,665,044 (Jacobsen et al.), and 6,683,663 (Hadley et al.), all of which are incorporated herein by reference.

Positioning of Plasma-Shell on Substrate

The plasma-shell may be positioned or located in the substrate or on the substrate surface by any appropriate means. In one embodiment of this invention, the plasma-shell is bonded to the surface of a monolithic or dual-substrate display such as a PDP. The plasma-shell may be bonded to the substrate surface with a non-conductive, adhesive material, which also serves as an insulating barrier to prevent electrically shorting of the conductors or electrodes connected to the plasma-shell. The plasma-shell may be mounted or positioned within a substrate well, cavity, hollow, or like depression. The well, cavity, hollow or depression is of suitable dimensions with a mean or average diameter and depth for receiving and retaining the plasma-shell. As used herein well includes cavity, hollow, depression, hole, or any similar configuration. In U.S. Pat. No. 4,827,186 (Knauer et al.), there is shown a cavity referred to as a concavity or saddle. The depression, well, or cavity may extend partly through the substrate or extended entirely through the substrate. The cavity may comprise an elongated channel, trench, or groove extending partially or completely across the substrate. The electrodes are typically in direct contact with each plasma-shell. An air gap between an electrode and the plasma-shell can cause high operating voltages. A material such as conductive adhesive, and/or conductive filler may be used to bridge or connect the electrode to the plasma-shell. Such conductive material must be carefully applied so as to not electrically short an electrode to other nearby electrodes. A dielectric material, adhesive, or other materials may also be applied to fill any air gap.

Insulating Barrier

The insulating barrier may comprise any suitable non-conductive material, which bonds the plasma-shell to the substrate. In one embodiment, there is used an epoxy resin that is the reaction product of epichlorohydrin and bisphenol-A. One such epoxy resin is a liquid epoxy resin, D.E.R. 383, produced by the Dow Plastics group of the Dow Chemical Company.

Light Barriers

Light barriers of opaque, translucent, or non-transparent material may be located between plasma-shells to prevent optical cross-talk between plasma-shells, particularly between adjacent plasma-shells. A black material such as carbon filler may be used.

Electrically Conductive Bonding Substance

In the practice of this invention, the conductors or electrodes are electrically connected to each plasma-shell with an electrically conductive bonding substance. The electrically conductive bonding substance can be any suitable inorganic or organic material including compounds, mixtures, dispersions, pastes, liquids, cements, and adhesives. In one embodiment, the electrically conductive bonding substance is an organic substance with conductive filler material. Contemplated organic substances include adhesive monomers, dimers, trimers, polymers and copolymers of materials such as polyurethanes, polysulfides, silicones, and epoxies. A wide range of other organic or polymeric materials may be used. Contemplated conductive filler materials include conductive metals or metalloids such as silver, gold, platinum, copper, chromium, nickel, aluminum, and carbon. The conductive filler may be of any suitable size and form such as particles, powder, agglomerates, or flakes of any suitable size and shape. The particles, powder, agglomerates, or flakes may comprise a non-metal, metal, or metalloid core with an outer layer, coating, or film of conductive metal. Examples of conductive filler materials include silver-plated copper beads, silver-plated glass beads, silver particles, silver flakes, gold-plated copper beads, gold-plated glass beads, gold particles, gold flakes, and so forth. In one particular embodiment of this invention there is used an epoxy filled with 60% to 80% by weight silver. Electrically conductive bonding substances are known in the art. The disclosures including the compositions of the following references are incorporated herein by reference. U.S. Pat. No. 3,412,043 (Gilliland) discloses an electrically conductive composition of silver flakes and resinous binder. U.S. Pat. No. 3,983,075 (Marshall et al.) discloses a copper filled electrically conductive epoxy. U.S. Pat. No. 4,247,594 (Shea et al.) discloses an electrically conductive resinous composition of copper flakes in a resinous binder. U.S. Pat. Nos. 4,552,607 (Frey) and 4,670,339 (Frey) disclose a method of forming an electrically conductive bond using copper microspheres in an epoxy. U.S. Pat. No. 4,880,570 (Sanborn et al.) discloses an electrically conductive epoxy-based adhesive selected from the amine curing modified epoxy family with a filler of silver flakes. U.S. Pat. No. 5,183,593 (Durand et al.) discloses an electrically conductive cement comprising a polymeric carrier such as a mixture of two epoxy resins and filler particles selected from silver agglomerates, particles, flakes, and powders. The filler may be silver-plated particles such as inorganic spheroids plated with silver. Other noble metals and non-noble metals such as nickel are disclosed. U.S. Pat. No. 5,298,194 (Carter et al.) discloses an electrically conductive adhesive composition comprising a polymer or copolymer of polyolefins or polyesters filled with silver particles. U.S. Pat. No. 5,575,956 (Hermansen et al.) discloses electrically-conductive, flexible epoxy adhesives comprising a polymeric mixture of a polyepoxide resin and an epoxy resin filled with conductive metal powder, flakes, or non-metal particles having a metal outer coating. The conductive metal is a noble metal such as gold, silver, or platinum. Silver-plated copper beads and silver-plated glass beads are also disclosed. U.S. Pat. No. 5,891,367

(Basheer et al.) discloses a conductive epoxy adhesive comprising an epoxy resin cured or reacted with selected primary amines and filled with silver flakes. The primary amines provide improved impact resistance. U.S. Pat. No. 5,918,364 (Kulesza et al.) discloses substrate bumps or pads formed of electrically conductive polymers filled with gold or silver. U.S. Pat. No. 6,184,280 (Shibuta) discloses an organic polymer containing hollow carbon microfibers and an electrically conductive metal oxide powder. In another embodiment, the electrically conductive bonding substance is an organic substance without a conductive filler material. Examples of electrically conductive bonding substances are well known in the art. The disclosures including the compositions of the following references are incorporated herein by reference. U.S. Pat. No. 5,645,764 (Angelopoulos et al.) discloses electrically conductive pressure sensitive polymers without conductive fillers. Examples of such polymers include electrically conductive substituted and unsubstituted polyanilines, substituted and unsubstituted polyparaphenylenes, substituted and unsubstituted polyparaphenylene vinylenes, substituted and unsubstituted polythiophenes, substituted and unsubstituted polyazines, substituted and unsubstituted polyfuranes, substituted and unsubstituted polypyrroles, substituted and unsubstituted polyselenophenes, substituted and unsubstituted polyphenylene sulfides and substituted and unsubstituted polyacetylenes formed from soluble precursors. Blends of these polymers are suitable for use as are copolymers made from the monomers, dimers, or trimers, used to form these polymers. Electrically conductive polymer compositions are also disclosed in U.S. Pat. Nos. 5,917,693 (Kono et al.), 6,096,825 (Garnier), and 6,358,438 (Isozaki et al.). The electrically conductive polymers disclosed above may also be used with conductive fillers. In some embodiments, organic ionic materials such as calcium stearate may be added to increase electrical conductivity. See U.S. Pat. No. 6,599,446 (Todt et al.), incorporated herein by reference. In one embodiment hereof, the electrically conductive bonding substance is luminescent, for example as disclosed in U.S. Pat. No. 6,558,576 (Brielmann et al.), incorporated herein by reference.

EMI/RFI Shielding

In some embodiments, electroconductive bonding substances may be used for EMI (electromagnetic interference) and/or RFI (radio-frequency interference) shielding. Examples of such EMI/RFI shielding are disclosed in U.S. Pat. Nos. 5,087,314 (Sandborn et al.) and 5,700,398 (Angelopoulos et al.), both incorporated herein by reference.

Electrodes

One or more hollow plasma-shells containing the ionizable gas are located within the display panel structure, each plasma-shell being in contact with at least two-electrodes. In accordance with this invention, the contact is made by an electrically conductive bonding substance applied to each shell so as to form an electrically conductive pad for connection to the electrodes. A dielectric substance may also be used in lieu of or in addition to the conductive substance. Each electrode pad may partially cover the outside shell surface of the plasma-shell. The electrodes and pads may be of any geometric shape or configuration. In one embodiment the electrodes are opposing arrays of electrodes, one array of electrodes being transverse or orthogonal to an opposing array of electrodes. The electrode arrays can be parallel, zigzag, serpentine, or like pattern as typically used in dot-matrix gas discharge (plasma) displays. The use of split or divided electrodes is contemplated as disclosed in U.S. Pat. Nos. 3,603,836 (Grier) and 3,701,184 (Grier), both incorporated herein by reference. Apertured electrodes may be used as disclosed in U.S. Pat. Nos. 6,118,214 (Marcotte) and 5,411,035 (Marcotte) and U.S. Patent Application Publication 2004/0001034 (Marcotte), all incorporated herein by reference. The electrodes are of any suitable conductive metal or alloy including gold, silver, aluminum, or chrome-copper-chrome. If a transparent electrode is used on the viewing surface, this is typically indium tin oxide (ITO) or tin oxide with a conductive side or edge bus bar of silver. Other conductive bus bar materials may be used such as gold, aluminum, or chrome-copper-chrome. The electrodes may partially cover the external surface of the plasma-shell. The electrode array may be divided into two portions and driven from both sides with dual scan architecture as disclosed in U.S. Pat. Nos. 4,233,623 (Pavliscak) and 4,320,418 (Pavliscak), both incorporated herein by reference. A flat plasma-shell surface is particularly suitable for connecting electrodes to the plasma-shell. If one or more electrodes connect to the bottom of the plasma-shell, a flat bottom surface is desirable. Likewise, if one or more electrodes connect to the top or sides of the plasma-shell it is desirable for the connecting surface of such top or sides to be flat. The electrodes may be applied to the substrate or to the plasma-shells by thin film methods such as vapor phase deposition, e-beam evaporation, sputtering, conductive doping, etc. or by thick film methods such as screen printing, ink jet printing, etc. In a matrix display, the electrodes in each opposing transverse array are transverse to the electrodes in the opposing array so that each electrode in each array forms a crossover with an electrode in the opposing array, thereby forming a multiplicity of crossovers. Each crossover of two opposing electrodes forms a discharge point or cell. At least one hollow plasma-shell containing ionizable gas is positioned in the gas discharge (plasma) display device at the intersection of at least two opposing electrodes. When an appropriate voltage potential is applied to an opposing pair of electrodes, the ionizable gas inside of the plasma-shell at the crossover is energized and a gas discharge occurs. Photons of light in the visible and/or invisible range are emitted by the gas discharge.

Shell Geometry

The plasma-shells may be of any suitable volumetric shape or geometric configuration that encapsulates the ionizable gas independently of the substrate. The size of the shells may vary over a wide range, from a mean or average diameter of about 50 microns to about 5000 microns or more. If light output in the visible or invisible range is desired, luminescent materials may be incorporated in the shell or located in close proximity to the shell.

Organic Luminescent Substance

Organic luminescent substances may be used alone or in combination with inorganic luminescent substances. Contemplated combinations include mixtures and/or selective layers of organic and inorganic substances. In accordance with one embodiment of this invention, an organic luminescent substance is located in close proximity to the enclosed gas discharge within a plasma-shell, so as to be excited by photons from the enclosed gas discharge. In accordance with one embodiment of this invention, an organic photoluminescent substance is positioned on at least a portion of the external surface of a plasma-shell, so as to be excited by photons from the gas discharge within the plasma-shell, such that the excited photoluminescent substance emits visible and/or invisible light. As used herein organic luminescent substance comprises one or more organic compounds, monomers, dimers, trimers, polymers, copolymers, or like organic materials, which emit visible and/or invisible light when excited by photons from the gas discharge inside of the plasma-shell. Such organic luminescent substance may include one or more organic photoluminescent phosphors selected from organic photoluminescent compounds, organic photoluminescent monomers, dimers, trimers, polymers, copolymers, organic photoluminescent dyes, organic photoluminescent dopants, and/or any other organic photoluminescent material. All are collectively referred to herein as organic photoluminescent phosphor. Organic photoluminescent phosphor substances contemplated herein include those organic light emitting diodes or devices (OLED) and organic electroluminescent (EL) materials, which emit light when excited by photons from the gas discharge of a gas plasma discharge. OLED and organic EL substances include the small molecule organic EL and the large molecule or polymeric OLED. Small molecule organic EL substances are disclosed in U.S. Pat. Nos. 4,720,432 (VanSlyke et al.), 4,769,292 (Tang et al.), 5,151,629 (VanSlyke), 5,409,783 (Tang et al.), 5,645,948 (Shi et al.), 5,683,823 (Shi et al.), 5,755,999 (Shi et al.), 5,908,581 (Chen et al.), 5,935,720 (Chen et al.), 6,020,078 (Chen et al.), 6,069,442 (Hung et al.), 6,348,359 (VanSlyke et al.), and 6,720,090 (Young et al.), all incorporated herein by reference. The small molecule organic light emitting devices may be called SMOLED.

Large molecule or polymeric OLED substances are disclosed in U.S. Pat. Nos. 5,247,190 (Friend et al.), 5,399,502 (Friend et al.), 5,540,999 (Yamamoto et al.), 5,900,327 (Pei et al.), 5,804,836 (Heeger et al.), 5,807,627 (Friend et al.), 6,361,885 (Chou), and 6,670,645 (Grushin et al.), all incorporated herein by reference. The polymer light emitting devices may be called PLED.

Organic luminescent substances also include OLEDs doped with phosphorescent compounds as disclosed in U.S. Pat. No. 6,303,238 (Thompson et al.), incorporated herein by reference. Organic photoluminescent substances are also disclosed in U.S. Patent Application Publication Nos. 2002/0101151 (Choi et al.), 2002/0063525 (Choi et al.), 2003/0003225 (Choi et al.), and 2003/0052596 (Yi et al.); U.S. Pat. Nos. 6,610,554 (Yi et al.) and 6,692,326 (Choi et al.); and International Publications WO 02/104077 and WO 03/046649, all incorporated herein by reference.

In one embodiment, the organic luminescent phosphorous substance is a color-conversion-media (CCM) that converts light (photons) emitted by the gas discharge to visible or invisible light. Examples of CCM substances include the fluorescent organic dye compounds. In another embodiment, the organic luminescent substance is selected from a condensed or fused ring system such as a perylene compound, a perylene based compound, a perylene derivative, a perylene based monomer, dimer or trimer, a perylene based polymer, and/or a substance doped with a perylene.

Photoluminescent perylene phosphor substances are widely known in the prior art. U.S. Pat. No. 4,968,571 (Gruenbaum et al.), incorporated herein by reference, discloses photoconductive perylene materials, which may be used as photoluminescent phosphorous substances. U.S. Pat. No. 5,693,808 (Langhals), incorporated herein by reference, discloses the preparation of luminescent perylene dyes. U.S. Patent Application Publication 2004/0009367 (Hatwar), incorporated herein by reference, discloses the preparation of luminescent materials doped with fluorescent perylene dyes. U.S. Pat. No. 6,528,188 (Suzuki et al.), incorporated herein by reference, discloses the preparation and use of luminescent perylene compounds. These condensed or fused ring compounds are conjugated with multiple double bonds and include monomers, dimers, trimers, polymers, and copolymers. In addition, conjugated aromatic and aliphatic organic compounds are contemplated including monomers, dimers, trimers, polymers, and copolymers. Conjugation as used herein also includes extended conjugation. A material with conjugation or extended conjugation absorbs light and then transmits the light to the various conjugated bonds. Typically the number of conjugate-double bonds ranges from about 4 to about 15. Further examples of conjugate-bonded or condensed/fused benzene rings are disclosed in U.S. Pat. Nos. 6,614,175 (Aziz et al.) and 6,479,172 (Hu et al.), both incorporated herein by reference. U.S. Patent Application Publication 2004/0023010 (Bulovic et al.) discloses luminescent nanocrystals with organic polymers including conjugated organic polymers. Cumulene is conjugated only with carbon and hydrogen atoms. Cumulene becomes more deeply colored as the conjugation is extended. Other condensed or fused ring luminescent compounds may also be used including naphthalimides, substituted naphthalimides, naphthalimide monomers, dimers, trimers, polymers, copolymers and derivatives thereof including naphthalimide diester dyes such as disclosed in U.S. Pat. No. 6,348,890 (Likavec et al.), incorporated herein by reference.

The organic luminescent substance may be an organic lumophore, for example as disclosed in U.S. Pat. Nos. 5,354,825 (Klainer et al.), 5,480,723 (Klainer et al.), 5,700,897 (Klainer et al.), and 6,538,263 (Park et al.), all incorporated herein by reference. Also lumophores are disclosed in S. E. Shaheen et al., *Journal of Applied Physics*, Vol. 84, Number 4, pages 2324 to 2327, Aug. 15, 1998; J. D. Anderson et al., *Journal American Chemical Society* 1998, Vol. 120, pages 9646 to 9655; and Gyu Hyun Lee et al., *Bulletin of Korean Chemical Society,* 2002, Vol. 23, NO. 3, pages 528 to 530, all incorporated herein by reference. The organic luminescent substance may be applied by any suitable method to the external surface of the plasma-shell, to the substrate or to any location in close proximity to the gas discharge contained within the plasma-shell. Such methods include thin film deposition methods such as vapor phase deposition, sputtering and E-beam evaporation. Also thick film or application methods may be used such as screen-printing, ink jet printing, and/or slurry techniques. Small size molecule OLED materials are typically deposited upon the external surface of the plasma-shell by thin film deposition methods such as vapor phase deposition or sputtering. Large size molecule or polymeric OLED materials are deposited by so called thick film or application methods such as screen-printing, ink jet, and/or slurry techniques. If the organic luminescent substance such as a photoluminescent phosphor is applied to the external surface of the plasma-shell, it may be applied as a continuous or discontinuous layer or coating such that the plasma-shell is completely or partially covered with the luminescent substance.

Inorganic Luminescent Substances

Inorganic luminescent substances may be used alone or in combination with organic luminescent substances. Contemplated combinations include mixtures and/or selective layers of organic and/or inorganic substances. The shell may be made of an inorganic luminescent substance. In one embodiment the inorganic luminescent substance is incorporated into the particles forming the shell structure. Typical inorganic luminescent substances are listed below.

Green Phosphor

A green light-emitting phosphor may be used alone or in combination with other light-emitting phosphors such as blue or red. Phosphor materials which emit green light include $Zn_2SiO_4$:Mn, ZnS:Cu, ZnS:Au, ZnS:Al, ZnO:Zn, CdS:Cu, CdS:$Al_2$, $Cd_2O_2S$:Tb, and $Y_2O_2S$:Tb. In one mode and embodiment of this invention, there is used a green light-emitting phosphor selected from the zinc orthosilicate phosphors such as $ZnSiO_4:Mn^{2+}$. Green light-emitting zinc orthosilicates including the method of preparation are disclosed in U.S. Pat. No. 5,985,176 (Rao), incorporated herein by reference. These phosphors have a broad emission in the green region when excited by 147 nm and 173 nm (nanometer) radiation from the discharge of a xenon gas mixture. In another mode and embodiment, there is used a green light-emitting phosphor which is a terbium activated yttrium gadolinium borate phosphor such as (Gd, Y) $BO_3:Tb^{3+}$. Green light-emitting borate phosphors including the method of preparation are disclosed in U.S. Pat. No. 6,004,481 (Rao), incorporated herein by reference. In another mode and embodiment, there is used a manganese activated alkaline earth aluminate green phosphor as disclosed in U.S. Pat. No. 6,423,248 (Rao), peaking at 516 nm when excited by 147 and 173 nm radiation from xenon. The particle size ranges from 0.05 to 5 microns. Rao '248 is incorporated herein by reference. Terbium doped phosphors may also emit in the blue region especially in lower concentrations of terbium. For some display applications such as television, it is desirable to have a single peak in the green region at 543 nm. A blue peak can be eliminated with a filter containing a blue absorption dye. Green light-emitting terbium-activated lanthanum cerium orthophosphate phosphors are disclosed in U.S. Pat. No. 4,423,349 (Nakajima et al.), which is incorporated herein by reference. Green light-emitting lanthanum cerium terbium phosphate phosphors are disclosed in U.S. Pat. No. 5,651,920 (Chau et al.), which is incorporated herein by reference. Green light-emitting phosphors may also be selected from the trivalent rare earth ion-containing aluminate phosphors as disclosed in U.S. Pat. No. 6,290,875 (Oshio et al.).

Contemplated green light-emitting phosphors are also disclosed by U.S. Patent Nos. 6,861,797 (Onimaru et al.), 6,998,779 (Choi), 7,025,902 (Rao), 7,037,445 (Nukuta et al.), 7,170,222 (Choi et al.), 7,202,595 (Lee), 7,268,492 (Tanaka et al.), 7,358,668 (Kwon), 7,372,196 (Juestel et al.), 7,396,489 (Horikawa et al.), and 7,410,599 (Rao), all incorporated herein by reference.

Blue Phosphor

A blue light-emitting phosphor may be used alone or in combination with other light-emitting phosphors such as green or red. Phosphor materials which emit blue light include ZnS:Ag, ZnS:Cl, and CsI:Na. In one embodiment, there is used a blue light-emitting aluminate phosphor. An aluminate phosphor which emits blue visible light is divalent europium ($Eu^{2+}$) activated Barium Magnesium Aluminate (BAM) represented by $BaMgAl_{10}O_{17}:Eu^{2+}$. BAM is widely used as a blue phosphor in the PDP industry. BAM and other aluminate phosphors, which emit blue visible light, are disclosed in U.S. Pat. Nos. 5,611,959 (Kijima et al.) and 5,998,047 (Bechtel et al.), both incorporated herein by reference. The aluminate phosphors may also be selectively coated as disclosed by Bechtel et al. '047. Blue light-emitting phosphors may be selected from a number of divalent europium-activated aluminates such as disclosed in U.S. Pat. No. 6,096,243 (Oshio et al.) incorporated herein by reference. The preparation of BAM phosphors for a PDP is also disclosed in U.S. Pat. No. 6,045,721 (Zachau et al.), incorporated herein by reference. In another mode and embodiment, the blue light-emitting phosphor is thulium activated lanthanum phosphate with trace amounts of $Sr^{2+}$ and/or $Li^{+}$. This exhibits a narrow band emission in the blue region peaking at 453 nm when excited by 147 nm and 173 nm radiation from the discharge of a xenon gas mixture. Blue light-emitting phosphate phosphors including the method of preparation are disclosed in U.S. Pat. Nos. 5,989,454 (Rao) and 6,187,225 (Rao), both of which are incorporated herein by reference. In one mode and embodiment of this invention using a blue-emitting phosphor, a mixture or blend of about 85% to 70% by weight of a lanthanum phosphate phosphor activated by trivalent thulium ($Tm^{3+}$), $Li^{+}$, and an optional amount of an alkaline earth element ($AE^{2+}$) as a coactivator and about 15% to 30% by weight of divalent europium-activated BAM phosphor or divalent europium-activated Barium Magnesium, Lanthanum Aluminated (BLAMA) phosphor. Such a mixture is disclosed in U.S. Pat. No. 6,187,225 (Rao), incorporated herein by reference. A blue BAM phosphor with partially substituted $Eu^{2+}$ is disclosed in U.S. Pat. No. 6,833,672 (Aoki et al.), incorporated herein by reference. Blue light-emitting phosphors also include $ZnO.Ga_2O_3$ doped with Na or Bi. The preparation of these phosphors is disclosed in U.S. Pat. Nos. 6,217,795 (Yu et al.) and 6,322,725 (Yu et al.), both incorporated herein by reference. Other blue light-emitting phosphors include europium activated strontium chloroapatite and europium-activated strontium calcium chloroapatite.

Blue phosphors are also disclosed in U.S. Pat. Nos. 7,067,969 (Aoki et al.), 7,138,965 (Shiiki et al.), 7,285,913 (Okuyama et al.), 7,288,889 (Kawamura et al.), and 7,390,437 (Dong et al.), all incorporated herein by reference.

Red Phosphor

A red light-emitting phosphor may be used alone or in combination with other light-emitting phosphors such as green or blue. Phosphor materials which emit red light include $Y_2O_2S$:Eu and $Y_2O_3S$:Eu. In one embodiment, there is used a red light-emitting phosphor which is an europium activated yttrium gadolinium borate phosphor such as (Y,Gd) $BO_3:Eu^{3+}$. The composition and preparation of these red light-emitting borate phosphors is disclosed in U.S. Pat. Nos. 6,042,747 (Rao) and 6,284,155 (Rao), both incorporated herein by reference. These europium activated yttrium, gadolinium borate phosphors emit an orange line at 593 nm and red emission lines at 611 and 627 nm when excited by 147 nm and 173 nm UV radiation from the discharge of a xenon gas mixture. The orange line (593 nm) may be minimized or eliminated with an optical filter. A wide range of red light-emitting phosphors are used in the PDP industry and are contemplated in the practice of this invention including europium-activated yttrium oxide for example as disclosed in U.S. Pat. Nos. 3,368,980 (Avella et al.) and 3,569,762 (Levine), both incorporated herein by reference. Contemplated phosphors are also disclosed in U.S. Pat. Nos. 6,509,685 (Justel et al.) and 7,436,108 (Kim et al.), both incorporated herein by reference.

Other Phosphors

There also may be used phosphors other than red, blue, green such as a white light-emitting phosphor, pink light-emitting phosphor or yellow light-emitting phosphor. These may be used with an optical filter. Phosphor materials which emit white light include calcium compounds such as $3Ca_3(PO_4)_2.CaF:Sb$, $3Ca_3(PO_4)_2.CaF:Mn$, $3Ca_3(PO_4)_2.CaCl:Sb$, and $3Ca_3(PO_4)_2.CaCl:Mn$. White light-emitting phosphors are disclosed in U.S. Pat. No. 6,200,496 (Park et al.) incorporated herein by reference. Pink light-emitting phosphors are disclosed in U.S. Pat. No. 6,200,497 (Park et al.) incorporated herein by reference. Phosphor material, which emits yellow light, include ZnS:Au.

Organic and Inorganic Luminescent Substances

Inorganic and organic luminescent materials may be used in selected combinations. In one embodiment, multiple layers of luminescent materials are applied to the plasma-shell with at least one layer being organic and at least one layer being inorganic. An inorganic layer may serve as a protective overcoat for an organic layer. In another embodiment, the shell of the plasma-shell comprises or contains inorganic luminescent material. In another embodiment, organic and inorganic luminescent materials are mixed together and applied as a layer inside or outside the shell. The shell may also be made of or contain a mixture of organic and inorganic luminescent materials. In one preferred embodiment, a mixture of organic and inorganic material is applied outside the shell.

Photon Exciting of Luminescent Substance

In one embodiment contemplated in the practice of this invention, a layer, coating, or particles of inorganic and/or organic luminescent substances such as phosphor is located on part or all of the exterior wall surfaces of the plasma-shell. The photons of light pass through the shell or wall(s) of the plasma-shell and excite the organic or inorganic photoluminescent phosphor located outside of the plasma-shell. Typically this is red, blue, or green light. However, phosphors may be used which emit other light such as white, pink, or yellow light. In some embodiments of this invention, the emitted light may not be visible to the human eye. Up-conversion or down-conversion phosphors may be used. The phosphor may be located on the side wall(s) of a channel, trench, barrier, groove, cavity, well, hollow or like structure of the discharge space. The gas discharge within the channel, trench, barrier, groove, cavity, well or hollow produces photons that excite the inorganic and/or organic phosphor such that the phosphor emits light in a range visible to the human eye. In prior art AC plasma display structures as disclosed in U.S. Pat. Nos. 5,793,158 (Wedding) and 5,661,500 (Shinoda et al.), inorganic and/or organic phosphor is located on the wall(s) or side(s) of the barriers that form the channel, trench, groove, cavity, well, or hollow, phosphor may also be located on the bottom of the channel, trench or groove as disclosed by Shinoda et al. '500 or the bottom cavity, well, or hollow as disclosed by U.S. Pat. No. 4,827,186 (Knauer et al.). The plasma-shells are positioned within or along the walls of a channel, barrier, trench, groove, cavity, well or hollow so as to be in close proximity to the phosphor such that photons from the gas discharge within the plasma-shell cause the phosphor along the wall(s), side(s) or at the bottom of the channel, barrier, trenches groove, cavity, well, or hollow, to emit light. In one embodiment of this invention, phosphor is located on the outside surface of each plasma-shell. In this embodiment, the outside surface is at least partially covered with phosphor that emits light in the visible or invisible range when excited by photons from the gas discharge within the plasma-shell. The phosphor may emit light in the visible, UV, and/or IR range. In one embodiment, phosphor is dispersed and/or suspended within the ionizable gas inside each plasma-shell. In such embodiment, the phosphor particles are sufficiently small such that most of the phosphor particles remain suspended within the gas and do not precipitate or otherwise substantially collect on the inside wall of the plasma-shell. The average diameter of the dispersed and/or suspended phosphor particles is less than about 1 micron, typically less than 0.1 microns. Larger particles can be used depending on the size of the plasma-shell. The phosphor particles may be introduced by means of a fluidized bed. The luminescent substance such as an inorganic and/or organic luminescent phosphor may be located on all or part of the external surface of the plasma-shells on all or part of the internal surface of the plasma-shells. The phosphor may comprise particles dispersed or floating within the gas. In another embodiment, the luminescent material is incorporated into the shell of the plasma-shell. The inorganic and/or organic luminescent substance is located on the external surface and is excited by photons from the gas discharge inside the plasma-shell. The phosphor emits light in the visible range such as red, blue, or green light. Phosphors may be selected to emit light of other colors such as white, pink, or yellow. The phosphor may also be selected to emit light in non-visible ranges of the spectrum. Optical filters may be selected and matched with different phosphors. The phosphor thickness is sufficient to absorb the UV, but thin enough to emit light with minimum attenuation. Typically the phosphor thickness is about 2 to 40 microns, preferably about 5 to 15 microns. In one embodiment, dispersed or floating particles within the gas are typically spherical or needle shaped having an average size of about 0.01 to 5 microns. A UV photoluminescent phosphor is excited by UV in the range of 50 to 400 nanometers. The phosphor may have a protective layer or coating which is transmissive to the excitation UV and the emitted visible light. Such include organic films such as perylene or inorganic films such as aluminum oxide or silica. Protective overcoats are disclosed and discussed below. Because the ionizable gas is contained within a multiplicity of plasma-shells, it is possible to provide a custom gas mixture or composition at a custom pressure in each plasma-shell for each phosphor. In the prior art, it is necessary to select an ionizable gas mixture and a gas pressure that is optimum for all phosphors used in the device such as red, blue, and green phosphors. However, this requires trade-offs because a particular gas mixture may be optimum for a particular green phosphor, but less desirable for red or blue phosphors. In addition, trade-offs are required for the gas pressure. In the practice of this invention, an optimum gas mixture and an optimum gas pressure may be provided for each of the selected phosphors. Thus the gas mixture and gas pressure inside the plasma-shells may be optimized with a custom gas mixture and a custom gas pressure, each or both optimized for each phosphor emitting red, blue, green, white, pink, or yellow light in the visible range or light in the invisible range. The diameter and the wall thickness of the plasma-shell can also be adjusted and optimized for each phosphor. Depending upon the Paschen Curve (pd v. voltage) for the particular ionizable gas mixture, the operating voltage may be decreased by optimized changes in the gas mixture, gas pressure, and the dimensions of the plasma-shell including the distance between electrodes.

Up-Conversion

In one embodiment, there is used an inorganic and/or organic luminescent substance such as a phosphor for up-conversion. Up-conversion materials including phosphors are disclosed in U.S. Pat. Nos. 5,541,012 (Ohwaki et al.), 6,028,977 (Newsome), 6,265,825 (Asano), and 6,624,414 (Glesener), all incorporated herein by reference. Up-conversion may also be obtained with shell compositions such as thulium doped silicate glass containing oxides of Si, Al, and La, as disclosed in U.S. Patent Application Publication 2004/0037538 (Schardt et al.), incorporated herein by reference. The glasses of Schardt et al. '538 emit visible or UV light when excited by IR. Glasses for up-conversion are also disclosed in Japanese Patent Publications 9054562 (Akira et al.) and 9086958 (Akira et al.), both incorporated herein by reference.

U.S. Pat. No. 5,166,948 (Gavrilovic), incorporated herein by reference, discloses an up-conversion crystalline structure. U.S. Pat. No. 5,290,730 (McFarlane et al.) discloses a single crystal halide-based up-conversion substance. It is contemplated that the shell may be constructed wholly or in part from an up-conversion material, down-conversion material or a combination of both.

Down-Conversion

The luminescent material may also include down-conversion materials including phosphors as disclosed in U.S. Pat. Nos. 6,013,538 (Burrows et al.), 6,091,195 (Forrest et al.), 6,208,791 (Bischel et al.), 6,534,916 (Ito et al.), 6,566,156 (Sturm et al.), 6,650,045 (Forrest et al.), and 7,141,920 (Oskam et al.), all incorporated herein by reference. As noted above, the shell may be constructed wholly or in part from a down-conversion material, up-conversion material or a combination of both.

Both up-conversion and down-conversion materials are disclosed in U.S. Pat. Nos. 3,623,907 (Watts), 3,634,614 (Geusic), 3,838,307 (Masi), and U.S. Patent Application Publication Nos. 2004/0159903 (Burgener, II et al.), 2004/0196538 (Burgener, II et al.), and 2005/0094109 (Sun et al.), all incorporated herein by reference. U.S. Pat. No. 6,726,992 (Yadav et al.), incorporated herein by reference, discloses nano-engineered luminescent materials including both up-conversion and down-conversion phosphors.

Quantum Dots

In one embodiment of this invention, the luminescent substance is a quantum dot material. Examples of luminescent quantum dots are disclosed in International Publication Numbers WO 03/038011, WO 00/029617, WO 03/038011, WO 03/100833, and WO 03/037788, all incorporated herein by reference. Luminescent quantum dots are also disclosed in U.S. Pat. No. 6,468,808 (Nie et al.), 6,501,091 (Bawendi et al.), 6,698,313 (Park et al.), and published U.S. Patent Application Publication 2003/0042850 (Bertram et al.), all incorporated herein by reference. The quantum dots may be added or incorporated into the shell during shell formation or after the shell is formed.

Protective Overcoat

In a one embodiment, the luminescent substance is located on an external surface of the plasma-shell. Organic luminescent phosphors are particularly suitable for placing on the exterior shell surface, but may require a protective overcoat. The protective overcoat may be inorganic, organic, or a combination of inorganic and organic. This protective overcoat may be an inorganic and/or organic luminescent material. The luminescent substance may have a protective overcoat such as a clear or transparent acrylic compound including acrylic solvents, monomers, dimers, trimers, polymers, copolymers, and derivatives thereof to protect the luminescent substance from direct or indirect contact or exposure with environmental conditions such as air, moisture, sunlight, handling, or abuse. The selected acrylic compound is of a viscosity such that it can be conveniently applied by spraying, screen print, ink jet, or other convenient methods so as to form a clear film or coating of the acrylic compound over the luminescent substance. Other organic compounds may also be suitable as protective overcoats including silanes such as glass resins. Also the polyesters such as Mylar® may be applied as a spray or a sheet fused under vacuum to make it wrinkle free. Polycarbonates may be used but may be subject to UV absorption and detachment. In one embodiment hereof the luminescent substance is coated with a film or layer of a perylene compound including monomers, dimers, trimers, polymers, copolymers, and derivatives thereof. The perylene compounds are widely used as protective films. Specific compounds including poly-monochloro-para-xylyene (Parylene C) and poly-para-xylylene (Parylene N). Parylene polymer films are also disclosed in U.S. Pat. Nos. 5,879,808 (Wary et al.) and 6,586,048 (Welch et al.), both incorporated herein by reference. The perylene compounds may be applied by ink jet printing, screen printing, spraying, and so forth as disclosed in U.S. Patent Application Publication 2004/0032466 (Deguchi et al.), incorporated herein by reference. Parylene conformal coatings are covered by Mil-I-46058C and ISO 9002. Parylene films may also be induced into fluorescence by an active plasma as disclosed in U.S. Pat. No. 5,139,813 (Yira et al.), incorporated herein by reference. Phosphor overcoats are also disclosed in U.S. Pat. Nos. 4,048,533 (Hinson et al.), 4,315,192 (Skwirut et al.), 5,592,052 (Maya et al.), 5,604,396 (Watanabe et al.), 5,793,158 (Wedding), and 6,099,753 (Yoshimura et al.), all incorporated herein by reference. In some embodiments, the luminescent substance is selected from materials that do not degrade when exposed to oxygen, moisture, sunlight, etc. and that may not require a protective overcoat. Such include various organic luminescent substances such as the perylene compounds disclosed above. Perylene compounds may be used as protective overcoats.

Tinted Plasma-Shells

In the practice of this invention, the plasma-shell may be color tinted or constructed of materials that are color tinted with red, blue, green, yellow, or like pigments. This is disclosed in U.S. Pat. No. 4,035,690 (Roeber) cited above and incorporated herein by reference. The gas discharge may also emit color light of different wavelengths as disclosed in Roeber '690. The use of tinted materials and/or gas discharges emitting light of different wavelengths may be used in combination with the above described phosphors and the light emitted from such phosphors. Optical filters may also be used.

Filters

This invention may be practiced in combination with an optical and/or electromagnetic (EMI) filter, screen, and/or shield. It is contemplated that the filter, screen, and/or shield may be positioned on a PDP constructed of plasma-shells, for example on the front or top-viewing surface. The plasma-shells may also be tinted. Examples of optical filters, screens, and/or shields are disclosed in U.S. Pat. Nos. 3,960,754 (Woodcock), 4,106,857 (Snitzer), 4,303,298, (Yamashita), 5,036,025 (Lin), 5,804,102 (Oi), and 6,333,592 (Sasa et al.), all incorporated herein by reference. Examples of EMI filters, screens, and/or shields are disclosed in U.S. Patent Nos. 6,188,174 (Marutsuka) and 6,316,110 (Anzaki et al.), incorporated herein by reference. Color filters may also be used. Examples are disclosed in U.S. Pat. Nos. 3,923,527 (Matsuura et al.), 4,105,577 (Yamashita), 4,110,245 (Yamashita), and 4,615,989 (Ritze), all incorporated herein by reference.

Mixtures of Luminescent Materials

It is contemplated that mixtures of luminescent materials may be used including inorganic and inorganic, organic and organic, and inorganic and organic. Dispersing inorganic materials into organic luminescent materials or vice versa may increase the brightness of the luminescent material. Stokes or Anti-Stokes materials may be used.

Layers of Luminescent Materials

Two or more layers of the same or different luminescent materials may be selectively applied to the plasma-shells. Such layers may comprise combinations of organic and organic, inorganic and inorganic, and/or inorganic and organic.

Plasma-Shells in Combination with Other Plasma-Shells

In the practice of this invention, plasma-shells of one geometric shape may be used alone or in combination with plasma-shells of other geometric shapes. Thus there may be combinations of two different plasma-shells such as plasma-spheres and plasma-discs, plasma-spheres and plasma-domes, plasma-discs and plasma-domes. Also combinations of three or more may be used such as plasma-spheres, plasma-discs, and plasma-domes.

Stacking of Plasma-Shells

Plasma-shells may be stacked especially plasma-shells with flat sides such as plasma-domes, plasma-discs, plasma-cubes or plasma-cuboids. These can be stacked on top of each other or arranged in parallel side-by-side positions on a substrate. This configuration requires less area of the substrate surface compared to a conventional structure and allows for close packing of plasma-shells to minimize voids or dead spaces. This stacking embodiment may be practiced with plasma-shells that use different phosphors or different gases.

Plasma-Shells Combined with Plasma-Tubes

The PDP structure may comprise plasma-tubes or a combination of plasma-tubes and plasma-shells. Plasma-tubes are elongated tubes for example as disclosed in U.S. Pat. Nos. 3,602,754 (Pfaender et al.), 3,654,680 (Bode et al.), 3,927,342 (Bode et al.), 4,038,577 (Bode et al.), 3,969,718 (Strom), 3,990,068 (Mayer et al.), 4,027,188 (Bergman), 5,984,747 (Bhagavatula et al.), 6,255,777 (Kim et al.), 6,633,117 (Shinoda et al.), 6,650,055 (Ishimoto et al.), 6,677,704 (Ishimoto et al.), 7,122,961 (Wedding), 7,157,854 (Wedding), and 7,176,628 (Wedding), all incorporated herein by reference. The elongated plasma-tube includes capillary, filament, filamentary, illuminator, hollow rod, or other such terms. It includes an elongated enclosed gas-filled structure having a length dimension that is substantially greater than its cross-sectional width dimension. The width of the plasma-tube is the viewing width from the top or bottom (front or rear) of the display. A plasma-tube has multiple gas discharge pixels of 100 or more, typically 500 to 1000 or more, whereas a plasma-shell typically has only one gas discharge pixel. In some embodiments, the plasma-shell may have more than one pixel, i.e., 2, 3, or 4 pixels up to 10 pixels. The length of each plasma-tube may vary depending upon the PDP structure. In one embodiment hereof, an elongated tube is selectively divided into a multiplicity of sections. In another embodiment, there is used a continuous tube that winds or weaves back and forth from one end to the other end of the PDP. The plasma-tubes may be arranged in any configuration. In one embodiment, there are alternative rows of plasma-shells and plasma-tubes. The plasma-tubes may be used for any desired function or purpose including the priming or conditioning of the plasma-shells. In one embodiment, the plasma-tubes are arranged around the perimeter of the display to provide priming or conditioning of the plasma-shells. The plasma-tubes may be of any geometric cross-section including circular, elliptical, square, rectangular, triangular, polygonal, trapezoidal, pentagonal, or hexagonal. The plasma-tube may contain secondary electron emission materials, luminescent materials, and reflective materials as discussed herein for plasma-shells. The plasma-tubes may also utilize positive column discharge as discussed herein for plasma-shells.

The plasma-tubes may be used for radiation shielding, radiation sensing or detection alone or in combination with plasma-shells.

The plasma-tubes may be made from the same materials as discussed above for plasma-shells including radiation shielding or radiation sensor or detecting materials. The plasma-tubes may be filled with the same gases as discussed above for plasma-shells including gases selected for radiation shielding or radiation sensing or detecting.

Tiled Substrates

In one embodiment, the substrates are tiled edge to edge using sealants such as polymeric seals including epoxy materials. Other sealing compounds include metallized film adhesives bonded to the tile edges and low temperature sintered sol-gel such as silica sol-gel.

The tiled substrates are sealed together edge to edge to form a self-supporting structure without the use of a supporting frame or other like support.

Tiling methods including sealing compounds and materials are disclosed in patents issued to Rainbow Displays, Endicott, N.Y. These include U.S. Pat. Nos. 6,693,684 (Greene et al.), 6,680,761 (Greene et al.), 6,639,643 (Babuka et al.), 6,476,886 (Krusius et al.), 6,262,696 (Seraphim et al.), 6,100,861 (Cohen et al.), 6,020,868 (Greene et al.), 6,005,649 (Krusius et al.), 5,963,281 (Koons et al.), 5,903,328 (Greene et al.), 5,889,568 (Seraphim et al.), 5,867,236 (Babuka et al.), 5,867,236 (Babuka et al.), 5,781,258 (Dabral et al.), 5,668,569 (Greene et al.), and 5,661,531 (Greene et al.), all incorporated herein by reference.

The tiling of the substrates may also be accomplished by sealing edge to edge or with a mullion made of any suitable material such as wood, stone, or a metal such as aluminum. Substrates may also be interconnected or inter-digitated through contacts along or on one or more edges. Mullions and other means for tiling substrates are disclosed in U.S. Pat. Nos. 7,592,970 (Matthies et al.), 7,394,194 (Cok), 7,358,929 (Mueller et al.), 7,295,179 (Dunn), 7,277,066 (Sundahl), 7,108,392 (Strip et al.), 6,999,138 (Cok), 6,940,501 (Seligson), 6,897,855 (Matthies et al.), 6,881,946 (Cok et al.), 6,870,519 (Sundahl), 6,690,337 (Mayer, III et al.), 6,683,665 (Matthies), 6,639,643 (Babuka et al.), 6,600,144 (Matthies), 6,571,043 (Lowry et al.), 6,498,592 (Matthies), 6,476,783

(Matthies et al.), 6,418,267 (Lowry), 6,396,985 (Lowry et al.), 6,262,696 (Seraphim et al.), 6,097,455 (Babuka et al.), 5,838,405 (Izumi et al.), 5,805,117 (Mazurek et al.), and 5,796,452 (Pierson), all incorporated herein by reference. Such are also disclosed in U.S. Patent Application Publication Nos. 2007/0103583 (Burnett et al.), 2007/0008259 (Barker), 2005/0134526 (Willem et al.), and European Patent Specification EP 0997865 (Tokimoto et al.), all incorporated herein by reference.

The substrates may be tiled to form a dome, a tunnel shape, or other structure suitable for detecting radiation from a source or for screening or shielding radiation from a source.

Medical Applications

The radiation shielding or radiation sensor or detector may be used in a wide range of medical applications including the shielding or measuring of radiation dosages in medical treatment and medical imaging systems. Examples of such medical systems are disclosed in U.S. Pat. Nos. 6,583,420 (Nelson et al.) and 5,786,597 (Lingren et al.), and U.S. Patent Application Publication Nos. 2002/0079456 (Lingren et al.) and 2001/0025928 (Lingren et al.), all incorporated herein by reference.

Other Embodiments

In one embodiment the gas-filled shells are operated with AC electronic waveforms, including an AC sustain pulse. The sustain pulse is adjusted to below the threshold voltage required to cause ionization or a gas discharge. Radiation from an exterior source will cause the gas in the shell to ionize or discharge and absorb the incoming radiation. The sensitivity of a single gas-filled hollow shell to radiation will depend on the level of the sustain voltage. The higher the sustain voltage, the more sensitive the gas will be to the radiation.

In another embodiment, the gas-filled shells are packed closely together to minimize radiation from passing in-between the shells. This can be ideally achieved with plasma-cubes and/or plasma-cuboids which can be packed together flat side by flat side. The stacking of the gas-filled shells in multiple layers also minimizes radiation from passing in-between shells. In this embodiment, an upper layer of shells is off-set relative to a lower layer of shells so as to cover-up any spaces in-between the shells in the lower layer.

SUMMARY

Aspects of this invention may be practiced with a co-planar or opposing substrate PDP as disclosed in the U.S. Pat. Nos. 5,793,158 (Wedding) and 5,661,500 (Shinoda et al.). There also may be used a single substrate or monolithic PDP as disclosed in the U.S. Pat. Nos. 3,646,384 (Lay), 3,860,846 (Mayer), 3,935,484 (Dick et al.), and other single substrate patents, discussed above and incorporated herein by reference. Although this invention has been disclosed and described above with reference to dot matrix gas discharge displays, it may also be used in an alphanumeric gas discharge display using segmented electrodes. This invention may also be practiced in AC or DC gas discharge displays including hybrid structures of both AC and DC gas discharge. The plasma-shells may contain both gases and solid substances for radiation shielding or radiation detection or sensing. Such substances may also include other display materials such as electroluminescent, liquid crystal, field emission, and electrophoretic materials. The use of plasma-shells on a flexible or bendable substrate allows the encapsulated pixel display device to be utilized in a number of radiation shielding or radiation detection applications. In this embodiment, a flexible sheet of plasma-shells may be provided as a blanket or cover over an object for radiation shielding or radiation detection. Likewise, the object may be passed through a ring or cylinder of plasma-shells. In lieu of a circular ring or cylinder, other geometric shapes may be used such as a triangle, square, rectangle, pentagon, hexagon, etc. In this invention, the radiation shielding or radiation detector device may be used in a number of applications including medical treatments, nuclear waste, and to detect radiation from a nuclear device, mechanism, or apparatus hidden in a container. It is particularly suitable for detecting hidden nuclear devices at airports, loading docks, bridges, ship holds, and other such locations.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. In an electromagnetic radiation device wherein an object or a person is screened or shielded from electromagnetic radiation, the improvement wherein said device comprises a single substrate and a multiplicity of hollow, gas-filled shells, said shells being located on one or more surfaces of the single substrate, the gas being selected to absorb the radiation in a non-discharge or discharge state.

2. The device of claim 1 wherein the gas-filled shells are located on opposite sides of the substrate.

3. The device of claim 1 wherein the geometric shape of the shells is a sphere, disc, dome, cube, or cuboid.

4. The device of claim 1 wherein one or more shells is made of a material that absorbs radiation.

5. The device of claim 1 wherein one or more shells is made of a radar absorbent material.

6. The device of claim 1 wherein the shells are stacked in two or more layers.

7. In an electromagnetic radiation device for screening or shielding an object or a person from electromagnetic radiation, the improvement wherein said device comprises two or more single substrates tiled and sealed together edge to edge, a multiplicity of hollow gas-filled shells being located on one or more surfaces of each tiled substrate, the gas being selected to absorb the radiation in a non-discharge or discharge state.

8. The device of claim 7 wherein the gas-filled shells are located on opposite sides of at least one of the tiled substrates.

9. The device of claim 7 wherein the shells are stacked in two or more layers on one or more surfaces of at least one tiled substrate.

10. The device of claim 7 wherein the geometric shape of the shells is a sphere, disc, dome, cube, or cuboid.

11. The device of claim 7 wherein one or more shells is made of a material that absorbs radiation.

12. The device of claim 7 wherein one or more shells is made of a radar absorbent material.

* * * * *